US007097523B2

(12) United States Patent
Woolley

(10) Patent No.: US 7,097,523 B2
(45) Date of Patent: Aug. 29, 2006

(54) FLYING SKI

(76) Inventor: Robert C. Woolley, 1222 Bracero La., Lake Havasu City, AZ (US) 86404

( * ) Notice: Subject to any disclaimer, the term of this patent is extended or adjusted under 35 U.S.C. 154(b) by 37 days.

(21) Appl. No.: 11/129,944

(22) Filed: May 16, 2005

(65) Prior Publication Data

US 2005/0255764 A1 Nov. 17, 2005

Related U.S. Application Data

(60) Provisional application No. 60/571,708, filed on May 17, 2004.

(51) Int. Cl.
*B63B 35/85* (2006.01)

(52) U.S. Cl. ..... 441/72; 114/253

(58) Field of Classification Search ..... 441/72; 114/253

See application file for complete search history.

(56) References Cited

U.S. PATENT DOCUMENTS

| | | | |
|---|---|---|---|
| 2,257,406 | A | 9/1941 | Von Burtenbach |
| 2,597,048 | A | 5/1952 | Almqvist et al. |
| 2,751,612 | A | 6/1956 | Shepard |
| 2,930,338 | A | 3/1960 | Flomenhoft |
| 2,931,332 | A | 4/1960 | Hebrank |
| 2,955,559 | A | 10/1960 | Palmer et al. |
| 3,003,778 | A | 10/1961 | Taggart |
| 3,085,537 | A | 4/1963 | Headrick et al. |
| 3,092,857 | A | 6/1963 | Churchman |
| 3,092,858 | A | 6/1963 | Wallach |
| 3,105,249 | A | 10/1963 | Palmore |
| 3,121,890 | A | 2/1964 | Rumsey, Jr. |

(Continued)

FOREIGN PATENT DOCUMENTS

| | | |
|---|---|---|
| AU | 652929 | 8/1992 |

(Continued)

OTHER PUBLICATIONS

Author Unknown, Air Chair & Sky Ski Gallary, advertisement from www.cyber-sea.com, web page printed on Jun. 16, 1998, 6 pages.

(Continued)

*Primary Examiner*—Jesus D. Sotelo
(74) *Attorney, Agent, or Firm*—Knobbe Martens Olson & Bear LLP

(57) ABSTRACT

The present flying ski is designed to be towed behind a conventional powered watercraft by a standard ski tow rope or similar device having a handle that can be held by a human rider. In use, the rider is seated on the seat of the flying ski and towed by the watercraft. The improved flying ski comprises an elongate board and a seat that extends generally perpendicular to and upward from the board to support the seated rider's buttocks. The seat preferably includes a flexible C-shaped member for absorbing impacts during use. The rider's legs extend toward the front of the board and are secured by a pair of foot holders that attach to the board. An elongate strut extends downward from the board and couples the seat to a planing blade. The elongate strut is preferably formed with a V-shape wherein the length from the front edge to the back edge of the strut is greater along an upper portion for enhanced structural integrity. The planing blade advantageously has a front blade and a rear blade interconnected by a fuselage. The rear blade may be located above the front blade for avoiding turbulence from the front blade. The present flying ski accommodates a variety of rider skill levels by incorporating a mechanism and system that allows the rider to selectively adjust performance characteristics of the ski.

10 Claims, 36 Drawing Sheets

U.S. PATENT DOCUMENTS

| | | | | | |
|---|---|---|---|---|---|
| 3,123,844 | A | * | 3/1964 | Bailey | 441/72 |
| 3,145,399 | A | | 8/1964 | Jackson | |
| 3,164,119 | A | | 1/1965 | Emmanuel et al. | |
| 3,182,341 | A | | 5/1965 | Rieffle | |
| 3,201,807 | A | | 8/1965 | Weaver | |
| 3,208,422 | A | | 9/1965 | Schopmeyer | |
| 3,216,031 | A | | 11/1965 | Ingold, Jr. | |
| 3,221,697 | A | | 12/1965 | Allegretti | |
| 3,221,698 | A | | 12/1965 | Turner | |
| 3,294,055 | A | | 12/1966 | McGuire | |
| 3,326,165 | A | | 6/1967 | Collins | |
| 3,455,264 | A | | 7/1969 | Castellani | |
| 3,472,192 | A | | 10/1969 | Yuan | |
| 3,547,063 | A | | 12/1970 | Folliett | |
| 3,604,031 | A | | 9/1971 | Cahill | |
| 3,617,070 | A | | 11/1971 | Roberts | |
| 3,651,775 | A | | 3/1972 | Kock | |
| 3,688,723 | A | | 9/1972 | Ulvesand et al. | |
| 3,744,811 | A | | 7/1973 | Johnston | |
| 3,747,138 | A | | 7/1973 | Morgan | |
| 3,803,653 | A | | 4/1974 | Trostad | |
| 4,050,397 | A | | 9/1977 | Vanderleest | |
| 4,193,609 | A | * | 3/1980 | Bissett | 280/28.14 |
| 4,361,103 | A | | 11/1982 | Willat | |
| 4,508,046 | A | | 4/1985 | Coulter et al. | |
| 4,669,992 | A | | 6/1987 | Morris | |
| 4,720,280 | A | | 1/1988 | Hufnagl et al. | |
| 4,811,674 | A | | 3/1989 | Stewart | |
| 4,857,026 | A | | 8/1989 | Hull | |
| 5,100,354 | A | * | 3/1992 | Woolley et al. | 441/65 |
| 5,136,961 | A | | 8/1992 | Follett | |
| 5,231,950 | A | | 8/1993 | Poulos | |
| 5,249,998 | A | * | 10/1993 | Woolley et al. | 441/65 |
| 5,544,607 | A | | 8/1996 | Rorabaugh et al. | |
| 6,070,543 | A | | 6/2000 | A'Lateef | |
| 6,234,856 | B1 | | 5/2001 | Woolley | |
| 6,443,786 | B1 | | 9/2002 | Woolley | |
| 6,443,787 | B1 | | 9/2002 | Woolley | |

FOREIGN PATENT DOCUMENTS

| | | |
|---|---|---|
| FR | 17387 | 8/1913 |
| FR | 1295926 | 5/1962 |
| SA | 91/2058 | 5/1993 |

OTHER PUBLICATIONS

Author Unknown, advertisement from BW Rotor Co., Inc. for Flying Water Ski, facsimile received on Jan. 25, 1994, 1 page.
Author Unknown, advertisement from BW Rotor Co., Inc. for Knee Ski, Sky Ski and Sky Bike, prior to May 22, 2001, 1 page.

* cited by examiner

FLYING SKI

RELATED APPLICATION

This application claims priority to provisional application Ser. No. 60/571,708, filed on May 17, 2004, the entire contents of which are hereby expressly incorporated by reference.

BACKGROUND OF THE INVENTION

1. Field of the Invention

This invention relates to recreational water equipment and, in particular, to a flying ski and method of use therefor.

2. Description of the Related Art and Summary of the Invention

U.S. Pat. Nos. 5,100,354 and 5,249,998 disclose an apparatus known as a flying ski. The flying ski is a device adapted to be towed behind a powered watercraft in a manner similar to a water ski. In contrast to a water ski, however, the rider sits on a seat spaced above the ski board and primarily rides on a blade structure that is spaced below the ski board by a vertical strut. When the ski is in use, the rider, seat and board are above the water surface and the blade structure is submerged below the water surface. The flying ski disclosed in the above-identified patents was a pioneering recreational water device.

While the basic flying ski structure remains highly desirable, a number of significant improvements have been developed. First, beginning riders with low skill levels can find the flying ski relatively difficult to operate and can become frustrated to the point that they do not attempt to use the ski again. Second, advanced riders with high skill levels can find the flying ski too easy to operate and insufficiently challenging. A modification that allows for quick adjustment of the flying ski, so as to alter the difficulty of maneuvering the ski would allow both skilled and novice riders to use the device at the same time. Third, the device is currently adapted only for those people who have full use and control of their lower bodies. An improvement to the device that allowed the flying ski to be used by paraplegics would be desirable. Lastly, the device currently has a safety belt that tends to wear out relatively quickly under the high stresses associated with normal use of the flying ski. A more desirable safety belt design would thus be desirable.

The present invention provides several significant improvements to a flying ski. One aspect of the present invention is a ski that accommodates a variety of rider skill levels by incorporating a mechanism and system that allows the rider to selectively adjust performance characteristics of the ski. In particular, ski stability, lift and maneuverability can be controlled by the rider to accommodate the rider's particular skill level and the particular challenge that the rider seeks. A second aspect of the present invention is a ski that accommodates paraplegic riders. In particular, the seat of the ski is capable of receiving a back support, which a paraplegic rider can use as a lever to manipulate the orientation of the ski. A third aspect of the present invention is a flying ski having a dramatically improved safety belt.

The original safety belt safely secures the rider to the ski, even in high-impact falls. The original safety belt design was subject to wear, however, due to the tendency of the belt to loosen somewhat upon impact. Earlier efforts to overcome this problem were successful in overcoming the problem of slight loosening, but resulted in a seatbelt that was subject to full release/failure. Given the risks associated with unintended full release during a fall, the original design remained preferred, despite the problem of durability. A new seat belt structure has been developed, however, which yields very little, if at all, during the most extreme impacts associated with normal use of the ski and yet prevents full release upon impact. This improvement assures the safety of the rider, while at the same time increasing the life span of the safety belt.

The improved flying ski must be appreciated in the context of the conditions to which it is subjected and the environment within which it is used. Flying skis can be used to jump over twenty feet in the air. Landing impacts from such jumps are very large. Accordingly, the ski structural configuration must be adapted to withstand these forces. Additionally, it is highly desirable that the ski configuration be adapted to minimize the transfer of these forces to the spine of the rider. Finally, riders of different skill levels will often be riding in the same boat and wish to use the same flying ski. Accordingly, it is highly desirable that the flying ski be easily and reliably adjustable to accommodate the various skill levels. The ski configuration should also require a minimum of parts and disassembly thereof, to avoid the risk of parts falling overboard or being lost.

One aspect of the present invention involves a recreational device that supports a seated human rider while the rider and the device are towed behind a powered watercraft. This recreational device comprises an elongated board having a front end and a back end, a seat, a strut which depends from one end of the board and the seat and defines a plane of symmetry, and a blade assembly secured to the strut.

The seat extends from the board for supporting the buttocks of the seated rider at a position spaced above the board.

The blade assembly has a front blade and a rear blade connected by a fuselage. The front blade includes a first portion defining a first surface on a first side of the plane of symmetry. The front blade also includes a second portion defining a second surface on a second side of the plane of symmetry. The first surface and the second surface direct water toward the plane of symmetry upon landing of the front blade on water.

The front blade has a leading edge and the rear blade has a first edge and a second edge. The rear blade is mountable on the fuselage in a first position wherein the first edge defines a trailing edge of the blade assembly. The rear blade is mountable on the fuselage in a second position wherein the second edge defines a trailing edge of the blade assembly. In one embodiment, the greatest perpendicular distance between the leading edge and the first edge when the rear blade is in the first position is longer than the greatest perpendicular distance between the leading edge and the trailing edge when the rear blade is in the second position.

The rear blade may include a first portion defining a first surface on a first side of the plane of symmetry and a second portion defining a second surface on a second side of the plane of symmetry wherein the first surface and the second surface directed water away from the plane of symmetry upon landing of the rear blade on water.

The front blade may further comprise a first depending fin on the first side of the plane of symmetry at a first outer side of the front blade and a second depending fin on the second side of the plane of symmetry at a second outer side of the front blade. These first and second fins may be angled toward the plane of symmetry from front to back.

The front blade may further comprise a third portion which defines a third surface on the first side of the plane of symmetry which directs water away from the plane of symmetry upon landing of the front blade on water as well as a fourth portion which defines a fourth surface on the second side of the plane of symmetry which directs water away from the plane of symmetry upon landing of the front blade on water.

In accordance with the present invention, the front blade may have an upper surface that is curved such that the pressure exerted on said front blade from above is lower than the pressure exerted on the front blade from below.

The rear blade may include a first upwardly curved portion defining a first surface on a first side of the plane of symmetry and a second upwardly curved portion defining a second surface on a second side of the plane of symmetry. In this embodiment, the first surface and the second surface direct water away from the plane of symmetry upon landing of the rear blade on water.

Another aspect of the present invention also involves a recreational device that supports a seated human rider while the rider and the device are towed behind a powered watercraft. This recreational device comprises an elongated board having a front end and a back end, a seat, a strut depending from either the board or the seat and defining a plane of symmetry, and a blade assembly secured to the strut.

The seat extends from the board and supports the buttocks of the seated rider at a position spaced above the board.

At least a portion of the strut is submerged underwater when the device is in use.

The blade assembly has a front blade and a rear blade connected by a fuselage. The front blade has a leading edge and the rear blade has a first edge and a second edge. The rear blade is mountable on the fuselage in a first position wherein the first edge defines a trailing edge of the blade assembly. The rear blade is mountable on the fuselage in a second position wherein the second edge defines a trailing edge of the blade assembly. The greatest perpendicular distance between the leading edge and the first edge when the rear blade is in the first position is longer than the greatest perpendicular distance between the leading edge and the trailing edge when the rear blade is in the second position.

The recreational device may further comprise a blade support mounted between the fuselage and the rear blade. The blade support has a first position in which the blade support cooperates with the fuselage to position the rear blade so as to have a first angle of attack. The blade support has a second position in which the blade support cooperates with the fuselage to position the rear blade so as to have a second angle of attack. A fastener may selectively secure both the rear blade and the blade support in a fixed position.

Another aspect of the present invention involves a kit which can be assembled to form a recreational device that supports a seated human rider while the rider and the device are towed behind a powered watercraft. The kit comprises an elongated board having a front end and a back end, a seat, a strut which is securable to one of the board and the seat and which defines a plane of symmetry, a blade assembly, and a plurality of blade supports.

The seat extends from the board for supporting the buttocks of the seated rider at a position spaced above the board.

The blade assembly is securable to the strut. The blade assembly has a front blade and a rear blade connected by a fuselage. The front blade has a leading edge and the rear blade has a first edge and a second edge. The rear blade is mountable on the fuselage in a first position wherein the first edge defines a trailing edge of the blade assembly. The rear blade is mountable on the fuselage in a second position wherein the second edge defines a trailing edge of the blade assembly. The greatest perpendicular distance between the leading edge and the first edge when the rear blade is in the first position is longer than the greatest perpendicular distance between the leading edge and the trailing edge when the rear blade is in the second position.

Each of the blade supports are alternatively mountable between the fuselage and the rear blade. Each of the plurality of blade supports are sized and shaped to cooperate with the fuselage to position the rear blade so as to have an angle of attack.

Another embodiment of the invention is directed to a blade for use with a flying ski type recreational device that supports a seated human rider while the rider and the device are towed behind a powered watercraft. The blade defines a plane of symmetry and includes a first portion defining a first surface on a first side of the plane of symmetry and a second portion defining a second surface on a second side of the plane of symmetry. The first surface and the second surface direct water toward the plane of symmetry upon landing of the blade on water.

This embodiment includes a first depending fin on the first side of said plane of symmetry at a first outer side of the blade as well as a second depending fin on the second side of the plane of symmetry at a second outer side of the blade.

The first and second fins can be angled toward the plane of symmetry from front to back.

The blade may further comprises a third portion which defines a third surface on the first side of the plane of symmetry which directs water away from the plane of symmetry upon landing of the blade on water as well as a fourth portion which defines a fourth surface on the second side of the plane of symmetry which also directs water away from the plane of symmetry upon landing of the blade on water.

This blade may define between 69 and 114 square inches. Alternatively, this blade may define between 82 and 101 square inches.

Another aspect of the invention involves a method of varying the attack angle of a planing blade for use with a flying ski type recreational device that supports a seated human rider while the rider and the device are towed behind a powered watercraft. The method comprises providing a fuselage that removably attaches to any one of a plurality of rear planing blades and selecting one rear planing blade and attaching the selected rear planing blade to the fuselage.

The step of selecting one rear planing blade may include selecting one rear planing blade with a generally planar surface or one with a curved rear planing blade. A curved rear planing blade that has a pair of spaced apart upswept wings may be selected. The curved rear planing blade may be detached from the fuselage and the orientation of the curved rear planing blade reversed so that the curved rear planing blade has a pair of spaced apart frontswept wings. The rear planing blade is then reattached to the fuselage.

The method also may comprise the steps of detaching the rear planing blade from the fuselage, placing a blade support in a cut-out formed in the fuselage and reattaching the rear planing blade to the fuselage.

The apparatus, in any of the embodiments described so far, may also comprise a detachable back support. The back support is constructed from two principal pieces, the first being a flat rectangular sheet of material having a thickness that is much less than either its length or its width. This piece is bent at a ninety-degree angle along an axis that lies perpendicular to the longitudinal axis of the rectangular sheet, thus forming a horizontal section and a vertical section. The vertical section is preferably approximately two and one-half times the length of the horizontal section.

The second principal piece is a spine, also "L"-shaped, and attached to the back of the vertical segment and the underside of the horizontal segment. The spine has a significant thickness in the direction perpendicular to the rider's back, so that the spine imparts a substantial amount of rigidity to the seat back. This rigidity ensures that the seat back will act as a lever, enabling the rider to alter the angle of attack of the planing blades by exerting pressure on the upper end of the seat back. The rider applies this pressure by raising or lowering his hands.

A further aspect is an improved safety belt. The belt has two straps, each having a free end, and a stationary end that is secured to the seat of the flying ski. The "female" strap is fitted with a clamp at its mating end, into which the "male" strap is inserted when the belt is fastened. To adjust the fit of the belt, the male strap is pulled through the clamp until the desired tightness is reached. The clamp is then closed, allowing the teeth of the clamp to engage the male strap and prevent the male and female straps from moving relative to one another.

Since the effectiveness of the belt is dependent upon the strength of the engagement between the clamp and the male strap, it is desirable to provide a connection that will not yield, even when subjected to extreme tensile force. In order to increase the strength of the connection, the frictional force generated by the interaction of the clamp and the strap must be increased. This frictional force is equal to the product of the normal force and the coefficient of static friction between the two straps. Therefore, in order to increase the frictional force present, one of these two components must be increased.

Preferably the coefficient of static friction between the clamp and the male strap is increased by providing, on the surface of the strap, a material comprised of a multitude of tightly packed loop fibers. The loops engage the teeth of the clamp and act as anchors, preventing the teeth from advancing along the surface of the strap.

The apparatus, in any of the embodiments described so far, may also comprise a padded safety belt. The belt is preferably substantially identical to the improved safety belt described above, and includes first and second padded strips attached to an underside. The strips are substantially rectangular lengths of resilient material covered by a durable fabric. The strips are preferably releasably attached to the belt with a hook and loop fastener. Alternatively, the strips may be secured to the belt with straps that wrap around the belt, such that the strips are slidable along the belt. The strips provide a soft interface between the rider and the belt, thus increasing the rider's comfort and enabling the rider to enjoy using the flying ski for longer periods of time.

In another aspect, a flexible member may be provided along the seat portion for improving the quality of the ride. The flexible member preferably takes the form of a C-shaped member that flexes to attenuate vertical forces felt by the rider.

In another aspect, an alternative vertical strut is provided wherein the strut is formed with a substantially V-shaped profile. This shape improves the stiffness of the strut.

In another aspect, an alternative planing blade configuration is provided wherein the rear blade is vertically displaced from the front blade. As a result, the rear blade is further spaced away from the turbulence created by the front blade, thereby providing enhanced control and stability.

In yet another aspect, an alternative planing blade configuration is provided wherein the rear blade is slidably coupled to the fuselage. As a result, the rear blade may be slid up or back along the fuselage for selecting the desired performance characteristics.

Further aspects, features, and advantages will become apparent from the detailed description of the preferred embodiments that follows.

BRIEF DESCRIPTION OF THE DRAWINGS

The above-mentioned and other features of the invention will now be described with reference to the accompanying drawings, which are intended to illustrate, but not limit, the concepts of the invention. The drawings contain like reference numerals to designate like parts throughout the figures thereof, and wherein.

DETAILED DESCRIPTION OF THE PREFERRED EMBODIMENTS

The present embodiments of the improved flying ski are disclosed in the context of the types of flying ski disclosed in U.S. Pat. Nos. 5,100,354 and 5,249,998, each of which are incorporated by reference in their entirety herein. The principles of the present flying ski, however, are not limited to the types of flying ski in those disclosures. Instead, it will be understood by one of skill in the art, in light of the present disclosure, that the improved types of flying ski disclosed herein can also be successfully utilized in connection with other types of flying skis, both presently known and later developed, as well as other recreational water and nonwater devices. One skilled in the art may also find additional applications for the improvements disclosed herein. However, the flying ski described herein is particularly advantageous in connection with the types of flying ski disclosed in the incorporated patents.

The improved flying ski described herein is especially adapted to accommodate a variety of rider skill levels and to provide quick and easy assembly and disassembly of component parts.

Figure 1:
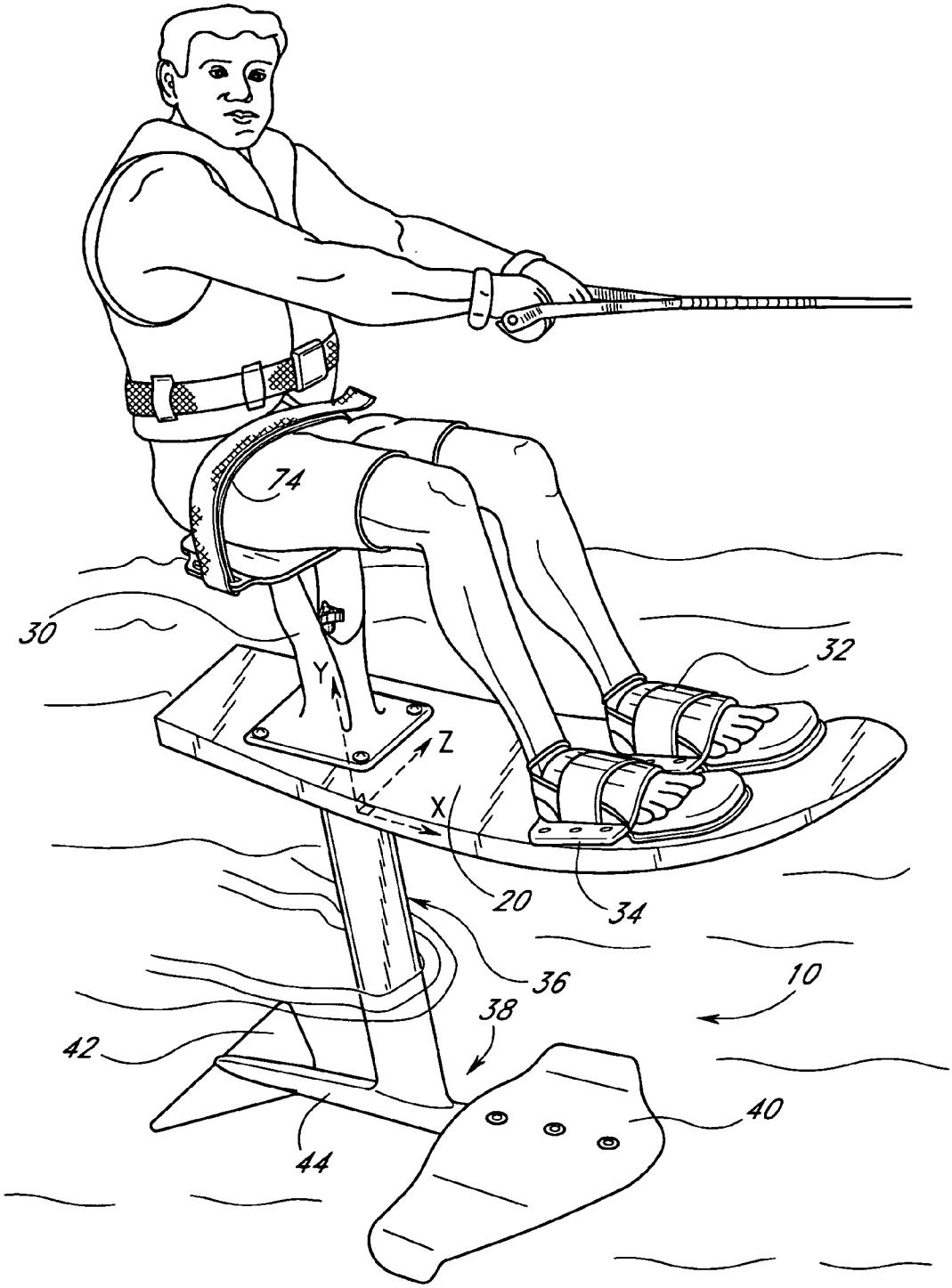
FIG. 1 is a perspective view an improved flying ski in accordance with a preferred embodiment of the present invention, illustrating the general orientation of the ski when in use and supporting a seated human rider being towed behind a powered watercraft (not shown)
Figure 2:
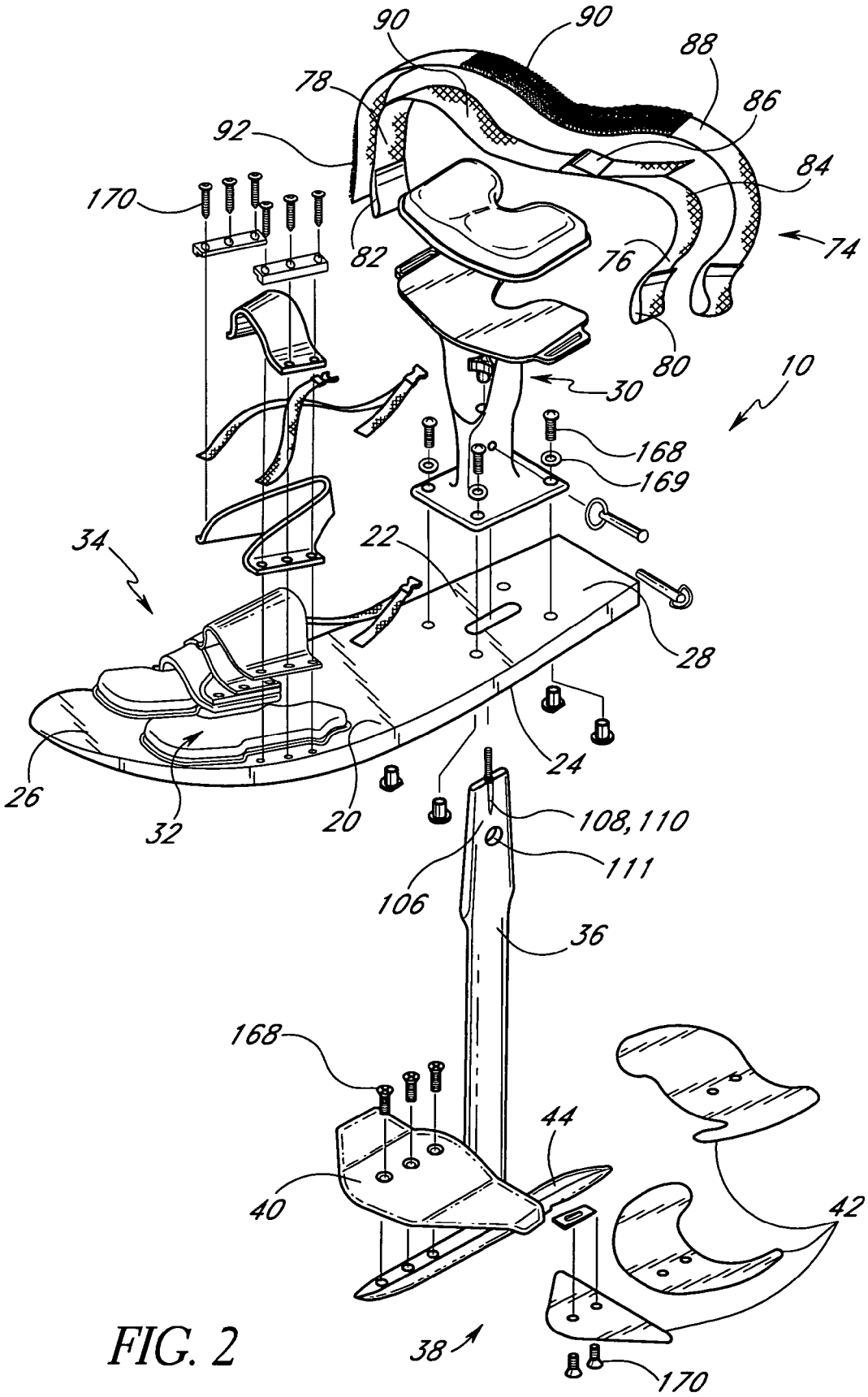
FIG. 2 is an exploded perspective view of the ski of FIG. 1, illustrating component parts of the ski.

With reference to FIGS. 1 and 2, the improved flying ski 10 comprises an elongate board 20 having an upper face 22 and a lower face 24, and a front end 26 and a rear end 28. A seat 30 extends generally perpendicular to and upward from the upper face 22 of the board 20 to support the seated rider's buttocks. The rider's legs extend toward the front end 26 of the board 20 and are secured by a pair of foot holders 32, 34 that attach to the board 20. An elongate strut 36 extends generally perpendicular to and downward from the board 20 and couples the seat 30 to a planing blade 38. The planing blade 38 advantageously has a front blade 40 and a rear blade 42 interconnected by a fuselage 44.

To assist in the description of the components of the flying ski 10, the following coordinate terms are used. Referring to FIG. 1, a "longitudinal axis" ("X") is generally parallel to the longest dimensional section of the elongate board 20 and bisects the strut 36 laterally. A "lateral axis" ("Z") is normal to the longitudinal axis, is generally parallel to the width of the elongate board 20 and bisects the board 36 vertically. A "transverse axis" ("Y") extends normal to both the longitudinal and lateral axes, vertically from the planing blade to the elongate board to the seat and intersects the intersection of the X and Z axis. In addition, as used herein, "the longitudinal direction" refers to a direction substantially parallel to the longitudinal axis; "the lateral direction" refers to a direction substantially parallel to the lateral axis; and "the transverse direction" refers to a direction substantially parallel to the transverse axis. Also, the terms "proximal" and "distal", which are used to describe the present flying ski 10, are used consistently with the description of the exemplary application. Thus, proximal and distal are used in reference to the center of the seated rider's body. A detailed description of the flying ski 10, and associated method of use, now follows.

With reference to FIG. 1, the improved flying ski 10 is desirably towed behind a conventional powered watercraft (not shown) utilizing a standard ski tow rope or similar device having a handle that can be held by the human rider (illustrated at a point spaced above the rider's knees for rider comfort). In use, the rider is seated on the seat of the flying ski and towed by the watercraft.

Components

As noted above, the types of flying ski disclosed in the prior art are relatively insensitive to riders with different ability levels and thus beginning riders tend to become frustrated while advanced riders tend to maximize the capabilities of the ski. The present invention incorporates significant changes and modifications to both individual components of the ski 10 as well as to the overall ski 10 itself to accommodate a variety of rider skill levels and to allow the ski to be more easily assembled and disassembled.

The various components of the improved flying ski 10 will now be described in greater detail.

Elongate Board

Referring to FIG. 2, the elongate board 20 is configured generally similar to the board of the incorporated patents. The improved board 20 has a longitudinal length of about 0.5 to 5 m, more preferably about 1 to 2 m and most preferably about 1.3 m. The front portion of the board is curved upward at an increasing rate toward the front end 26 of the board 20. That is, the rear end 28 of the board 20 is substantially planar in the longitudinal direction while the front end 26 has approximately one foot of rise. This rise is greater than that of prior flying skis to improve performance characteristics of the ski 10, including easing impact on the rider when landing. The lateral width of the board 20 is generally bullet shaped, with the rear end 28 width about 200 mm, a midsection width of about 300 mm, and a front end 26 nose width of about 20–40 mm.

The board 20 is advantageously constructed from hot melt unidirectional and continuous strand glass with epoxy resin. The board desirably has a foam core and nylon backing plates to reinforce the attachment of the bindings. However, the board 20 can be constructed from any of a variety of other suitable materials, such as wood, plastic, fiberglass, metal, composites and the like and combinations thereof, both presently known or later developed.

The board 20 is preferably manufactured by compression molding. However, in other embodiments the board 20 can be manufactured through a variety of other suitable manufacturing techniques, both presently known or later developed.

Seat

Figure 3:
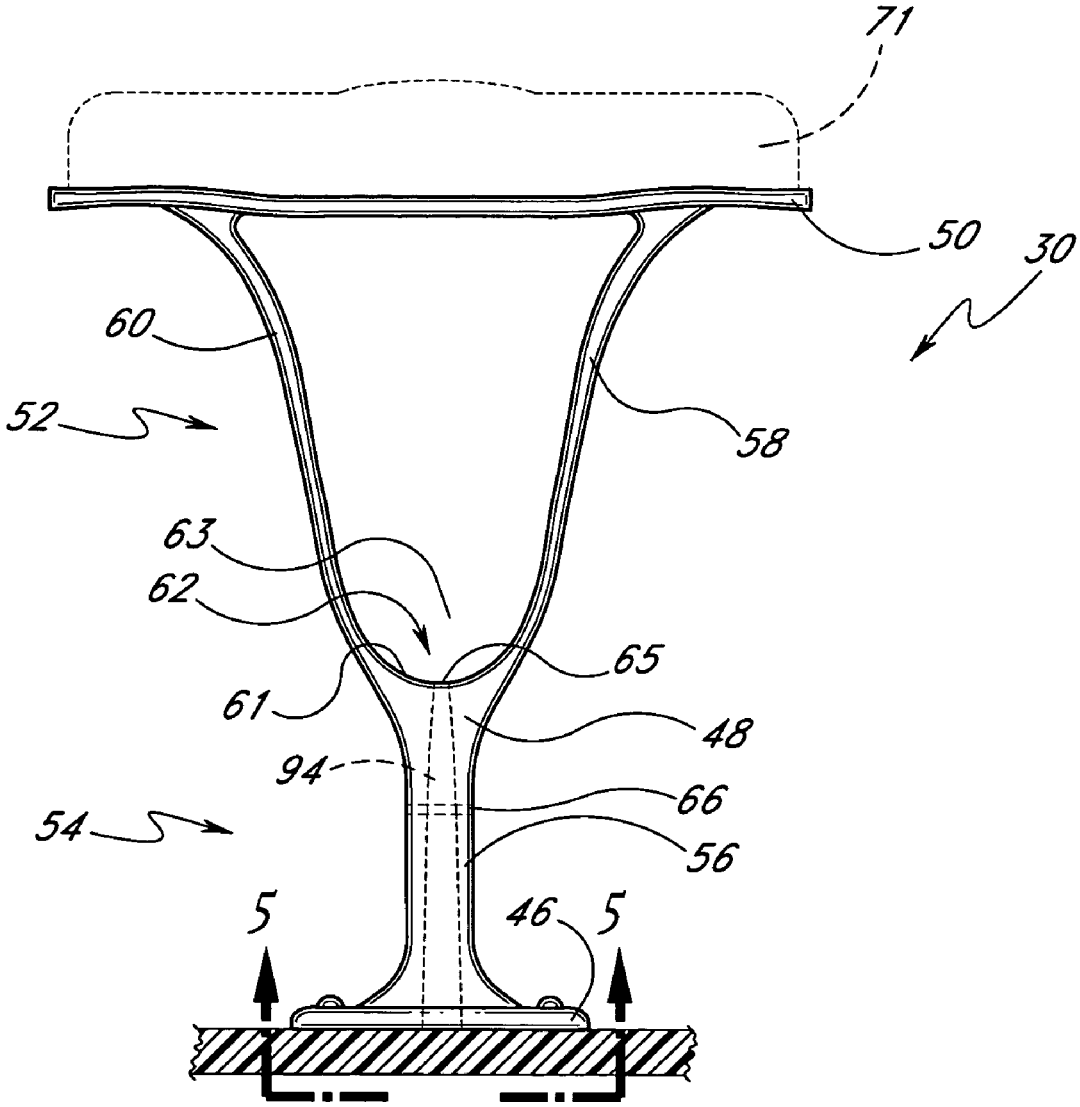
FIG. 3 is a front elevational view of a seat for the ski of FIG. 1, illustrating the components thereof.

Referring to FIGS. 2 and 3, the seat 30 advantageously has a unitary one-piece construction so that the ski 10 can respond to the rider's actions (e.g. shifting body weight in one particular direction) with minimal "play" that could otherwise exist if the seat 30 comprised separate component parts that shifted relative to one another in response to the rider's actions. However, less preferred embodiments of the seat 30 could have multi-piece construction, so that the seat 30 comprises a plurality of components that interconnect to form the seat 30.

The seat 30 includes a base portion 46, an intermediary portion 48, and a buttocks-receiving portion 50. The illustrated base portion 46 has a generally rectangular cross-sectional shape to fit within the elongate confines of the board 20, although, the base portion 46 can be any of a variety of other shapes such as square, circular, oval, triangular, curvilinear and the like. The base portion 46 attaches the seat 30 to the rear end 28 of the board 20, as described below.

The intermediary portion 48 interconnects the base portion 46 to the buttocks-receiving portion 50. The intermediary portion 48 has an upper section 52 and a lower section 54, with the lateral width of the upper section 52 advantageously wider than the lateral width of the lower section 56. This lateral configuration allows the buttocks-receiving portion 50 to accept a variety of riders' buttocks while allowing the base portion 46 to maintain a smaller footprint and fit within the confines of the board 20, if desired and as illustrated. However, the upper section 54 may have the same or smaller lateral width than that of the lower section. The illustrated embodiment shows the intermediary portion 48 being generally Y-shaped. This particular shape, as well as other alternative shapes (e.g. inverted triangle, rectangle, cylinder etc.) affords an internal passageway 94 for connecting the seat 30 to the strut 36, described below.

The exemplary generally Y-shaped intermediary portion has a brace 56 and a pair of upper extensions 58, 60, each having a generally oval cross-sectional shape with the major axis in the longitudinal direction and the minor axis in the lateral direction. The brace 56 has a minor axis thickness of at least about 5 mm for structural strength but less than the lateral width of the elongate board 20 for aerodynamic efficiency, hydrodynamic efficiency and reduced weight. The extensions 58, 60 are preferably symmetrical about the brace 56 and taper away from each other to support opposing ends of the buttocks-receiving portion 50 of the seat 30, each extension 58, 60 having a minor axis thickness of about 2–10 mm and more preferably about 4 mm for structural strength.

Figure 4:
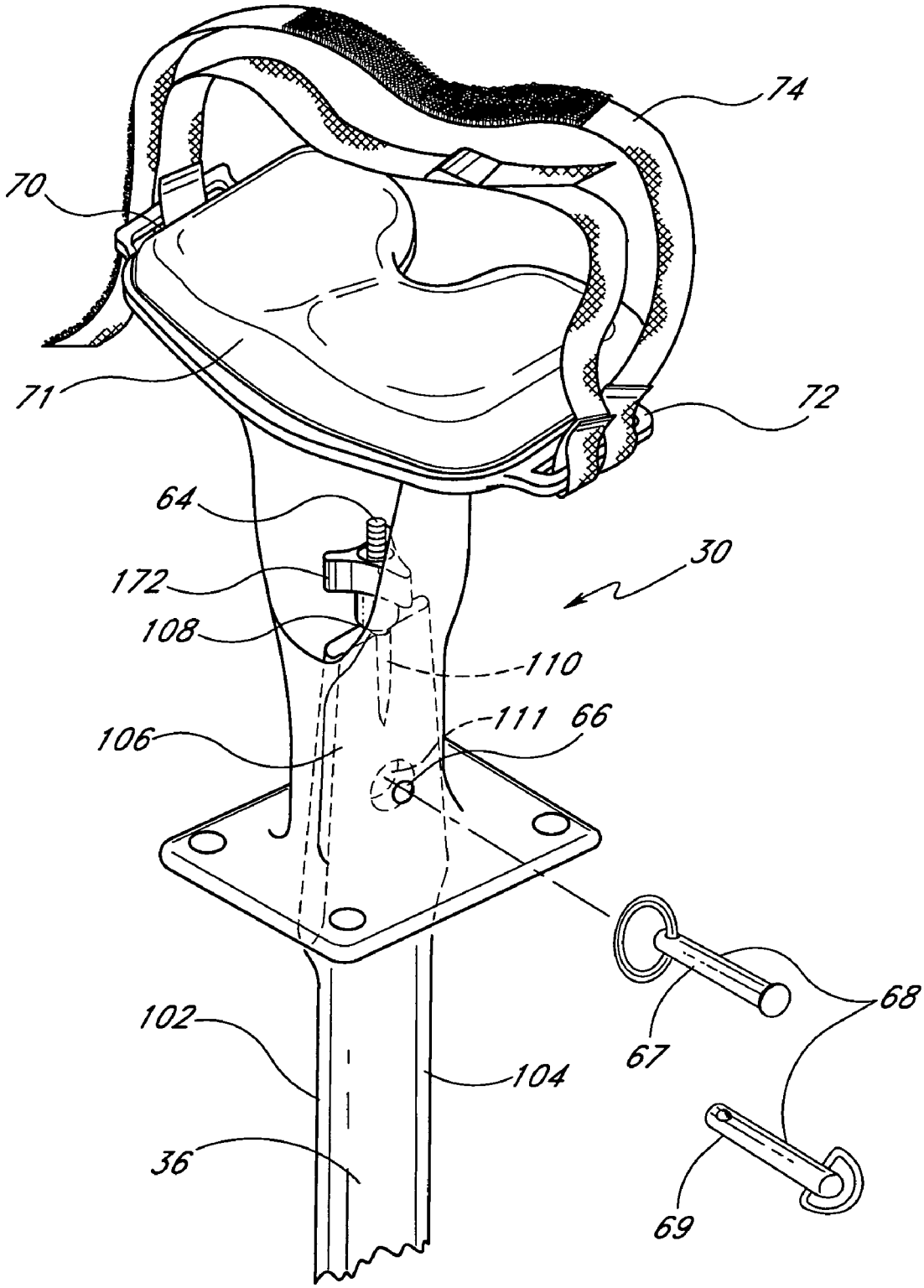
FIG. 4 is a perspective view of a strut and the seat for the ski of FIG. 1, illustrating interengagement between the strut and an internal passageway formed within the seat.

Referring to FIGS. 3 and 4, a Y-junction site 62, accommodates the lateral distance between the joined bottom of the extensions 58, 60 and has a sufficient surface area 61 to accept at least a portion of a fastener, such as a bolt 64 as well as a sufficient area 63 above the bolt 64 to accept a turn knob 172 with interior threads, nut or other device that interengages with the fastener. The bolt 64 extends through a Y-junction hole 65 in the seat 30 and, in cooperation with the turn knob 172, provides for quick and easy interconnection between the strut 36 and seat 30, as explained below. The illustrated Y-junction site 62 has a surface area with a transverse width of about 5–50 mm and more preferably about 10–30 mm, and a lateral width generally similar to that of the brace 56. The surface area 63 of Y-junction site 62 can be curved, as illustrated, planar or a combination thereof.

A through-hole 66 is arranged through the brace 56 and is designed to accept a conventional safety pin 68, such as a clevis pin 67 or a ball-lock pin 69. The safety pin 68 and through-hole 66 provide a redundant coupling structure for securing the strut 36 to the seat 30. The illustrated through-hole has 66 a diameter of about 5 mm.

The buttocks-receiving portion 50 of the seat 30 is sized and configured to accommodate and support the buttocks of a variety of human riders, whether the particular rider is an adult or child, and irrespective of the weight, proportions or size of the rider. The illustrated buttocks-receiving portion 50 lies generally parallel to the rear end 28 of the board 20 and is supported by the extensions 58, 60. The illustrated buttocks-receiving portion 50 is generally rectangular shaped and laterally extends beyond the extensions 58, 60.

A lateral width of about 300 mm and a longitudinal length of about 150 mm has been found suitable to perform the intended function of the buttocks-receiving portion 50, however, a variety of other dimensions and geometric configurations could easily be used.

A cushion 71 is advantageously placed over the buttocks-receiving portion 50 for rider comfort. The cushion 71 may be contoured similar to the contours of the seated riders' buttocks and may be constructed of any of a variety of soft, pliable, water-resistant materials such as neoprene, rubber, gel, silicone, plastic and the like for additional rider comfort. The illustrated cushion 71 is generally U-shaped with a pair of depressions formed therein.

Referring to FIGS. 2 and 4, a pair of openings 70, 72 are advantageously incorporated along the lateral ends of the buttocks-receiving portion 50 to secure opposing ends of a seat belt 74. The openings 70, 72 allow the seat belt 74 to be permanently attached to the seat 30 so that the seat belt 74 cannot be accidentally misplaced or lost. A variety of particular configurations can be used to achieve this purpose. For example, the illustrated seat belt 74 incorporates ends 76, 78 that are passed through the respective openings 70, 72 and then stitched to a portion of the seat belt 30 near the respective ends 76, 78 of the seat belt 74 to form loops 80, 82.

A primary lap strap 84 and a buckle 86 cooperate to secure the rider to the seat 30 in a manner similar to that found in an airplane or automobile. However, the seat belt 74 has a supplemental lap strap 88 to inhibit unintentional loosening of the primary lap strap 84 which may otherwise occur during use as a result of the appreciable movement of the rider. The supplemental lap strap 88 extends over the primary lap strap 84 and buckle 86 and can be configured and used in a wide variety of ways. For example, and as illustrated, the supplemental lap strap 88 can be placed over the primary lap strap 84 (thereby exposing Velcro hook fasteners 90 attached to a portion of the supplemental lap strap 88), looped through one of the openings 70 and then backtracked over itself (thereby aligning Velcro loop fasteners 92 attached to a portion of the supplemental lap strap 88, that interlock with the Velcro hook fasteners 90). Of course, a variety of other seat belt and seat belt type securement devices could be used to secure the rider to the seat 30 and to inhibit unintentional loosening of the primary lap strap 84.

Figure 5:
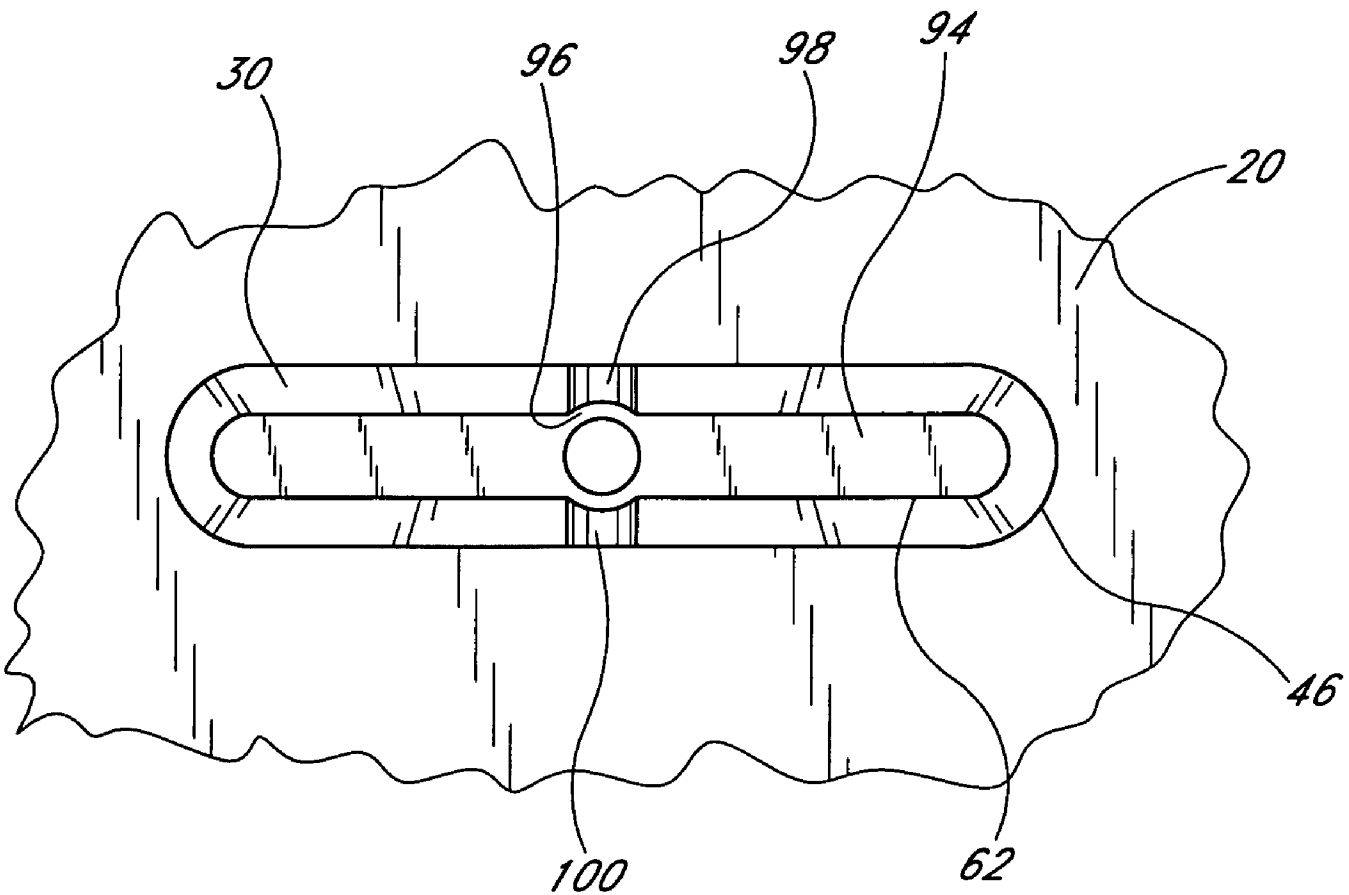
FIG. 5 is a bottom plan view of the internal passageway of the seat.

Referring to FIGS. 3, 4 and 5, at least a portion of the seat 30 interior is hollow and forms a passageway 94 through which a portion of the strut 36 extends. The passageway 94 is advantageously sized and configured to form a keyway groove 96 that accepts and form-fits with the strut 36. This configuration reduces "play" caused by attachment of these parts 30, 36. The illustrated keyway groove 96 extends through the base and intermediary portions 46, 48 of the seat 30 and is generally oval shaped like the brace 56. Of course, a variety of other shapes can be used to form the keyway groove 96. Importantly, the keyway groove 96 is tapered such that the smallest cross-section of surfaces defining the grove is near the Y-junction site 62 and the largest cross-section of the surfaces defining the grove is near the base portion 46, the particular taper shown being a Morse taper. The keyway groove 96 also has a pair of opposing tracks 98, 100 recessed into the seat body 30. The tracks 98, 100 further reduce "play" and allow the keyway groove 96 and strut 36 to form-fit.

The illustrated unitary seat 30 is preferably constructed from cast aluminum and particularly 365A aluminum for strength, cost, hydrodynamic efficiency, and ease of manufacture. However, the seat 30 can be constructed from any of a variety of other suitable materials, such as wood, plastic, fiberglass, metal, composites and the like and combinations thereof, both presently known or later developed.

Figure 34:
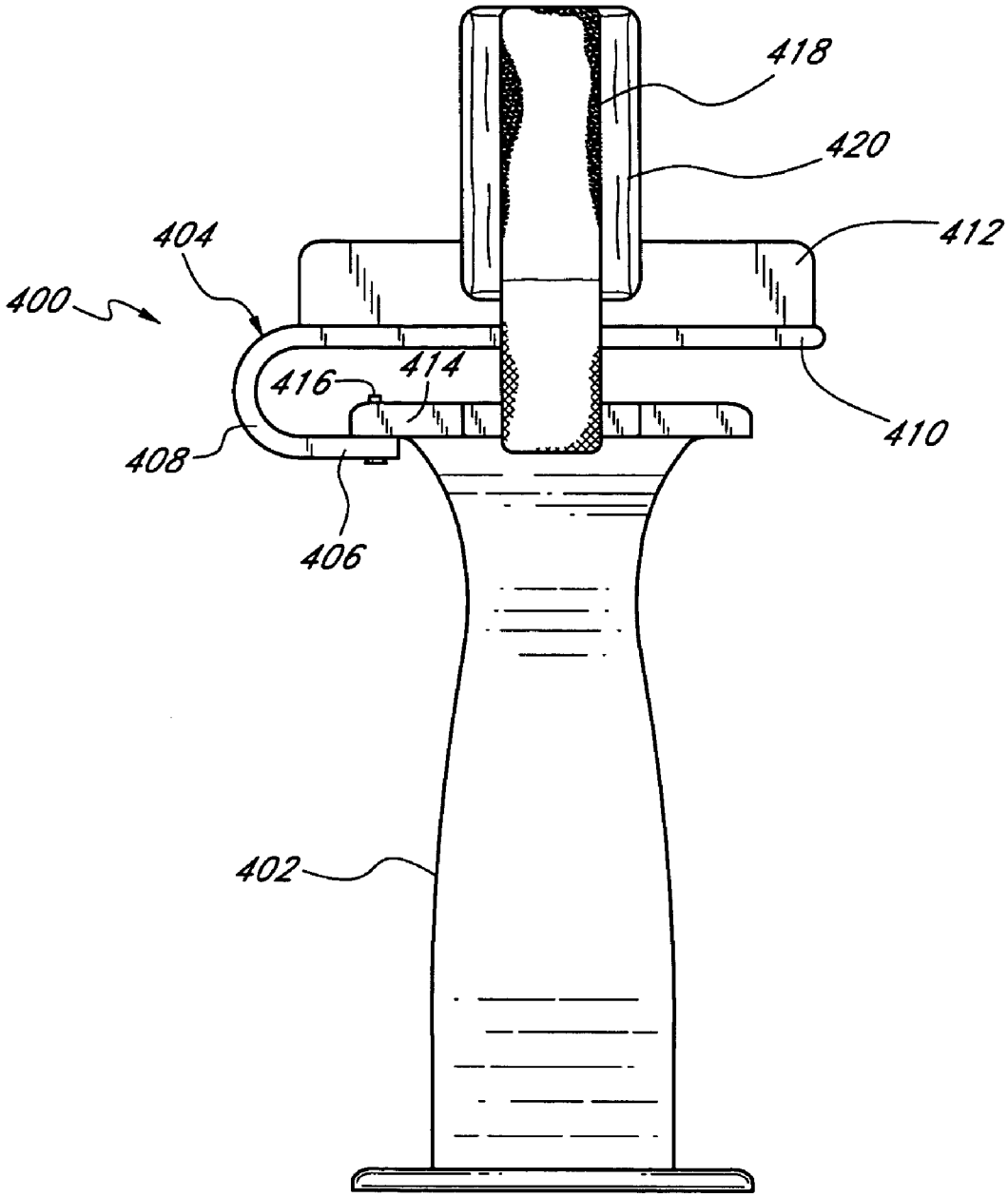
FIG. 34 is a side view of an improved seat for use with the flying ski.

In an alternative embodiment, a flexible structure is provided along the top end of the seat for absorbing impacts and thereby improving and enhancing the rider's comfort during use. Referring now to FIG. 34, one preferred embodiment of an improved seat 400 comprises a fixed seat portion 402 extending upward from the board. The fixed seat portion 402 may be constructed in accordance with the embodiments generally described above. The improved seat 400 further comprises a C-shaped member 404 coupled to a top end 414 of the fixed seat portion 402. The C-shaped member preferably includes a lower plate 406, a curved region 408 and an upper plate 410. In the illustrated embodiment, the lower plate 406 of the C-shaped member 404 is attached to the top end 414 of the fixed seat portion 402 by one or more bolts 416. In alternative configurations, the C-shaped member may be attached by any other appropriate fastening means, such as, for example, welding. In yet another configuration, the base portion and C-shaped member may be integrally formed as a single unit.

Figure 35:
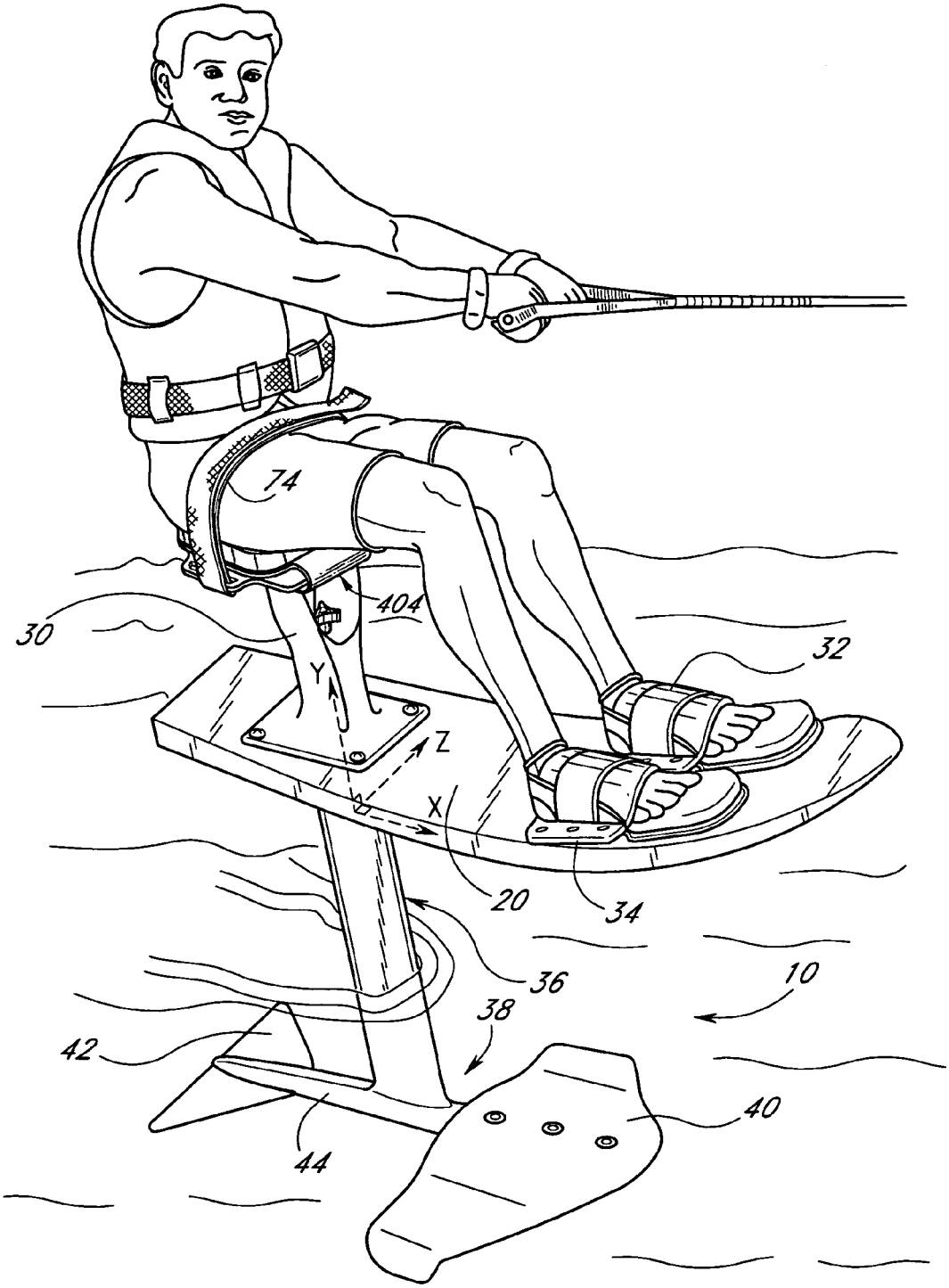
FIG. 35 is an assembled perspective view of the improved seat during use.

The C-shaped member 404 includes an open end and a closed end. Preferably, the curved region 408 is provided at the front end and the open end is provided at the back end, relative to a direction of forward travel. Accordingly, the back portion of the upper plate 410 advantageously provides the greatest flexibility in the region where the rider's weight is typically centered. For illustration purposes, FIG. 35 shows one embodiment of a flying ski provided with a flexible C-shaped member 404 provided along the top end of the seat portion. In this configuration, the flexible structure of the C-shaped member provides a damped spring member for attenuating the transmission of vertical forces to the rider, thereby providing the rider with a smooth and comfortable riding experience.

It will be appreciated by those skilled in the art that embodiments of the C-shaped member described herein have a rugged construction that are lightweight and include no moving parts. Accordingly, the C-shaped member is relatively inexpensive to produce and may be subjected to a very large number of bending cycles without mechanical failure. Furthermore, it will be appreciated that the C-shaped member may be configured for use with existing seats with minimal modifications.

In preferred embodiments, the C-shaped member is manufactured with a flexibility and stiffness that are selected for absorbing impacts during use without allowing the upper 410 and lower plates 406 to come into contact. For example, in one preferred embodiment, the back end of the upper plate 410 flexes up and down by approximately +/−0.75 inches during typical use with a rider of average weight. The C-shaped member is preferably manufactured to maintain a substantially constant stiffness over a very large number of bending cycles. In one preferred embodiment, the C-shaped member is formed from an aluminum alloy, such as 365A or 6061-T4. Alternatively, the C-shaped member may be formed from other aluminum alloys, or from other suitably strong materials.

With reference again to FIG. 34, a top cushion 412 may be provided along the top side of the upper plate 410 to further enhance the rider's comfort during use. In alternative configurations, one or more additional springs and/or cushions (not shown) may be placed in the gap between the upper 410 and lower 406 plates to further damp and absorb impacts. The spring and/or cushions further provide an absorbing member in the event that the upper and lower plates come into contact during extreme use.

A safety belt 418 is preferably provided with a pad 420 for added comfort. In one preferred embodiment, the safety belt 418 may be attached to the top end of the fixed seat portion 402, as illustrated in FIGS. 34 and 35. In another embodiment, the safety belt 418 may be attached to the upper plate 410 of the C-shaped member 404.

Strut

Referring to FIGS. 2, 4 and 6, the strut 36 extends in the transverse direction and couples the planing blade 38 to the seat 30. The strut 36 defines a plane of symmetry A that runs through the planing blade 38.

The illustrated strut 36 is formed in unity with at least a portion of the planing blade 38 and, like the seat 30, is constructed from 365A cast aluminum. However, the strut 36 can be formed as a stand-alone component part of the ski and comprise any of the materials identified above.

The strut 36 has a transverse length of about 0.3–2 m and preferably about 0.9 m to provide a suitable distance between the board 20 and planing blade 38. If the board 20 and planing blade 38 are too close or too far apart, performance characteristics of the ski tend to decrease. In cross-section, the strut 36 has a generally oval-shaped hydrodynamically efficient configuration that reduces drag and turbulent waterflow and around the strut 36, the major axis extending in the longitudinal direction and the minor axis extending in the lateral direction. More particularly, the lateral thickness of the strut 36 is oblong with a forward end 102 thickness of about 2–5 mm before tapering to a rounded point, and a rearward end 104 thickness of about 1–4 mm before tapering to a rounded point.

A tongue 106 extends from the upper end of the strut 36 and is sized and configured to form-fit with the keyway groove 96 of the seat 30. The illustrated tongue 96 has a Morris taper with a centered stainless steel bolt 64 extending therefrom and reinforcing ears 108, 110. A portion of the bolt 64 is cast into the tongue 106 about 20–50 mm and preferably about 35 mm for strength and so that it will not break off from the strut 36. The portion of the bolt 64 that is not cast in the tongue 106 extends from the tongue 106 for a transverse height of about 20–50 mm and preferably about 35 mm, and has a diameter of about 3–7 mm and more preferably about 5 mm to secure the strut 36 to the seat 30. The ears 108, 110 laterally surround and reinforce the bolt 64 so the bolt 64 will not break off from the strut 36, and provide a mating structure that form-fits with the tracks 98, 110 of the keyway groove 96 of the seat 30 to assist in reducing "play." Ears 108, 110 having a lateral thickness of about 3–10 mm and longitudinally tapering uniformly along the front and rear ends have been found suitable for this purpose.

A void 111 is arranged through the tongue 106 and aligns with the through-hole 66 in the brace 56 of the seat 30 to enable the safety pin 68 to pass through the strut 36 and seat 30. As explained above, this provides a redundant coupling structure for these components 30, 36.

Figure 36:
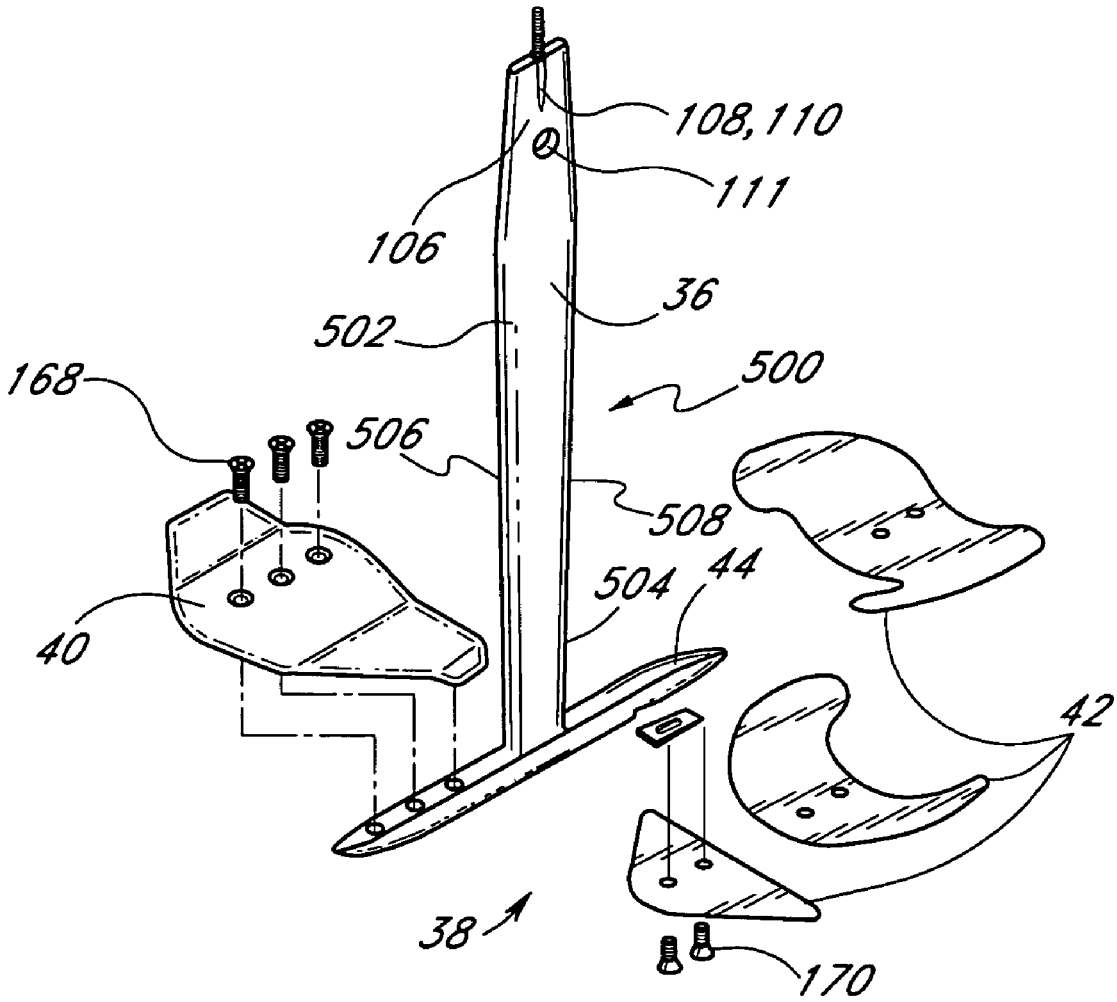
FIG. 36 is a perspective view illustrating an alternative strut for use with the flying ski.

Referring now to FIG. 36, an alternative strut 500 is provided with a tapered shape that forms a truncated V-shaped structure when viewed in profile. The strut 500 is provided with an upper portion 502, a lower portion 504, a leading edge 506 and a trailing edge 508. The strut 500 defines a cross-section over substantially its entire length that is substantially oval-shaped, but that comes to a point at its leading and trailing edges. Those of ordinary skill in the art will appreciate that the leading and trailing edges may be more rounded than as shown in FIG. 36.

In the illustrated embodiment, the leading edge 506 and trailing edge 508 of the strut are not parallel. More particularly, the strut 500 is formed with additional material in the upper portion 502 for enhanced rigidity and structural integrity. As a result, the distance between the leading and trailing edges 506, 508 of the strut 500 (i.e., the length along the major axis) is largest along the upper portion 502. In one preferred embodiment, the distance between the leading and trailing edges along the upper portion 502 of the strut 500 is approximately 4.5 inches, whereas the distance between the leading and trailing edges along the lower portion 504 of the strut 500 is approximately 3.25 inches. In the illustrated embodiment, the distance between the leading and trailing edges reaches a maximum at the top of the strut 500 where the strut joins the tongue 106. This widest portion of the strut corresponds generally to the position of the board 20 when the flying ski is assembled. However, the widest portion may be located somewhat above or somewhat below the board 20.

The V-shaped structure provides a strut having a substantially increased bending stiffness, thereby reducing the amount of undesirable flexing and deformation during use. The increased bending stiffness is a particularly desirable quality because deformation of the strut may cause control problems. Furthermore, over time, bending of the strut increases the likelihood of a mechanical failure. In another advantageous feature, the increased bending stiffness allows the strut to be extended such that the distance between the planing blade and the board is increased. In practice, it has been found that the V-shape allows the strut to be extended by about 0.25 meters (i.e., about 10 inches) without any adverse effects. In one preferred embodiment, the V-shaped strut 500 has an overall length of at least 34 inches, preferably at least 36 inches, and most preferably about 38 inches.

It will be appreciated by those skilled in the art that the extended strut advantageously allows the rider to handle rougher water (i.e., bigger waves) more easily because the planing blade is less likely to rise up out of the water. Further still, the extended strut decreases the likelihood of the board contacting the surface of the water. The extended strut also provides a variety of advantages when used in smooth water. For example, the extended strut provides the rider with additional climb time, thereby allowing the rider to jump much higher out of the water while performing tricks. In another advantage, the extended strut allows the planing blade to enter the water more quickly after a jump, thereby providing a smoother and more controlled landing with less shock and/or impact to the rider.

Planing Blade

Referring to FIGS. 6–10, the planing blade 38 provides stability, lift and responsiveness performance characteristics to the ski 10. Components of the planing blade 38 are advantageously interchanged to vary these performance characteristics, as discussed below. The ski 10 can thereby accommodate a variety of rider skill levels.

The planing blade or blade assembly 38 advantageously has a front blade 40 and a rear blade 42 interconnected by a fuselage 44. Each of these components can be each configured in a variety different sizes and shapes to provide different stability, lift and responsiveness characteristics. The unassembled ski 10 advantageously provides a plurality of each of these components 40, 42, 44 and can be made commercially available as a kit. Thus, various planing blade components 40, 42, 44 when assembled can be selectively interchanged with the other various planing blade components 40, 42, 44 when assembled (and subsequently repeatedly disassembled and reassembled) to alter the performance characteristics of the ski 10 as often as the rider prefers. The kit may alternatively comprise a plurality of one-piece unitary planing blades 38 but preferably comprise planing blades 38 having two or four or more components to accomplish the purpose of varying ski performance characteristics easily with a minimum of materials and cost.

The planing blade 38 components are preferably constructed of 365A cast aluminum, but, like the seat 30 and strut 36, can be constructed of a variety of other materials. Also, each embodiment of the front and rear blades 40, 42 has a thickness sufficient to resist breaking or chipping when the ski 10 is used and when the blades 40, 42 are accidentally dropped or mishandled when not in use. The thickness, however, need not be uniform along the entire dimension of the front and rear blades 40, 42 and can range from about 1–20 mm. Each embodiment of the fuselage 44 similarly has a thickness sufficient to resist breaking or chipping when the ski 10 is used and when it is accidentally dropped or mishandled when not in use. The thickness also need not be uniform along the entire dimension of the fuselage 44 and can range from about 1–50 mm.

Front Blade

Figure 9B:
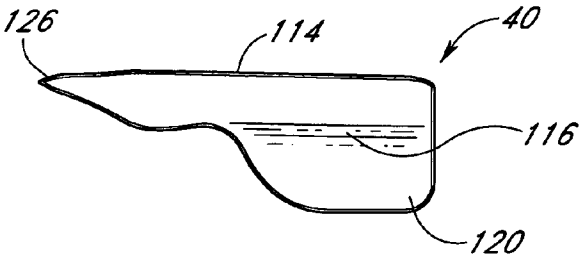
FIG. 9B is a side elevational view of the front planing blade for the ski of FIG. 9A.
Figure 9A:
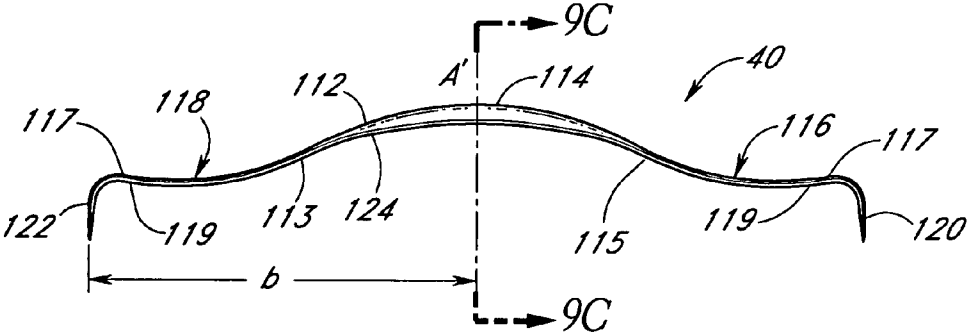
FIG. 9A is a front elevational view of a front planing blade for the ski of FIG. 1.
Figure 9C:
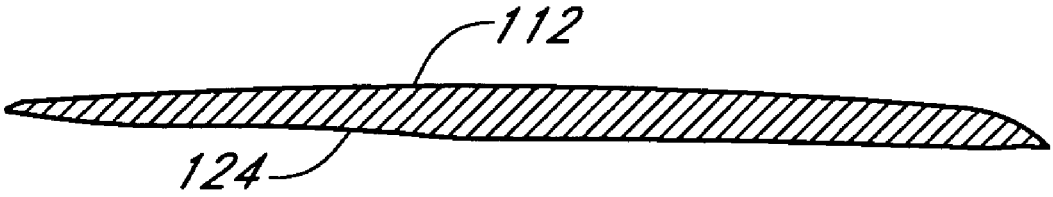
FIG. 9C is a sectional view along the line 9C—9C of FIG. 9A.

Referring to FIGS. 6 and 9, in the illustrated embodiment, the front blade 40 comprises an undulated hydrodynamically efficient member designed to provide lift and responsiveness characteristics to the ski 10. This configuration further provides reduced resistance to water when compared to the front planing blade disclosed in the prior art.

The illustrated front blade 40 comprises an upper surface 112 having a central hill 114 with first and second valleys 116, 118 symmetrically arranged on opposing lateral sides of the hill 114. The front blade 40 is symmetric about a plane of symmetry A', which corresponds to the plane of symmetry A defined by the strut 36. The valleys 116, 118 terminate into stabilizing fins 120, 122 that extend downward and away from the seated rider. The fins 120, 122 may be angled toward the plane of symmetry A from front to back. The greatest perpendicular distance between the edge of the blade and the plane of symmetry A defined by the strut 36 corresponds to a distance b that is about 191 mm. The relatively large distance of the edge of the blade from the plane of symmetry A increases the moment created by water acting on the surface of the blade. A lower surface 124 is shaped generally as a mirror image of the upper surface 112. The front blade 40 has a thickness that tapers from about 5–20 mm and preferably about 10–15 mm along the upper surface 112 of the central hill 114 to about 2–10 mm and preferably about 3–7 mm along the upper surface 112 of the valleys 116, 118 and fins 120, 122.

The perimeter edges of the front blade 40 are advantageously tapered so that the upper and lower surfaces 112, 124 meet along a smooth rounded edge having a thickness of about 1–5 mm and preferably about 1–3 mm for improved hydrodynamic efficiency. Preferably, the surface area on the upper surface 112 of the front blade 40 is greater than the surface area on the lower surface 124. With this design, the path that water follows over the front blade 40 is longer than the path that the water must follows beneath the front blade. Thus, the front blade 40 functions like the wing of a plane. The pressure exerted on the front blade 40 from above is lower than the pressure exerted on the front blade from below. The net result is lift.

The lateral pivot point of the front blade 40 advantageously runs along the longitudinal length of the top of the central hill 114. Because the valleys 116, 118 define rising surfaces toward the central hill 114, the pivot point provides mechanical advantage.

The front blade 40 has a nose 126 that extends from the central hill 114 in the longitudinal direction and is generally squared-off in the rear. Thus, the central hill 114 has a longitudinal length longer than that of valleys 116, 118 or fins 120, 122. A longitudinal hill 114 length of about 200–250 mm, has been found suitable.

The fins 120, 122 are advantageously toed out toward the rear blade 42 at an angle of about 2–5° and preferably about 3°. This slight angle assists in catching and packing water toward the rear blade 42. This increases the velocity of water past the rear blade 42 and enhances maneuverability.

Various other aspects of the shape of the front blade also provide significant advantages. Each of the valleys 116, 118 define generally planar upper and lower support surfaces 117, 119 respectively proximate the outer fins. Because the support surfaces are spaced downward from the portion of the front blade which mates with the fuselage, the length of the moment arm is increased. Similarly, the relatively large spacing of these surfaces from the plane of symmetry A of the strut 36 also increases the moment created by water acting on these surfaces.

Another important improvement is that the curved underside of the inner portion of the valleys directs water toward the plane of symmetry A defined by the strut 36. This action greatly diminishes the force communicated to the spine of the rider when the rider lands from a jump. In particular, surfaces 113 and 115 on curved underside of the inner portion of the valleys direct the water toward the plane of symmetry A. Similarly, the lower outer support surfaces 119 are curved so as to direct the water somewhat away from the plane of symmetry A of the strut 36, again reducing the force communicated to the rider. This is in stark contrast to a flat blade in which most of the force is directed upward upon reentry into the water after a jump. Importantly, the center portion of the blade along the axis of symmetry is thick enough to withstand any impact forces exerted on it and the blade continually tapers as it extends outward thereby reducing the weight of the blade.

The front blade is desirably between 46 and 137 square inches, is more desirably between 69 and 114 square inches and most desirably is between 82 and 101 square inches. If the blade is larger, the ski is very difficult to maneuver. If the blade is smaller, the blade does not sufficiently break the impact of the ski upon reentry into the water after a jump.

In another embodiment (not shown), the front blade 40 defines a generally planar member designed to increase stability characteristics. This configuration is generally similar to that disclosed in the prior art front blade but includes a taper along the perimeter edges of the front blade 40 so that the upper and lower surfaces meet along a smooth rounded edge having a thickness of about 1–5 mm and preferably about 1–3 mm.

Fuselage

Still referring to FIG. 6, the fuselage 44 spaces apart the front and rear blades 40, 42 so that the blades 40, 42 can perform their intended functions. The fuselage 44 also assists in varying the performance characteristics of the ski 10.

In the illustrated embodiment, the fuselage 44 comprises a streamlined hydrodynamically efficient member designed to provide lift and responsiveness characteristics to the ski 10. This configuration also provides reduced resistance to water when compared to the fuselage disclosed in the prior art.

The fuselage 44 has a slightly twisted cylindrical-oval or serpentine shape with a longitudinal length of about 0.3–1 m and preferably about 0.6 m, a lateral width of about 10–30 mm and preferably about 20 mm, and a transverse height of about 25–45 mm and preferably about 35 mm. The front end 128 of the fuselage 44 tapers to a rounded point, with the upper surface 129 tapering more sharply than the lower surface 131. The rear end 130 of the fuselage 44 also tapers to a rounded point, however, the upper surface tapers less sharply than the bottom surface.

Figure 16:
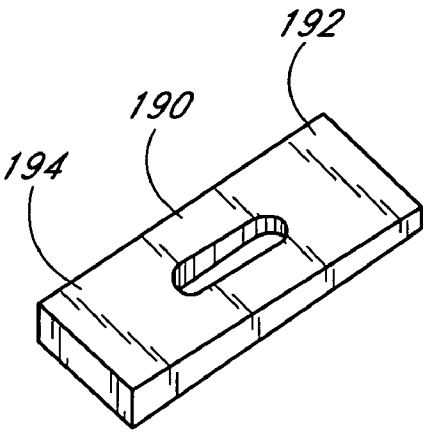
FIG. 16 is a perspective view of a third shim for use in connection with varying the attack angle of the planing blade.
Figure 15:
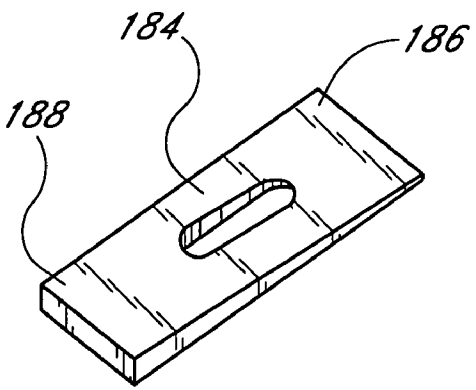
FIG. 15 is a perspective view of a second shim for use in connection with varying the attack angle of the planing blade.
Figure 14:
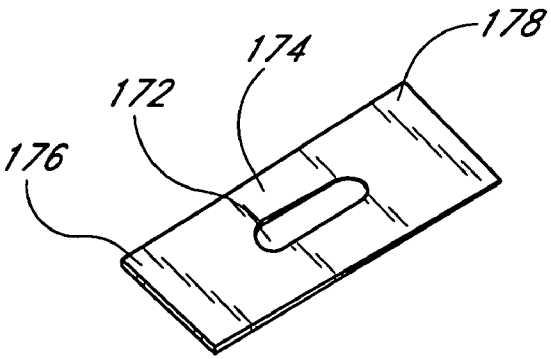
FIG. 14 is a perspective view of a first shim for use in connection with varying the attack angle of the planing blade.

A notch or cut-out 132 is formed on the lower surface 131 of the fuselage 44, longitudinally aligned with the attachment point(s) to the rear blade 42. The cut-out 132 is sized and configured to accept a wedge or shim 174 (FIGS. 14–16) and is illustrated as having a generally elongated L-shape to accept a generally rectangular shim 174 with a varied thickness. The cut-out 132 and shim 174 cooperate to vary of the attack angle of the rear blade 42 and thereby vary the performance characteristics of the ski 10, as described below. The fuselage desirably has cast in stainless steel threads for receiving and retaining the bolts securing the blades 40, 42 thereto.

In another embodiment (not shown), the fuselage comprises a generally linear tubular-oval member designed to provide stability characteristics to the ski. The fuselage has a longitudinal length, a lateral width, and a transverse height similar to the previous embodiment. Both the front and rear ends of the fuselage symmetrically taper to a smooth rounded point.

Rear Blade

Figure 10B:
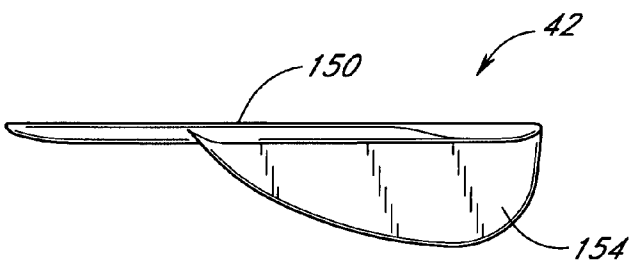
FIG. 10B is a side elevational view of the rear planing blade for the ski of FIG. 10A.
Figure 10A:
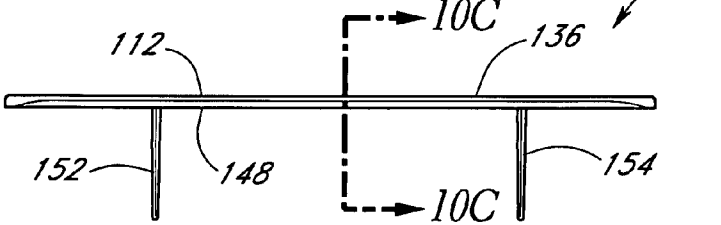
FIG. 10A is a front elevational view of a rear planing blade for the ski of FIG. 1.
Figure 10C:
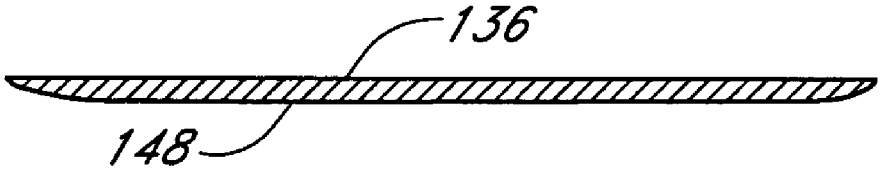
FIG. 10C is a sectional view along the line 10C—10C of FIG. 10A.

Referring to FIGS. 6 and 10, in the illustrated embodiment, the rear blade 42 defines a generally planar member 150 designed to provide stability characteristics to the ski 10. This configuration is generally similar to that disclosed in the prior art rear blade but further includes a taper along the perimeter edges so that the upper and lower surfaces 136, 148 meet along a smooth edge having a thickness of about 1–5 mm and preferably about 1–3 mm. Preferably, the rear blade 42 is designed such that the surface area on the lower surface 148 is greater than the surface area on the upper surface 136. More specifically, the lower surface 148 of the generally planar member 150 is curved while the upper surface 136 is flat. With this design, the path that water follows over the rear blade 42 is shorter than the path that the water must follows beneath the rear blade. Thus, the rear blade 42 functions like an inverted wing of a plane. The pressure exerted on the rear blade 42 from above is higher than the pressure exerted on the rear blade from below. The result is that the rear blade 42 is forced downward. At the same time, the front blade 40 is being force upward. The combination of opposing forces on the front and rear blades 40, 42 makes the ski 10 especially suitable for jumping.

Stabilizing fins 152, 154 are symmetrically spaced about 70–90 mm from the longitudinal centerline of the rear blade 42 that is defined by the intersection of the rear blade and the plane of symmetry A. These fins 152, 154 have a transverse height of about 20 to 40 mm that tapers into the lower surface 148 of the rear blade 42 in the longitudinal direction. The rear blade 42 is desirably between 15 and 44 square inches, is more desirably between 22 and 37 square inches and most desirably is between 26 and 32 square inches.

When the generally planar surface 150 of the rear blade 42 operates together with the elliptical planing surface of the front blade 40, these surfaces battle and counteract each other, providing the desired stability characteristics. Specifically, these surfaces resist the turning of the ski from side-to-side or up and down, which is very desirable for beginners.

In another embodiment, illustrated in FIGS. 7 and 1, the rear blade 42 defines a curved hydrodynamically efficient member designed to provide lift and responsiveness characteristics to the ski 10. Significantly, elliptical planing surface of the curved rear blade 42 cooperates with the elliptical planing surface of the front blade 40 greatly enhancing responsiveness. In addition, the curved planing surface of the curved rear blade 42 significantly reduces the amount of impact felt by a rider when reentering the water after a jump. The curved underside of the rear blade 42 directs the water away from the plane of symmetry A. Directing the water away from the plane of symmetry A diminishes the force communicated to the spine of the rider when the rider lands from a jump.

The rear blade 42 includes an upper surface 136 having a central valley 138 with a pair of upswept wings 140, 142 symmetrically arranged on opposing lateral sides of the valley 138. The rear blade 42 is symmetric about a plane of symmetry A", which corresponds to the plane of symmetry A defined by the strut 36. The upswept wings 140, 142 extend transversely above and longitudinally beyond the valley 138, and terminate as curved protuberances 144, 146. A valley 138 length of about 50–150 mm in the longitudinal direction has been found suitable.

The lower surface 148 is configured generally as a mirror image of the upper surface 136. Surfaces 145, 147 on the curved underside of the upswept wings 140, 142 direct the water away from the plane of symmetry A upon landing of the rear blade 42 on the water.

The rear blade 42 is desirably between 10 and 30 square inches, is more desirably between 15 and 25 square inches and most desirably is between 18 and 22 square inches.

The rear blade 42 has a thickness that tapers from about 5–15 mm and preferably about 10–15 mm.

The perimeter edges of the rear blade 42 are tapered so that the upper and lower surfaces 136, 148 meet along a smooth edge having a thickness of about 1–5 mm and preferably about 1–3 mm. Preferably, the rear blade 42 is designed such that the surface area on the lower surface 148 is greater than the surface area on the upper surface 136. More specifically, the lower surface 148 of the rear blade 42 curves toward the perimeter edges while the upper surface 136 is not curved toward the perimeter edges as seen from a cross-section of the rear blade 42 taken parallel to the plane of symmetry A". With this design, the path that water follows over the rear blade 42 is shorter than the path that the water must follows beneath the rear blade. Thus, the rear blade 42 functions like an inverted wing of a plane and is forced downward as water flows past the blade. This downward force in conjunction with the upward force imposed on the front blade 40 makes the ski 10 especially suitable for jumping.

As will be discussed in more detail below, the position of the rear blade with respect to the fuselage may be altered to adjust the responsiveness characteristics of the planing blade. This feature advantageously allows riders of different experience levels to enjoy the flying ski.

T-Tail Configuration

Figure 37:
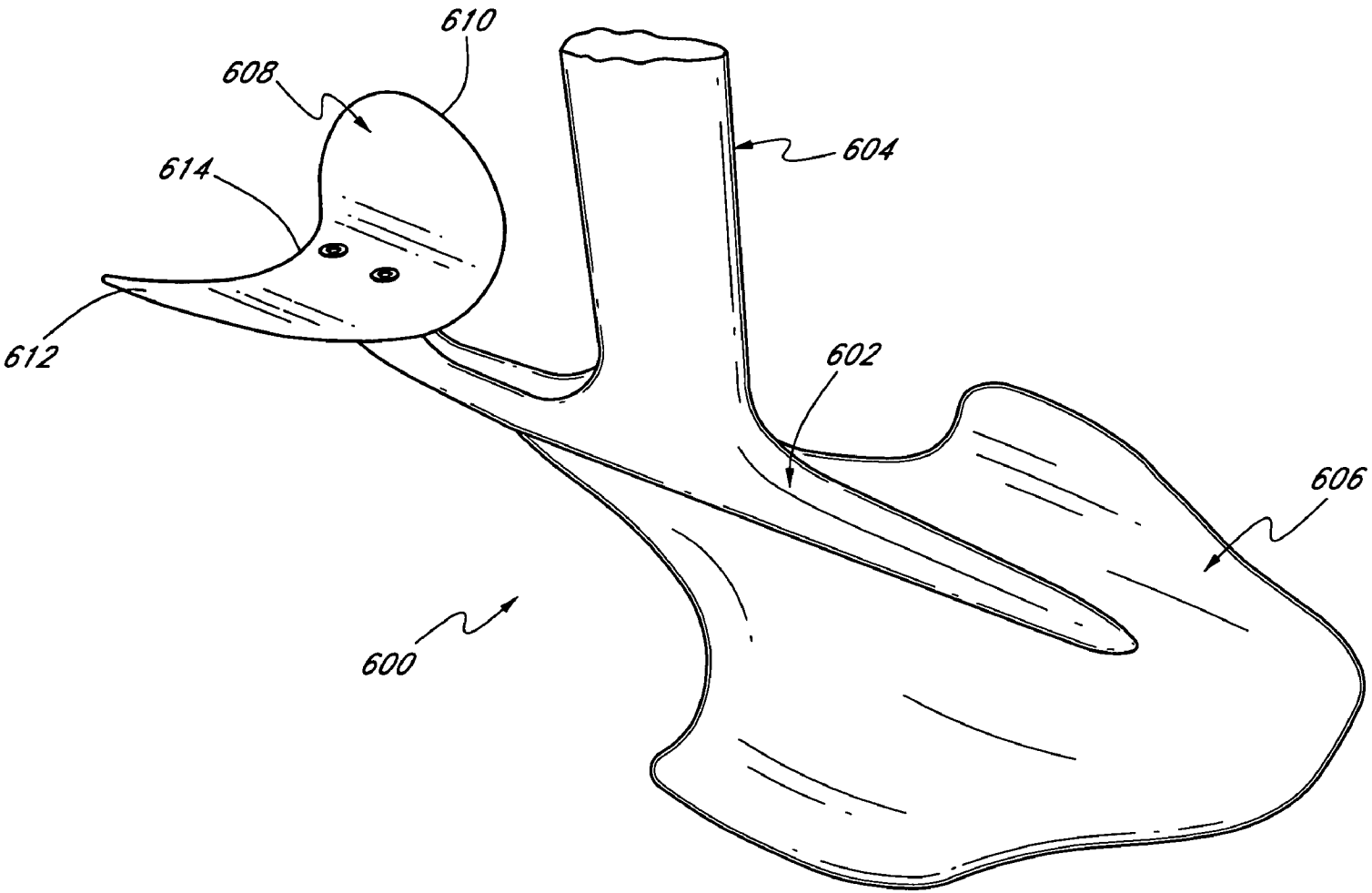
FIG. 37 is a perspective view of another preferred embodiment of a planing blade wherein the rear blade is positioned above the front blade.

Referring now to FIG. 37, one alternative planing blade 600 comprises an elongate fuselage 602 disposed at the bottom end of a strut 604, a front blade 606 coupled to a bottom side of the fuselage and a rear blade 608 coupled to a top side of the fuselage. As illustrated, the rear blade is preferably formed with upswept wings 610, 612 and a central valley 614 disposed between the wings.

Figure 37A:
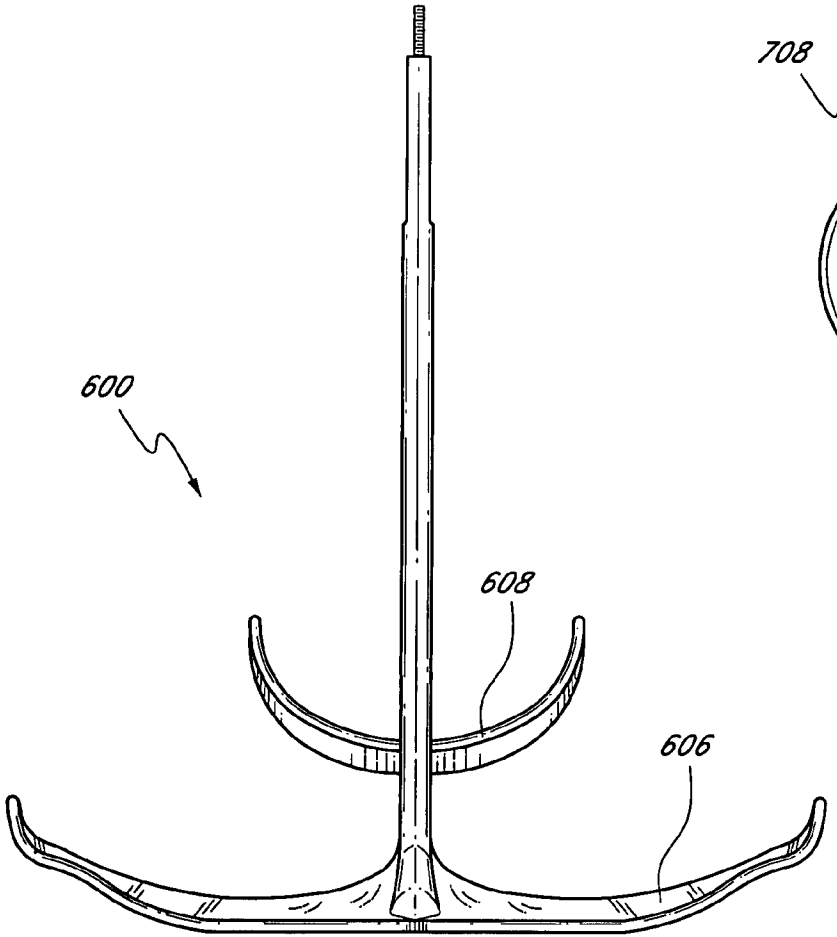
FIG. 37A is a front view illustrating the planing blade of FIG. 37.

In this embodiment, the rear blade 608 is vertically displaced from the front blade by a substantial distance. As a result, the disturbance in the water (i.e., the hydrodynamic interference) from the front blade has little or no effect on the rear blade. In other words, the rear blade moves along a path above the "dirty water" that has been disturbed by the movement of the front blade. Accordingly, the flow of water over the rear blade is less turbulent, thereby providing the rider with improved control and stability. Because the rear blade is very effective in this configuration, the size of the blade may be reduced while maintaining adequate control. The reduced size of the rear blade is advantageous because it reduces the amount of drag. FIG. 37A provides a front view of the planing blade 600 of FIG. 37. This view illustrates the profile and upswept wings of the front blade 606. Furthermore, the vertical displacement between the front 606 and rear blades 608 is readily apparent.

Foot holder

Figure 12:
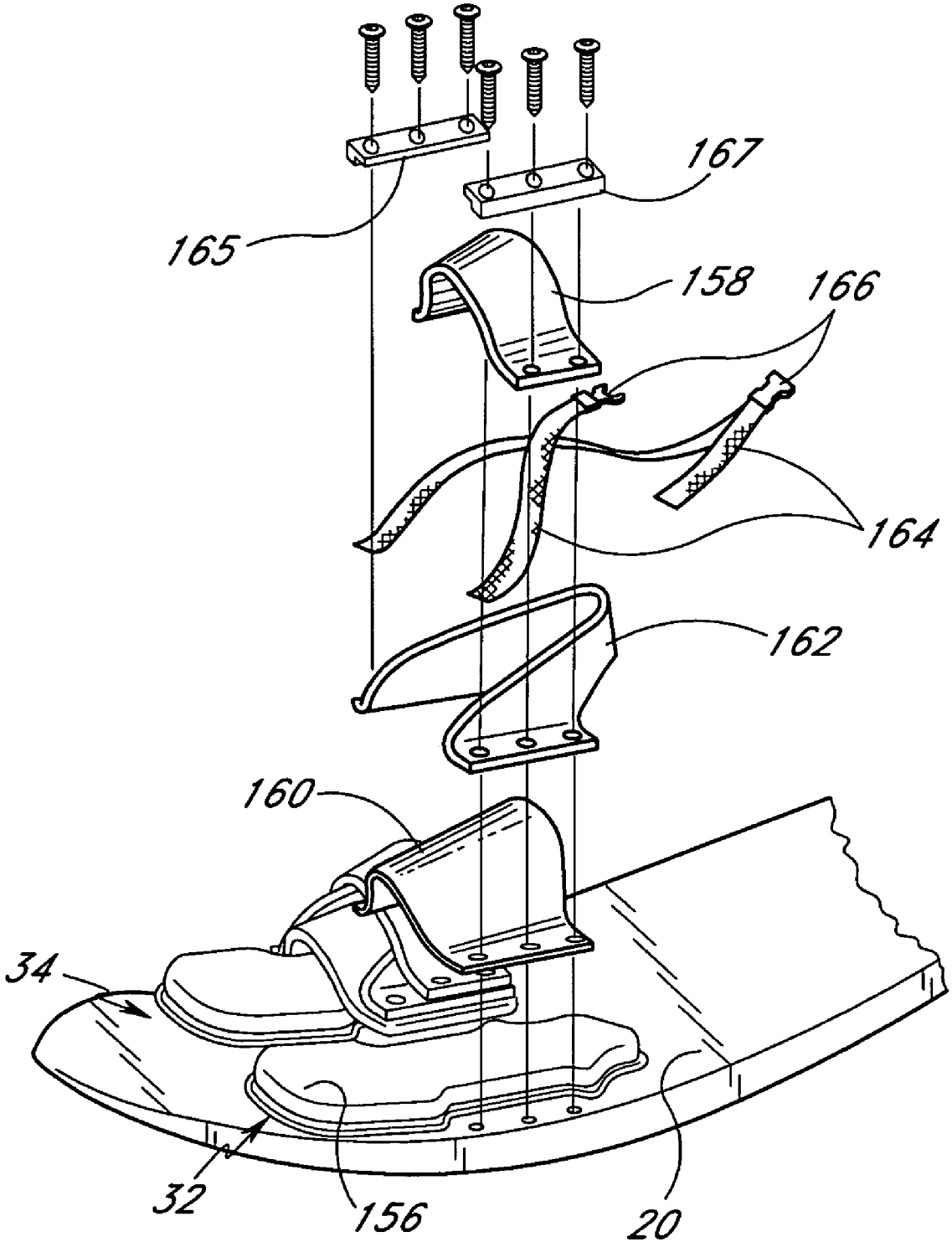
FIG. 12 is an exploded perspective view of a footholder for the ski of FIG. 1.
Figure 13:
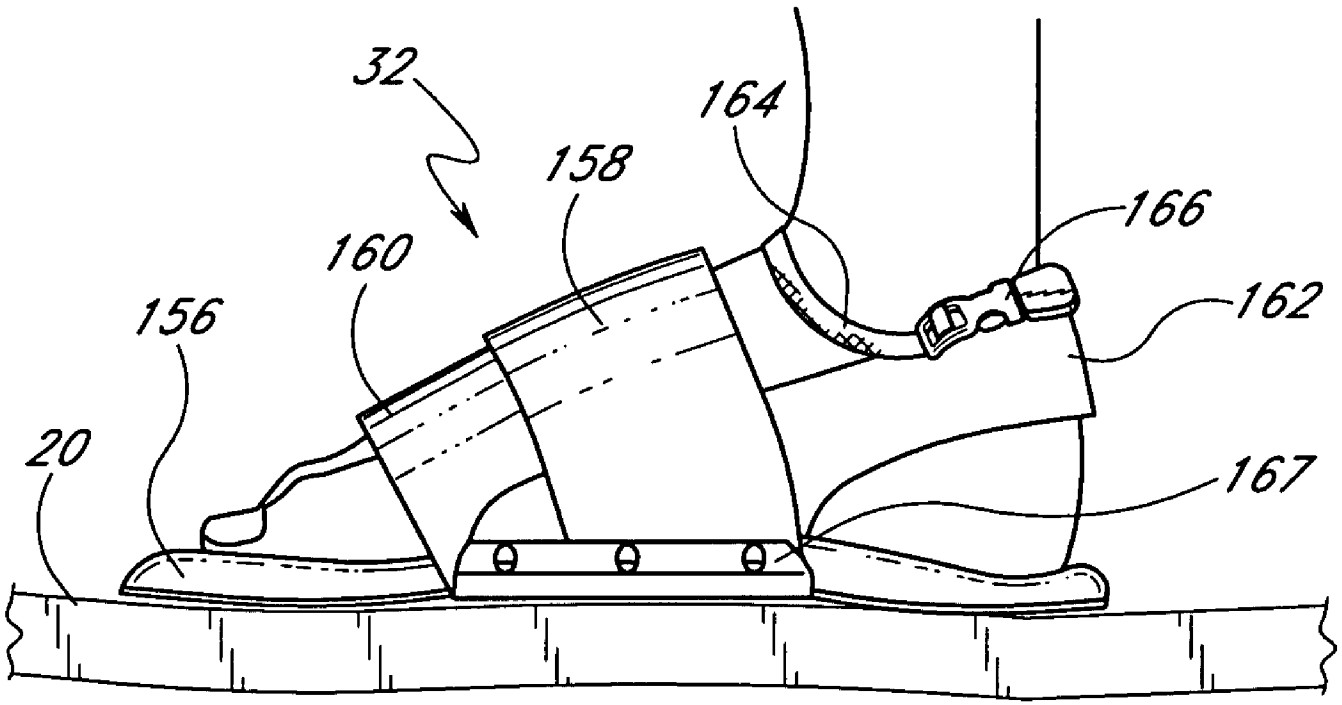
FIG. 13 is an assembled side elevational view of the footholder for the ski of FIG. 12.

Referring to FIGS. 12 and 13, a pair of foot holders 32, 34 are shown attached to the upper face 22 of the board 20 near its front end 26. Each foot holder 32, 34 has a similar size and configuration to house and secure a respective rider's foot. Alternatively, one holder sized and configured to house both rider's feet could also be used although this is less preferred because a relatively wide base assists the rider in controlling and acting on the ski 10. Secure housing of the rider's feet is desired so the rider can precisely act on and control the ski 10 (e.g. by pushing or pulling on the board via his or her feet) and thereby maneuver the ski 10.

The illustrated foot holders 32, 34 are preferably identical for ease of manufacture and assembly and only the exploded foot holder 32 is detailed for descriptive convenience, although it is understood that the other footholder 34 is constructed, assembled and operates in a similar manner as the below-described foot holder 32. The foot holder 32 has an orthopedic foot bed 156 configured similar to the bottom of a person's foot to provide rider comfort and help secure the rider's foot within the foot holder 32. The foot bed 156 is sized to accommodate a variety of human riders, whether the riders are adults or children, and irrespective of the proportions or size of the rider. The foot bed 156 is preferably constructed of a soft, resilient, water-resistant material such as foams, gels, neoprene, silicon and the like or combinations thereof. The foot bed 156 may also have a slip resistant surface and/or be ridged or scalloped (not shown) to further inhibit movement of the rider's foot relative to the foot bed 156.

A binding 158 extends laterally across the foot bed 156 with a dome-like transverse height sufficient to accept and house the rider's foot thereunder. Like the foot bed 156, the binding 158 is preferably constructed of a soft, resilient water-resistant material and may also have a slip resistant surface and/or be ridged or scalloped. Additional binding layers can also be incorporated into the foot holders 32 for any of a variety of a particular purposes, such a using a foam inset layer 160 closest to the rider's foot for additional rider comfort.

A heel strap 162 further inhibits the rider's foot from sliding out the rear of the foot holder 32. The heel strap 162 is advantageously moveable relative to the foot bed 156 and/or binding 158 to accommodate a variety of foot sizes and shapes. This moveable feature can be achieved in a variety of ways. For example and as illustrated, the heel strap 162 can comprise a resilient material, such as neoprene, rubber or silicon. For another example, the heel strap 162 can use Velcro hook and loop fasteners to interconnect opposing portions of the heel strap.

An ankle leash 164 is connected to the foot holder 32 to prevent the rider's foot from significantly separating from the foot holder 32. The leash 164 comprises an elongated flexible material with sufficient length to circumnavigate the rider's ankle. The ankle leash 164 length is advantageously adjustable to accommodate various ankle sizes and thickness and to allow a variety of separation distances between the rider's foot and the foot holder 32, 34 before the ankle leash 164 engages. The leash 164 also has a conventional quick-release buckle 166 for easy engagement and disengagement. The illustrated leash 164 has first and second ends that interconnect via the buckle 166.

A pair of elongated brackets 165, 167 having an inverted ledge are positioned along opposing lateral sides of the footholder 32. At least a portion of the binding 158, insert layer 160, heel strap 162, and ankle leash 164 are all secured under the bracket ledges 165, 167 to form the footholder 32, as further described below.

Assembly

As noted above, the flying ski 10 is advantageously constructed from several separately manufactured components for ease of manufacture. Some of the component parts may be assembled by the manufacturer, particularly those designed for permanent or semi-permanent attachment to other components. Permanent or semi-permanent attachment by the manufacturer is advantageous when there is little likelihood that the components will be detached and thus the manufacturer can help assure that the components are properly assembled.

Other components of the ski are advantageously removably attached to each other and/or specifically designed for repeated quick and easy attachment and detachment. This removable feature allows the ski to be disassembled into component parts when not in use and more easily carried.

Although some of the components are advantageously permanently, semi-permanently or removably attached, any and all of the components can be permanently, semi-permanently or removably attached to each other. Moreover, any and all of the components can be formed as a larger unitary member.

Referring to FIG. 2, the seat 30 is preferably permanently mounted to the board 20 by four allen bolts 168 and washers 169 placed on opposing corners of the base portion 46 of the seat 30 and plugs. However, the seat 30 can be permanently, semi-permanently or removably attached to the board 20 by other suitable means, such as screws, nails, clamps, clips, fasteners, adhesives, magnets, Velcro and the like or combinations thereof.

The foot holders 32, 34 are preferably connected to the board 20 by three screws 170 on one side of the foot holder 32, 34 and three screws 170 on the opposite side of the foot holder 32, 34. Like the seat 30, the foot holders 32, 34 can be attached to the board 20 by a variety of other suitable fastening devices. The illustrated footbed 156 is preferably separately attached to the board 20 by an adhesive glue, although there is no requirement for separate attachment or use of glue.

Referring to FIGS. 3, 4, and 5, the strut 36 connects to the seat 30 through the internal passageway 94 and advantageously can be repeatedly connected and disconnected in a quick and easy manner so that these two components 30, 36 can be detached and easily carried when the ski 10 is not in use. Specifically, the bolt 64 that extends from the tongue 106 of the strut 36 is advanced through the keyway groove 96 in the strut 36 and into the Y-junction site 62 of the seat 30. The Morris taper and outwardly extending ears 108, 110 of the tongue 106 form-fit into the keyway groove 96. The threaded turn knob 172 is then attached to the bolt 64 to secure the strut 36 to the seat 30. This configuration provides for quick and easy repeated connection and disconnection of these components 30, 36. That is, to connect the strut 36 to the seat 30, a person merely places the board 20 (with seat 30 attached thereto) over the strut 36, aligns the passageway 94 and the tongue 106, then lowers the passageway 94 onto and through the tongue 106 (or vice-versa) so that the bolt 64 extends into the Y-junction site 62, and then attaches the turn knob 172 to the exposed bolt 64. Similarly, to disconnect the strut 36 from the seat 30, a person merely detaches the turn knob 172 from the exposed bolt 64 and then removes the tongue 106 from the passageway 94. The opposing end of the strut 36 is preferably formed in unity with the fuselage 44, however, as explained above, this connection can be provided by other permanent, semi-permanent or removable configurations.

Referring back to FIG. 2, the front and rear planing blades 40, 42 are attached to the fuselage 44. Although a variety of attachment devices can be used, the particular device used preferably does not alter the performance characteristics of the particular planing blade components 40, 42, 44 coupled thereto. The illustrated embodiment shows the front planing blade 40 attached to the top of the fuselage 44 by three bolts 168 laterally centered along internal stainless steel insets cast into the fuselage and corresponding to the attachment location of the central hill 114 of the planing blade and extending in the longitudinal direction. The illustrated embodiment shows the rear planing blade 42 attached to the bottom of the fuselage 44 by two bolts 170 laterally centered along internal stainless steel inset threads cast into the central fuselage and received in countersunk holes in the valley 138 of the planing blade and extending in the longitudinal direction.

Altering Performance Characteristics of the Ski

As noted above, one of the improvements of the flying ski 10 of the present invention relates to a method and system for altering the performance characteristics of the ski 10. That is, the improved flying ski 10 can be readily adapted for use with beginning and intermediate riders such that the ski provides a substantially stable, steady ride while being relatively unresponsive to rider actions (such as swaying from side to side). In this mode, ski responsiveness is generally analogous to a conventional jet ski. The improved flying ski 10 can also be readily adapted for use with advanced riders such that the ski provides a generally stable ride while promptly responding to rider actions. In this mode, ski responsiveness is generally analogous to a conventional water ski. The improved flying ski 10 can further be readily adapted for use with professional riders such that the ski provides an action-packed extremely responsive ride while immediately responding to rider actions and being capable of such maneuvers as jumping up to about 10 m in the air or performing a series of continuous somersaults.

Figure 11B:
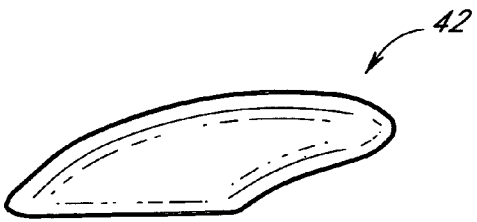
FIG. 11B is a side elevational view of the rear planing blade for the ski of FIG. 11A.
Figure 11A:
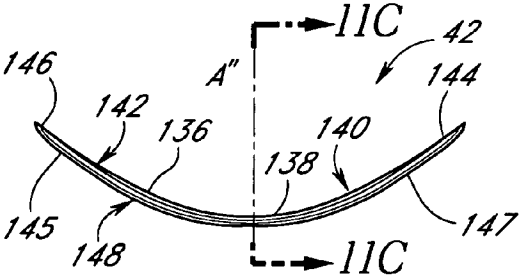
FIG. 11A is a front elevational view of another rear planing blade for the ski of FIG. 1.
Figure 11C:
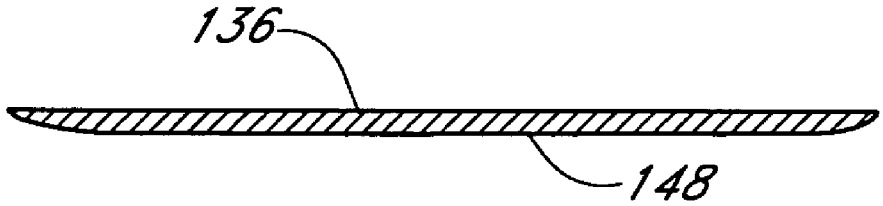
FIG. 11C is a sectional view along the line 11C—11C of FIG. 11A.

A variety of methods can be used to alter the performance characteristics of the flying ski 10, such as shortening the distance between the planing blades or increasing the size differential between the planing blades (a smaller rear blade will enhance performance). Preferably, however, it has been found that varying the hydrodynamic configuration of the planing blade 38 and varying the attack angle of the planing blade 38 provides a suitable range of performance characteristics while requiring few additional components or modifications to the overall flying ski 10. More specifically, it has been found that selectively using a rear planing blade 42 with either a generally planar member 150 (FIGS. 6 and 10), a curved member with rearwardly extending upswept wings 140, 142 (FIGS. 7 and 11), or a curved member with frontwardly extending upswept wings 196, 198 (FIGS. 8 and 11), and/or varying the attack angle of the rear planing blade 38 by placing a shim 174 between the rear blade 38 and the fuselage 44, allows the ski 10 to provide sufficiently varied performance characteristics so as to be enjoyed by beginning, intermediate, advanced and professional riders, as described below. While the disclosed blades are strongly preferred, the planing blade 38 could have a variety of other shapes. Similarly, the attack angle could be varied in other ways, such as by an adjustment screw. Moreover, methods and systems other than by selectively using a rear planing blade 42 with either a generally planar member 150, a curved member with upswept wings 140, 142, or a curved member with frontswept wings 196, 198 and/or varying the attack angle of the rear planing blade 38 by placing a shim 174 between the rear blade 38 and the fuselage 44 can be used to alter the performance characteristics of the flying ski 10. However, the disclosed shim arrangement is preferred in that it provides strength, reliability, few parts and permits the blades to be adjusted without removal of the blade or shim, speeding adjustment and reducing the risk of lost parts. This is particularly important in a water setting.

Beginning and Intermediate Modes

Figure 6A:
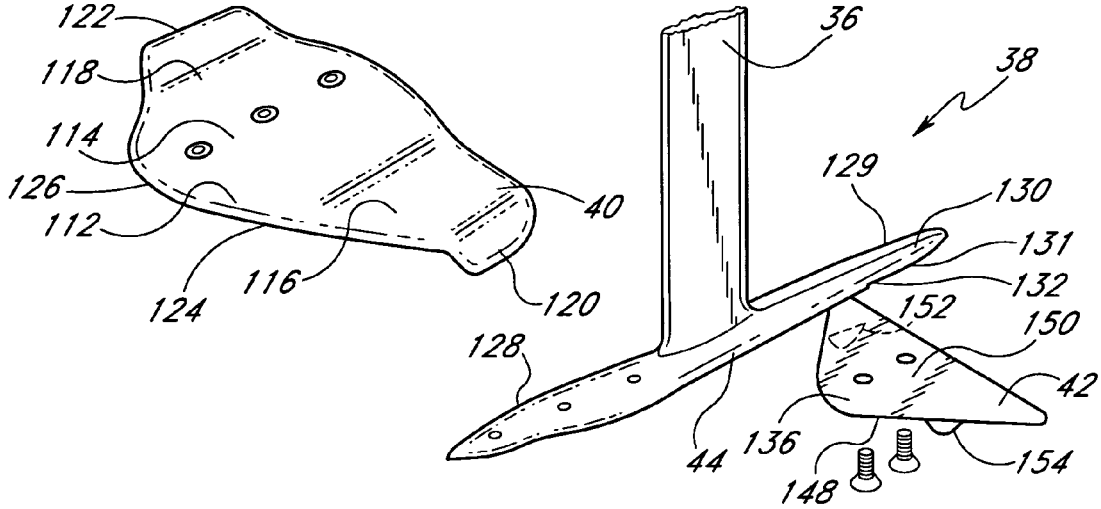
FIG. 6A is an exploded perspective view of a preferred embodiment of a planing blade for the ski of FIG. 1.
Figure 6B:
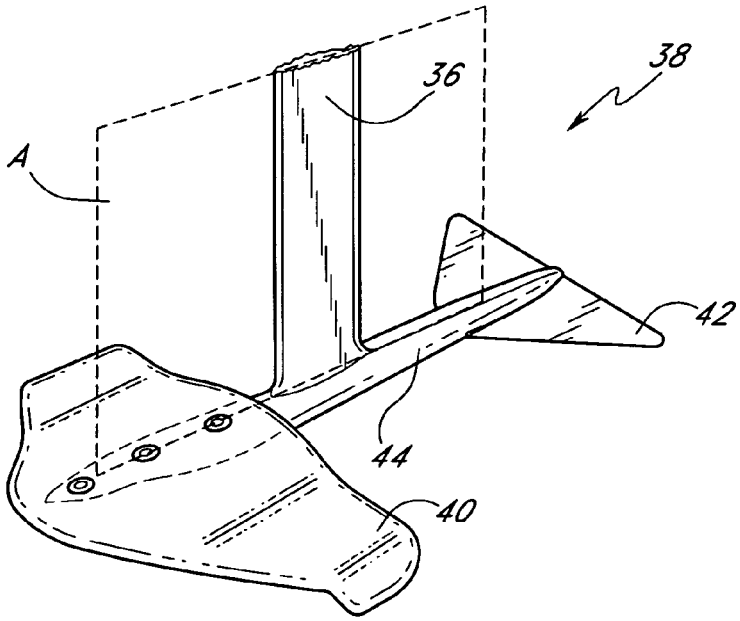
FIG. 6B is an assembled perspective view of the planing blade of FIG. 6A.

Referring to FIGS. 6A and 6B, in beginning mode, the board 20, seat 30, foot holders 32, 34, fuselage 44 and undulated front planing blade 40 are attached as described above. The rear planing blade 42 having the generally planar member 150 is similarly attached to the fuselage as described above. When so configured, the ski 10 provides a significantly stable, steady boat-like ride that is relatively dampened response to rider actions.

Figure 17A:
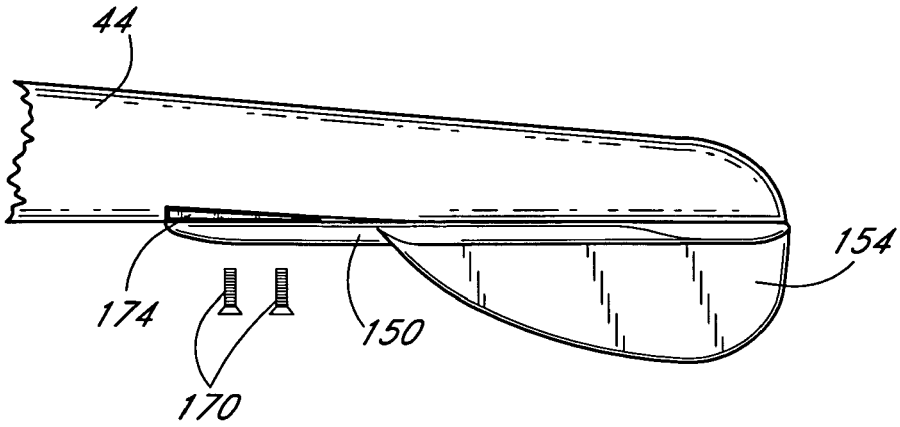
FIG. 17A is a side elevational view of a portion of the planing blade of FIG. 6A, illustrating the first shim placed within a cut-out of the fuselage and between the fuselage and the rear planing blade to alter the angle of attack of the rear planing blade.

Referring to FIG. 17A, as the rider's skills increase, the generally planar rear blade 150 can be detached from the fuselage 44 and a first blade position support or shim 174 (FIG. 14) placed within the cut-out 132 of the fuselage 44 and between the rear planing blade 42 and the fuselage 44. The first shim 174 is sized and configured to be accepted into the cut-out 132 and is shaped in continuity with the fuselage 44. The first shim 174 has an elongated oval opening 172 that extends along the shim 174 in the longitudinal direction through which the fastener (e.g. screw 170) that couples the fuselage 44 to the rear blade 42 can extend and the shim 174 sandwiched therebetween. Accordingly, the fasteners function to secure both the rear blade 42 and the blade support 174 in a fixed position. The first shim 174 has a longitudinal length of about 30–70 mm, a lateral width that varies from about 20–30 mm at one end 176 of the shim to a lateral width of about 15–25 mm at the opposite side 178 of the shim 174, and a transverse height that varies linearly from about 0.5–1 mm at one end 176 of the shim 174 to a thickness of about 1–3 mm at the opposite end 178 of the shim 174. So positioned, the first shim 174 increases the attack angle of the rear blade 42 about 0.5°. An increased attack angle increase the downward force on the rear blade 42, which, in turn, provides increased performance characteristics.

Figure 17B:
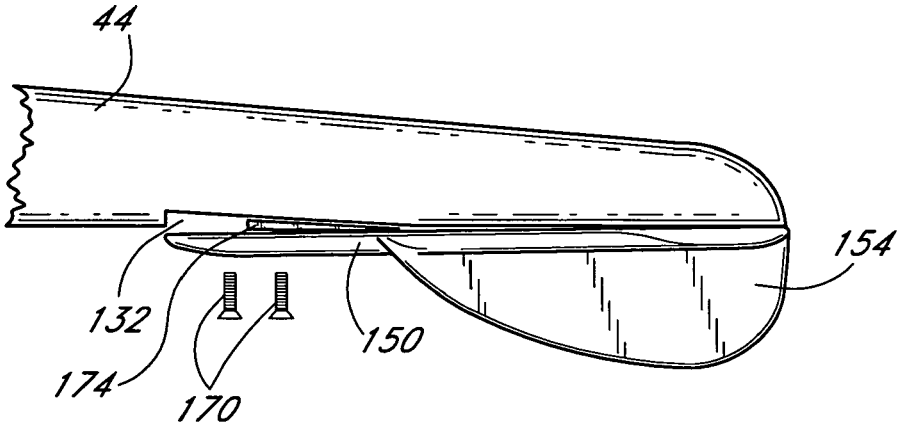
FIG. 17B is a side elevational view of a portion of the planing blade of FIG. 17A, illustrating the first shim moved from within a cut-out of the fuselage towards the rear end of the planing blade to increase the angle of attack of the rear planing blade.
Figure 17C:
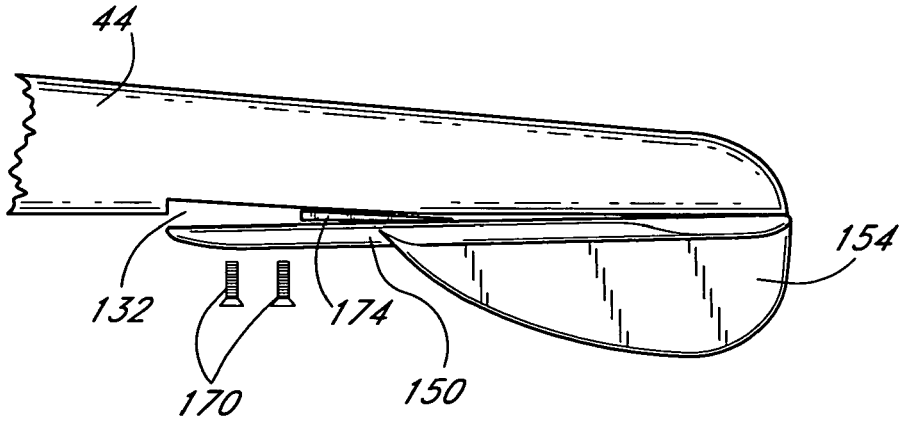
FIG. 17C is a side elevational view of a portion of the planing blade of FIG. 17B, illustrating the first shim moved further towards the rear end of the planing blade to further increase the angle of attack of the rear planing blade.
Figure 18:
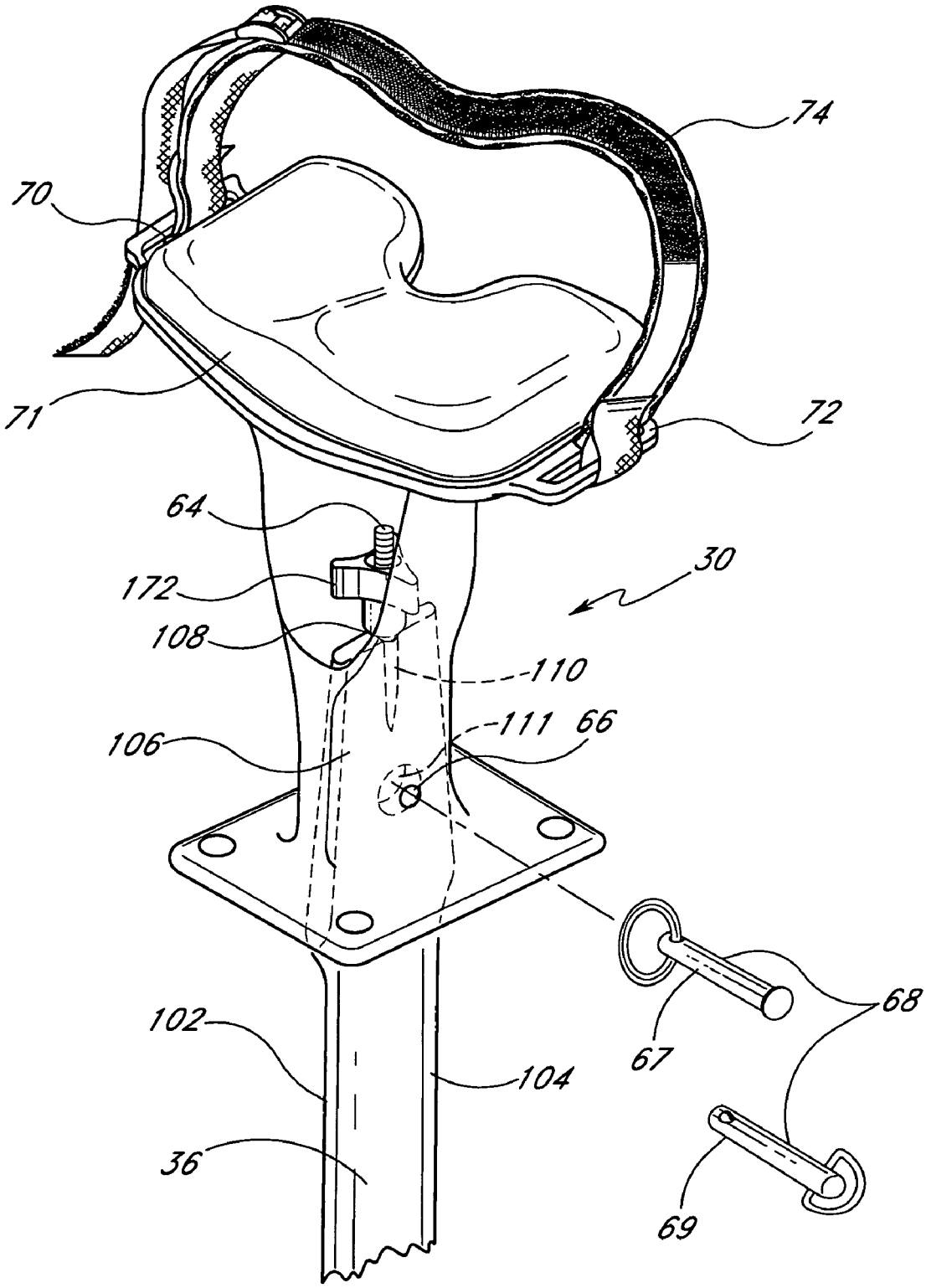
FIG. 18 is a perspective view of the strut and an alternative seat and seatbelt for a flying ski.
Figure 19:
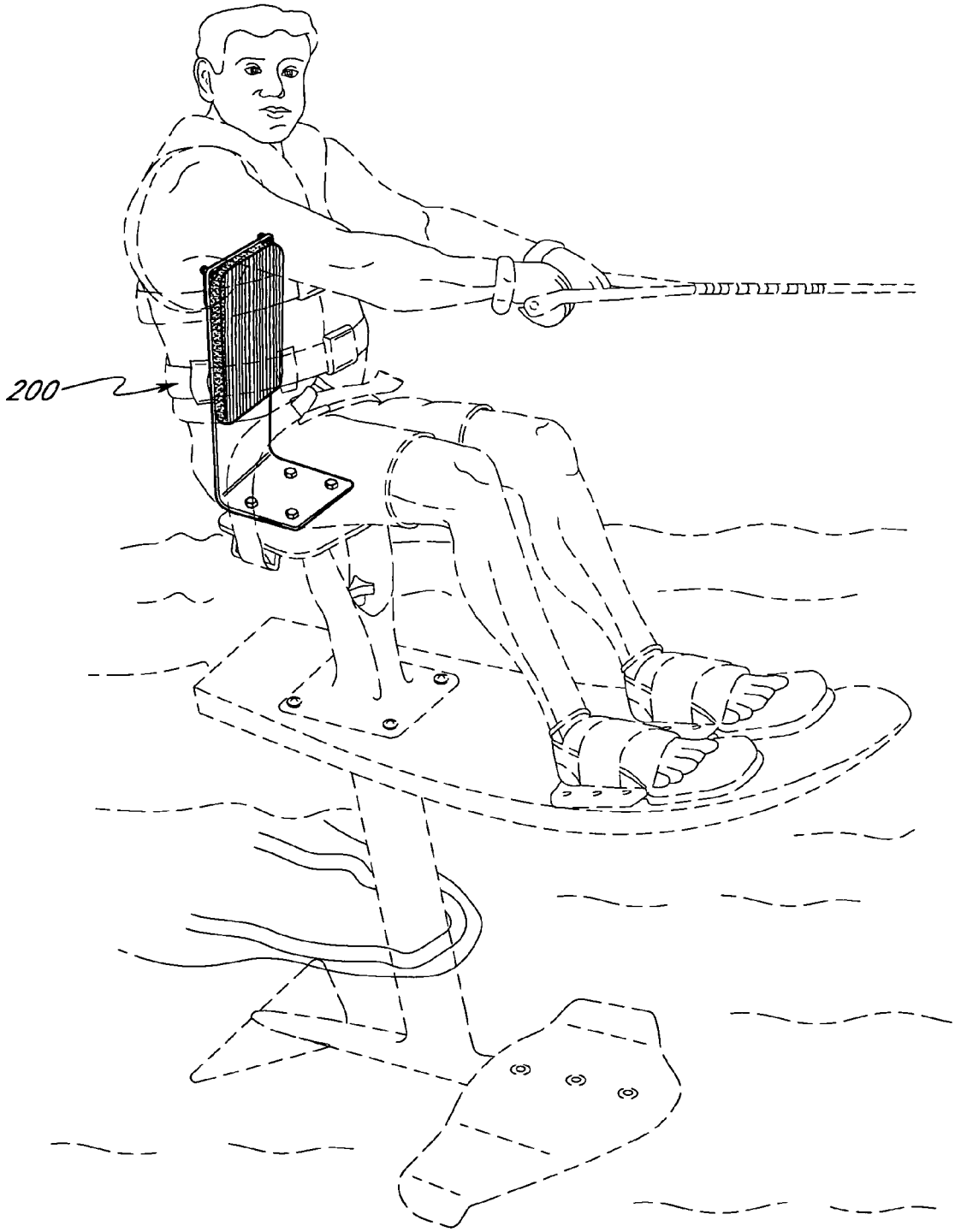
FIG. 19 is a perspective view of a rider atop the flying ski, with the seat back attached.

Referring to FIG. 17B, as the rider's skills further increase, the generally planar rear blade 150 can be again detached from the fuselage 44 and the first shim 174 moved out of or along the cut-out 132 and advanced in the longitudinal direction toward the rear of the fuselage 44. The rear blade 150 can then be reattached to the fuselage 44. Moving the first shim 174 toward the rear of the fuselage 44 further increases the attack angle greater than about 0.5° which further provides increased performance characteristics and the first shim 174 can be repeatedly and incrementally moved in the longitudinal direction toward the rear of the passageway (e.g. FIG. 17C) to vary the attack angle of the rear blade 42 from about 0.5° to about 10°.

As the rider's skills continue to increase, the generally planar rear blade 150 can be detached from the fuselage 44 and the first shim 174 replaced by a second blade support or positioning shim 184 (FIG. 15) that is placed between the rear planing blade 42 and the fuselage 44. Like the first shim 174, the second shim 184 is sized and configured to be accepted into the cut-out 132 of the fuselage 44 and is shaped in continuity with the fuselage 44. The second shim 184 has a longitudinal length and lateral width similar to the first shim 174 and a transverse height that varies from about 1–3 mm at one longitudinal end 186 of the shim 184 to a thickness of about 3–5 mm at the opposite longitudinal end 188 of the shim 184. The second shim 188 increases the attack angle of the rear blade 42 to about 10° when arranged in within the cut-out 132. However, like the first shim 174, the second shim 184 can be repeatedly moved towards the rear of the fuselage 44 to further increase the attack angle of the rear blade 42 along a continuum of about 10°–20°.

As the rider's skills still further increase, the generally planar rear blade 150 can be detached from the fuselage 44 and the second shim 184 replaced by a third blade positioning support or shim 190 (FIG. 16) that is placed between the rear planing blade 42 and the fuselage 44. Like the first and second shims, 174, 184 the third shim 190 is sized and configured to be accepted into the cut-out 132 of the fuselage 44 and is shaped in continuity with the fuselage 44. The third shim 190 has a longitudinal length and lateral width similar to the first and second shims 174, 184 and a transverse height that varies from about 3–5 mm at one longitudinal end 192 of the shim 184 to a thickness of about 5–9 mm at the opposite longitudinal end 194 of the shim 184. The third shim 190 increases the attack angle of the rear blade 42 to about 20° when arranged within the cut-out 132. However, like the first and second shim 174, 184, the third shim 190 can be repeatedly moved towards the rear of the fuselage 44 to further increases the attack angle of the rear blade 42 along a continuum of about 20°–30°.

Figure 38:
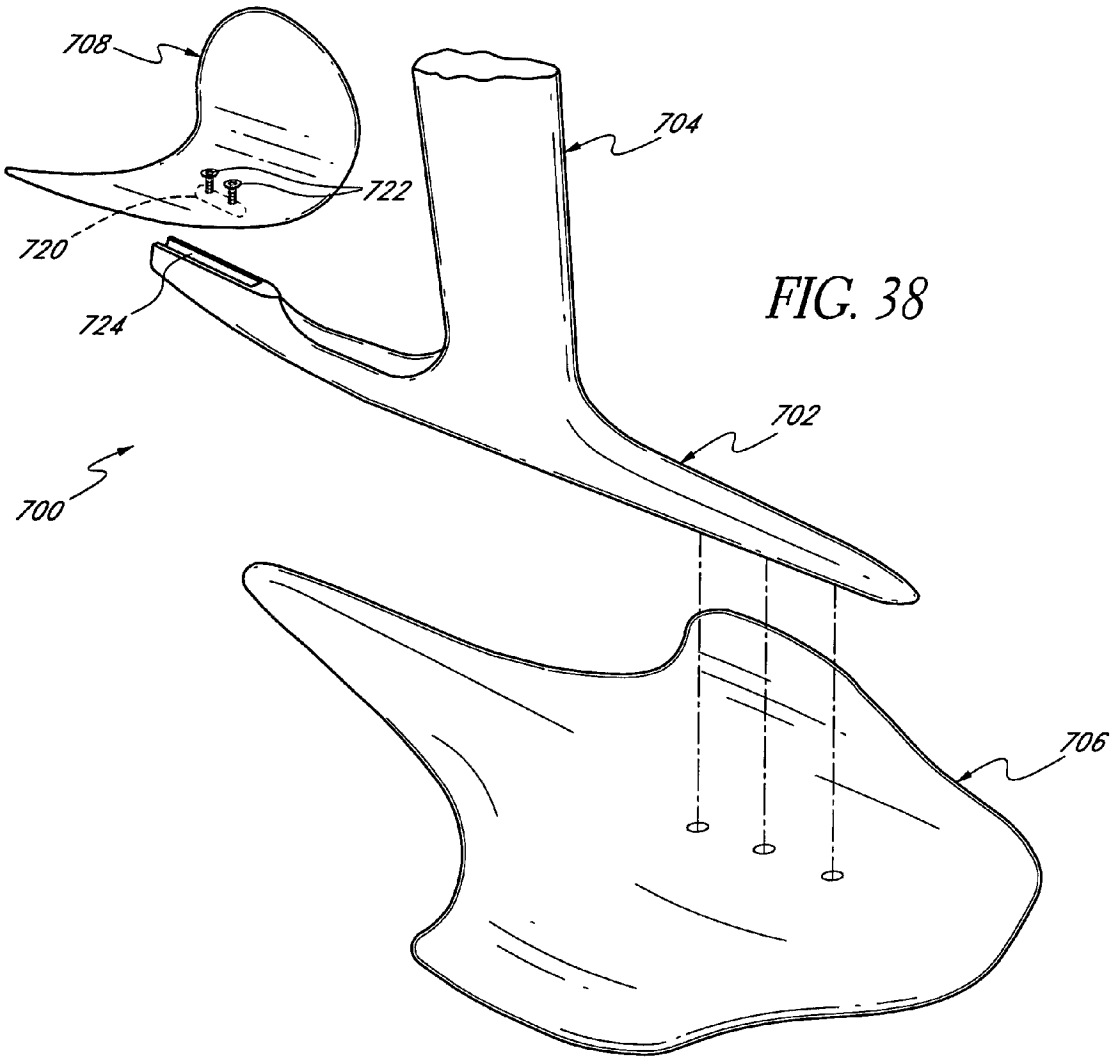
FIG. 38 is an exploded perspective view of another preferred embodiment of a planing blade wherein the position of the rear blade is adjustable with respect to the fuselage.

Referring now to FIG. 38, another alternative planing blade configuration 700 comprises an elongate fuselage 702 disposed at the bottom end of a strut 704, a front blade 706 coupled to a front portion of the fuselage and a rear blade 708 coupled to the rear portion of the fuselage. In this embodiment, the rear blade 708 is slidably inter-connectable to the rear portion of the fuselage for selecting the desired performance characteristics of the flying ski.

In one preferred embodiment, a barrel nut 720 is coupled to the bottom side of the rear blade 708. A pair of fasteners 722 extends through the rear blade 708 and into the barrel nut. The barrel nut is preferably spaced apart from the bottom side of the rear blade. The fuselage is formed with an interior channel 724 for slidably receiving the barrel nut 720. The channel 724 is provided with a slot along the top side of the fuselage which allows the fasteners to extend upward from the channel.

Figure 39:
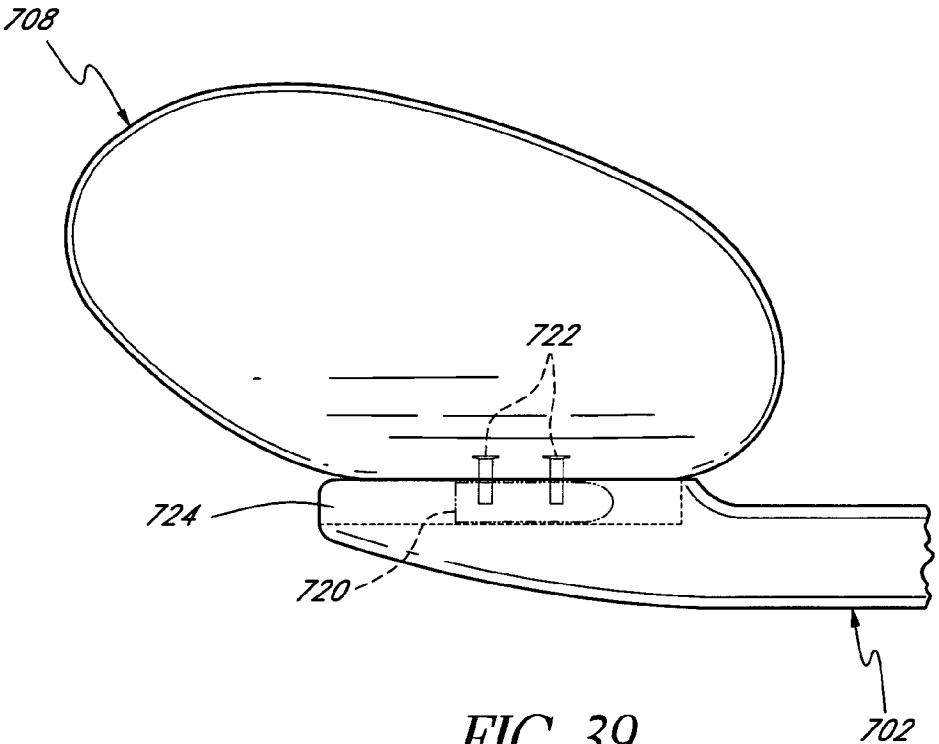
FIG. 39 is a side view illustrating the operation of the rear blade assembly of FIG. 38.

Referring now to FIGS. 38 and 39, when the fasteners (e.g., screws) are loosened, the barrel nut 720 is free to slide within the channel 724 for moving the rear blade 708 with respect to the fuselage 702. When the rear blade is positioned at the desired location, the fasteners are tightened, thereby drawing the barrel nut and rear blade into closer proximity. As the fasteners are tightened, a portion of the fuselage is gripped between a top side of the barrel nut and a bottom side of the rear blade, thereby fixing the position of the rear blade with respect to the fuselage.

In beginning mode, the rear blade may be slid to the extreme aft end of the fuselage to create a very large gap between the front and rear blades. With the rear blade in this location, the responsiveness of the planing blade is relatively low. As a result, the flying ski is relatively stable and is therefore very forgiving to the rider during training. As the rider becomes accustomed to the flying ski, in the intermediate mode, the rear blade is moved forward to increase the responsiveness of the planing blade, thereby allowing the rider to maneuver through the water more quickly and with greater control.

Advanced Mode

Figure 7A:
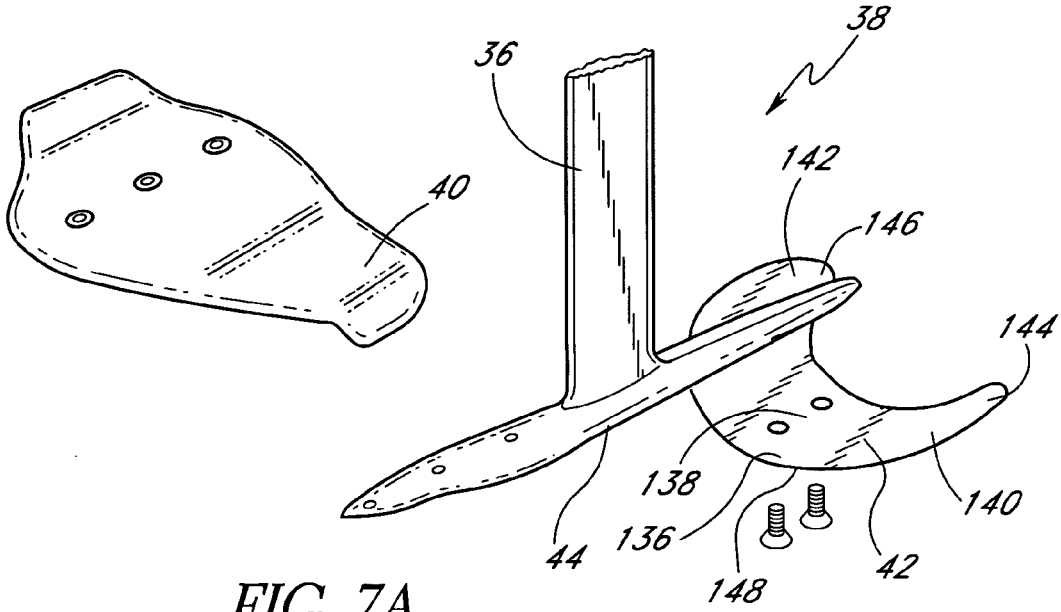
FIG. 7A is an exploded perspective view of another preferred embodiment of a planing blade for the ski of FIG. 1.
Figure 7B:
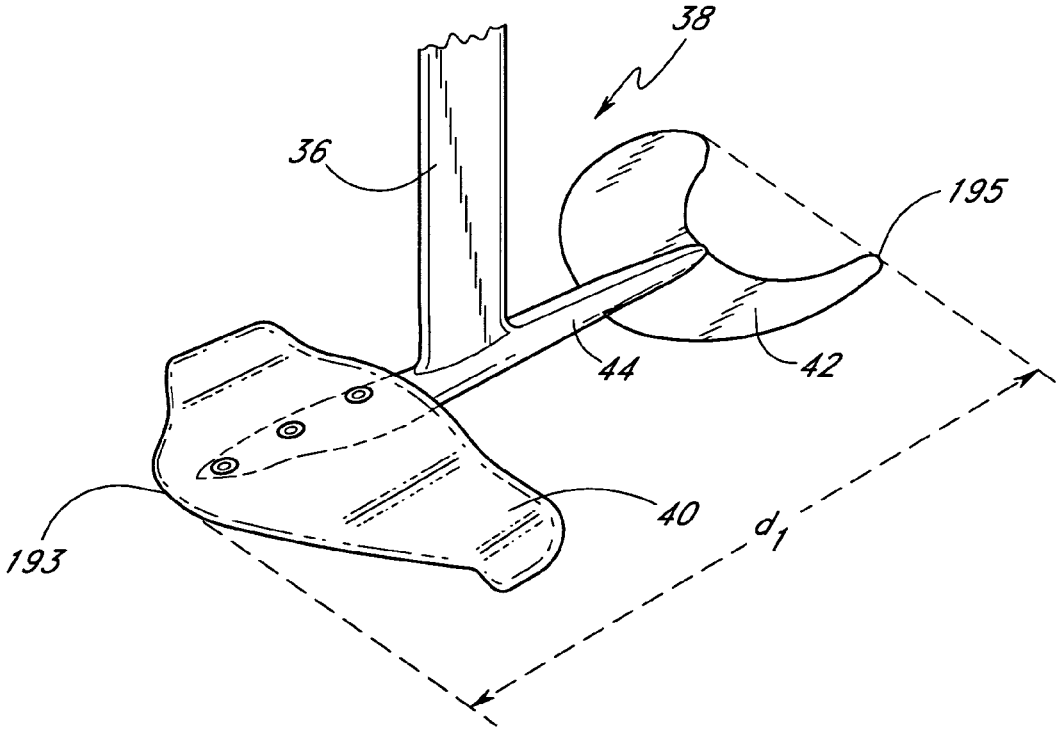
FIG. 7B is an assembled perspective view of the planing blade for the ski of FIG. 7A.

Referring to FIGS. 7A and 7B, in advanced mode, the board 20, seat 30, foot holders 32, 34, fuselage 44, and undulated front planing blade 40 are attached as described in connection with the beginning and intermediate modes. However, rather than using the rear planing blade 42 with the generally planar member 150, the rear planing blade 42 with upswept wings 140, 142 is used and attached to the fuselage 44 as described above. When so configured, the ski 10 provides a generally stable ride while promptly responding to rider actions. The rear planing blade 42 with upswept wings 140, 142 enhances the hydrodynamic nature of the planing blade 38, which, in turn, provides increased performance characteristics.

In the advanced mode, the blade assembly 38 has a longitudinal length $d_1$ that is larger than that of the configuration designed for professional riders. As shown in FIG. 7B, the front blade 40 has a leading edge 193 and rear blade has a trailing edge 195 that correspond to the foremost front and rear edges of the planing blade 38. The longitudinal length $d_1$ is the greatest perpendicular distance between the leading edge 193 and the trailing edge 195. As the distance between the front edge 193 of the front blade and the rear edge 195 of the rear blade is increased, there is a longer effective moment arm and thus, a larger moment generated by the resistance of the water on the blades.

As the rider skills increase, and in a similar manner as described in connection with the beginning and intermediate modes, a series of shims 174, 184, 190 (FIGS. 14–16) can be used to modify the attack angle of the rear planing blade 42 and thereby further increase the performance characteristics of the ski 10.

Using the embodiment provided with a slidably interconnected rear blade, in the advanced mode, the rear blade is slid forward along the fuselage to decrease the gap between the front and rear blades. As a result, the rider is provided with a very responsive planing blade for quickly maneuvering through the water and enhancing the rider's ability to perform tricks.

Professional Mode

Figure 8A:
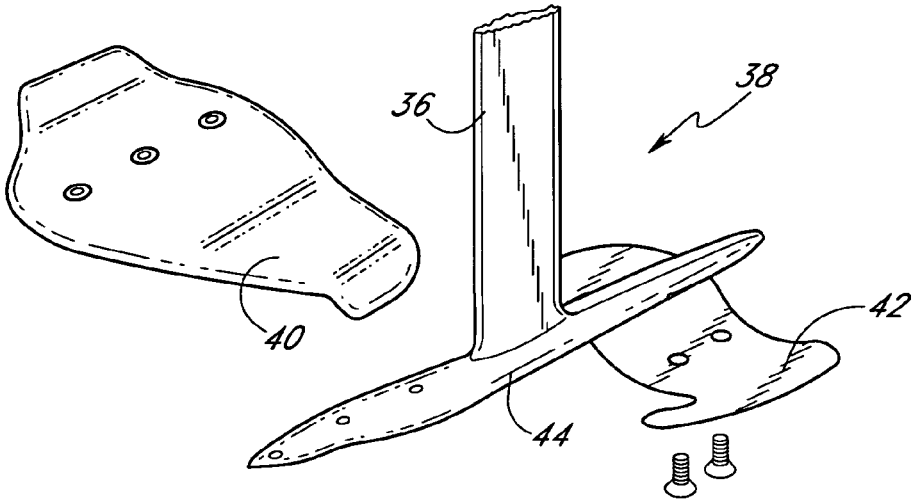
FIG. 8A is an exploded perspective view of another preferred embodiment of a planing blade for the ski of FIG. 1.
Figure 8B:
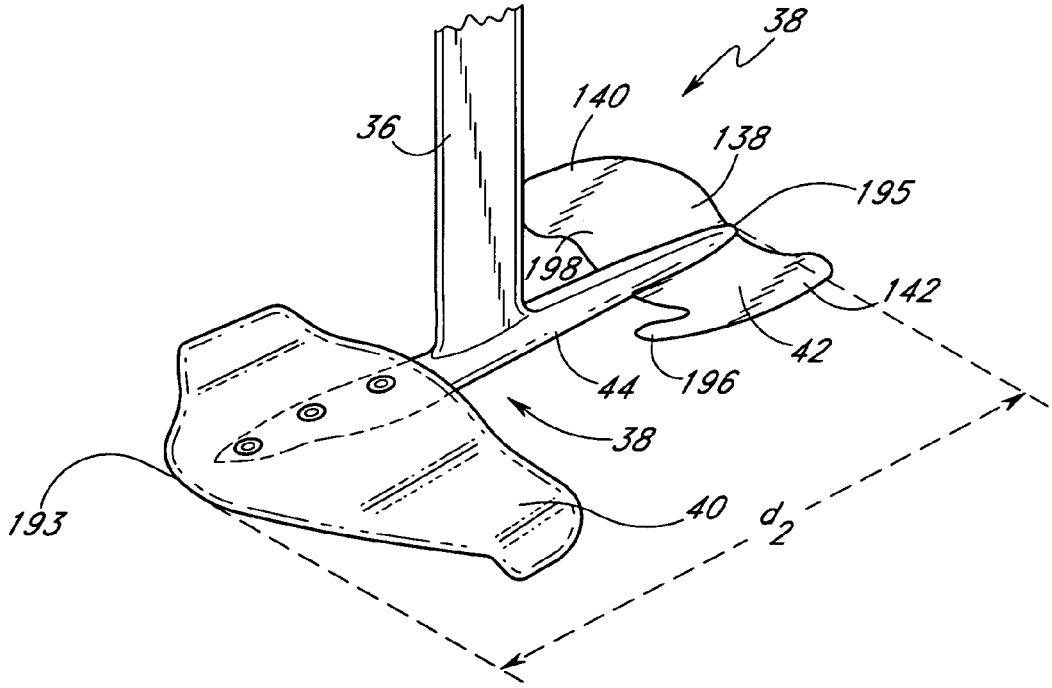
FIG. 8B is an assembled perspective view of the planing blade for the ski of FIG. 8A.

Referring to FIGS. 8A and 8B, in professional mode, the board 20, seat 30, foot holders 32, 34, fuselage 44, and undulated front planing blade 40 are attached as described in connection with the beginning, intermediate and advanced modes. Like the advanced mode, the rear planing blade 42 with upswept wings 140, 142 is used rather than the rear planing blade 42 with the generally planar member 150. However, the rear planing blade 42 with upswept wings 140, 142 is rotated 180° to form a rear planing blade 42 with frontswept wings 196, 198 that is attached to the fuselage 44 as described above. The frontswept wings 196, 198 act like canards. When so configured, the ski 10 provides an action-packed ride while immediately responding to rider actions. The rear planing blade 42 with frontswept wings 196, 198 significantly enhances the hydrodynamic nature of the planing blade 38, which, in turn, provides increased performance characteristics.

In the professional mode, the blade assembly 38 has a longitudinal length $d_2$ that is shorter than the longitudinal length $d_1$ used in the advanced mode where the upswept wings 140, 142 are employed. As above, the longitudinal length $d_2$ is defined as the greatest perpendicular distance between the leading edge 193 and the trailing edge 195.

As the rider skills increase, and in a similar manner as described in connection with the beginning, intermediate and advanced modes, the series of shims 174, 184, 190 (FIGS. 14–16) can be used to modify the attack angle of the rear planing blade 38 and thereby further increase the performance characteristics of the ski 10. It has been observed that thicker wedges that provide an increased attack angle are desirable to vary ski performance when the frontswept wings 196, 198 are used because the frontswept wings 196, 198 are closer to the front blade 40, which decreases the mechanical leverage of the overall planing blade 38. That is, in the professional mode, the distance between the front edge 193 of the front blade 40 and the rear edge 195 of the rear blade 42 is reduced, so there is a shorter effective moment arm and thus, a smaller moment generated by the resistance of the water on the blades. The rear blade 42 also has a fixed angle of attack which pulls the rear of the fuselage downward. In the professional mode, this angle of attack is greater to compensate for the decreased effective movement arm of the rear blade.

Use of a limited number of shims to vary the angle of attack to less than about 30° is preferred in order to reduce the number of component parts used in connection with the ski 10 and because this particular system embodiment provides a sufficient continuum of varied performance characteristics to satisfy beginner, intermediate, advanced and professional riders. Similarly, the disclosed device is preferred in that only two types of rear planing blades 38 can be used to vary the hydrodynamic nature of the ski 10 for use with beginner, intermediate, advanced and professional riders.

Using the embodiment provided with a slidably interconnected rear blade, in the professional mode, the rear blade is moved to the extreme forward position for minimizing the gap between the front and rear blades. As a result, the rider is provided with an extremely responsive planing blade that allows the rider to perform advanced tricks.

Ski Maintenance

It has been observed that when the planing blade 38, strut 36 and seat 30 are constructed from the preferred aluminum material, this material tends to tarnish and lose its original smooth, shiny finish. The smooth finish is preferred, particularly in connection with the submerged planing blade 38 and strut 36, because it decreases water resistance and otherwise improves ski performance.

A variety of techniques can be used to maintain the preferred smooth, shiny surface. For example, conventional metal cleaners, such as MOTHER'S magnesium and aluminum polish, are suitable for this purpose when the manufacturer's directions are followed. Importantly, however, the performance of the cast strut and blades is greatly enhanced if the polished surface is also sealed. Conventional aluminum sealants are suitable for this purpose when applied to the components 30, 36, 38 as follows. First, the sealant is applied by a rag or towel and allowed to turn generally cloudy. After about 1–3 minutes, the sealant is wiped off. Through this application procedure, the sealant has been found to inhibit tarnishing for up to about 1 month.

Detachable Back Support

As noted above, one aspect of the present flying ski is a detachable back support 200, seen in FIGS. 19–22. Because the flying ski is designed for use in water, it is desirable that the back support 200 be constructed of a metal is corrosion resistant and that has a high strength to weight ratio, to minimize density. A preferred metal is aluminum. Referring to FIGS. 20A–20B, and 21A–21C, the back support 200 comprises two basic pieces, to which the other components are attached. The first piece, the upright 202, is desirably formed from a rectangular flat sheet of material that is bent at substantially a 90-degree angle along an axis that lies perpendicular to the longitudinal axis of the rectangular sheet. The bend produces a vertical portion 204 that is preferably approximately 2½ times the length of the horizontal portion 206.

The second piece is a substantially L-shaped spine 208 that supports the upright 202 and gives it rigidity in the direction perpendicular to the vertical portion 204. The spine 208 is preferably constructed from the same material as the upright 202, with the two being fastened together by welding. To ensure a great deal of rigidity in the spine 208, it is preferably formed from a single sheet of metal. The sheet is cut to conform to the contour of the rear surface of the upright 202, and stretches from near the top of the vertical portion 204 to near the front of the horizontal portion 206.

The spine 208 desirably has a cross-sectional size and shape that is well adapted to resist flexing in the direction perpendicular to the surface of the upright 202. Such a cross-section imparts rigidity to the upright 202, thus providing greater back support to the rider. Any number of cross-sectional sizes and shapes meet this requirement. However, because the flying ski is designed for use in water, weight must be minimized so that the device will float. Therefore, providing the spine 208 with a cross-section such that height (in the direction perpendicular to the surface of the upright 202) is several times greater than width (in the direction parallel to both the surface of the upright 202 and the surface of the horizontal portion 206), is preferred.

Figure 22:
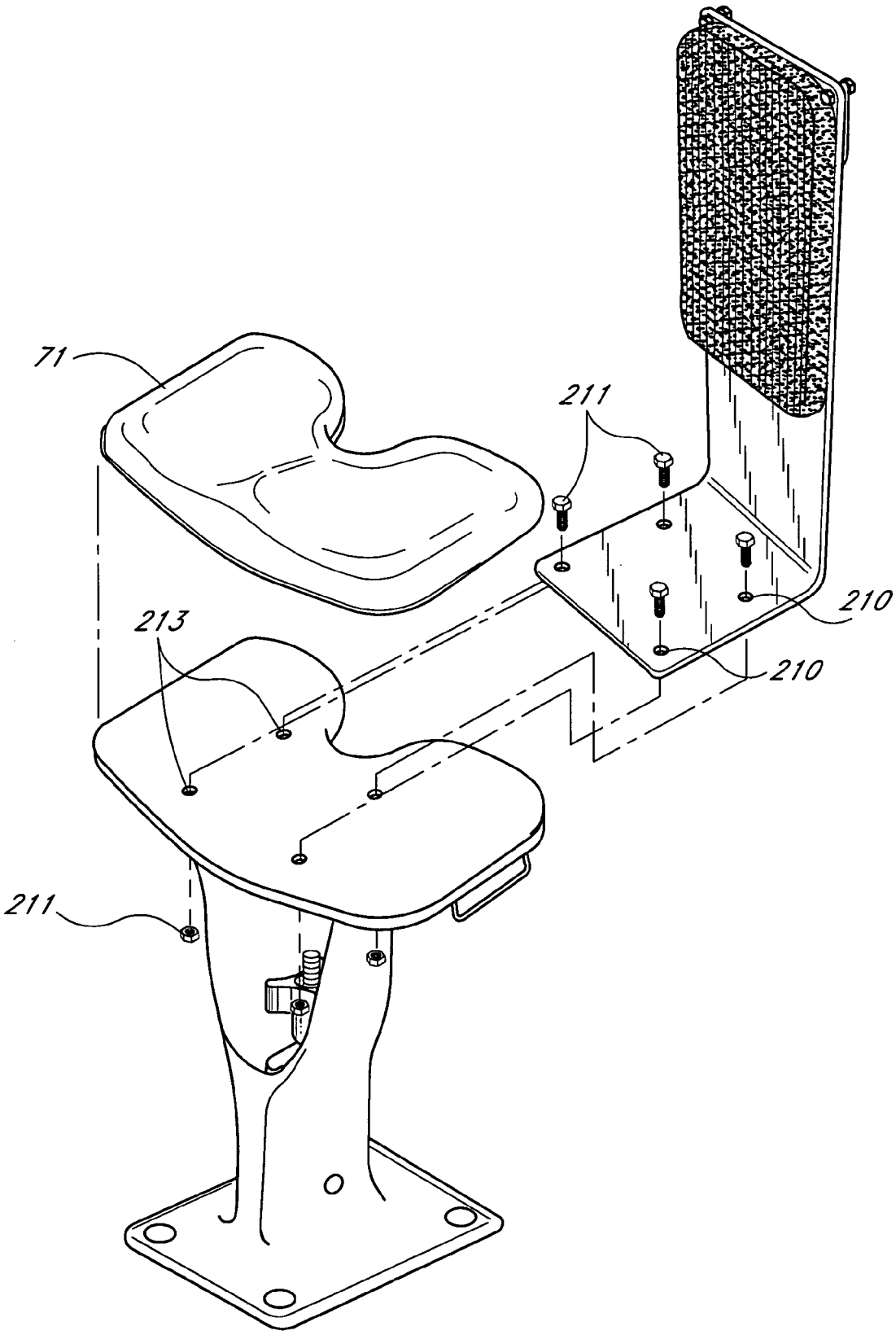
FIG. 22 is an exploded perspective view of the seat and seat back, illustrating how the two are connected together.

FIG. 22 illustrates the preferred method of attachment for the back support 200. The horizontal portion 206 contains a plurality of holes 210 that are adapted to receive threaded bolt and nut fasteners 211. The position of the holes 210 corresponds to a second plurality of holes 213 in the seat 50. The back support 200 may be positioned such that the lower surface of the horizontal portion 206 faces the upper surface of the seat 50, as shown in FIG. 22. Alternatively, the back support 200 may be positioned such that the upper surface of the horizontal portion 206 faces the lower surface of the seat 50. In either configuration, the threaded fasteners 211 secure the two components together. To increase rider comfort, the cushion 71 covers the portion of the fasteners 211 that protrude from the upper surface of the horizontal portion 206 or seat 50. While it is preferred that the back support 200 is detachable from the seat 50, one of skill in the art will recognize that the back support 200 could be permanently fixed to the seat 50.

Figure 21C:
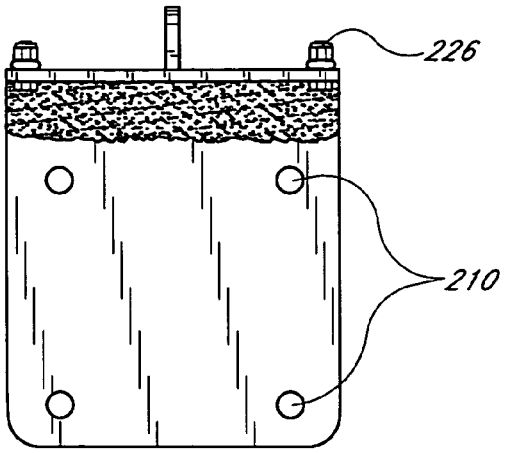
FIGS. 21A–21C are front, left side and top views, respectively, of the seat back attachment.
Figure 21A:
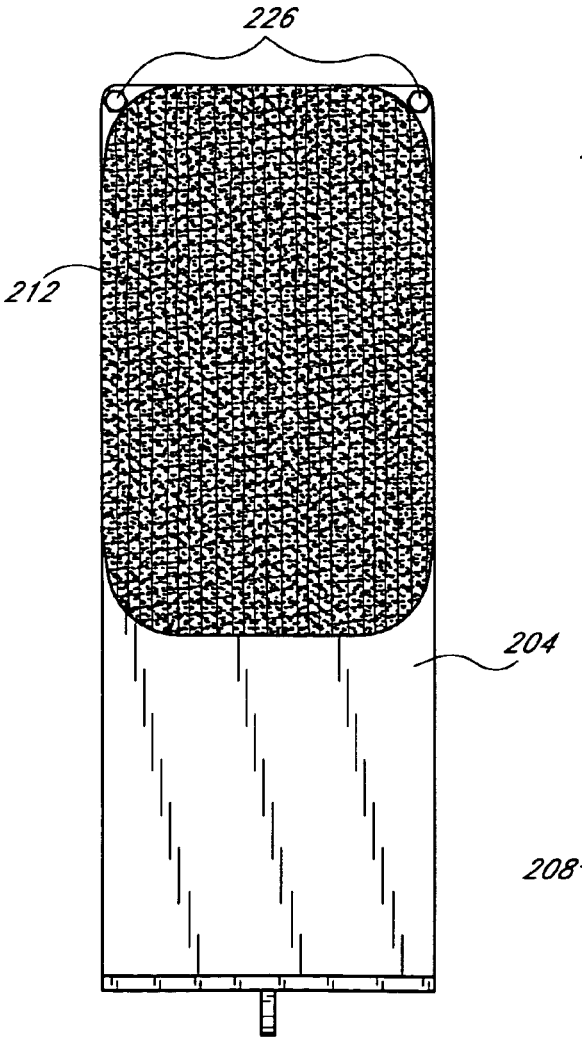
Figure 21B:
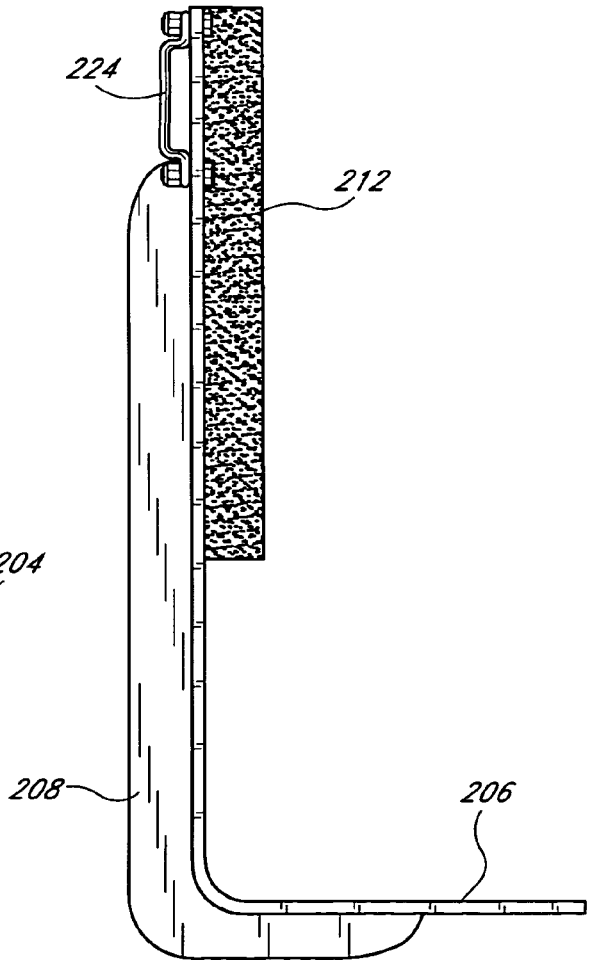

A pad 212, as shown in FIGS. 21A–C, is preferably secured near the upper end of the vertical portion 204. The pad 212 provides a more comfortable surface to support the rider's back, and also preferably makes the device more buoyant. In order to provide both of these characteristics, the pad 212 is preferably constructed of a material that is soft, resilient and buoyant. The pad 212 is preferably secured to the vertical portion 204 by a waterproof adhesive.

Figure 20A:
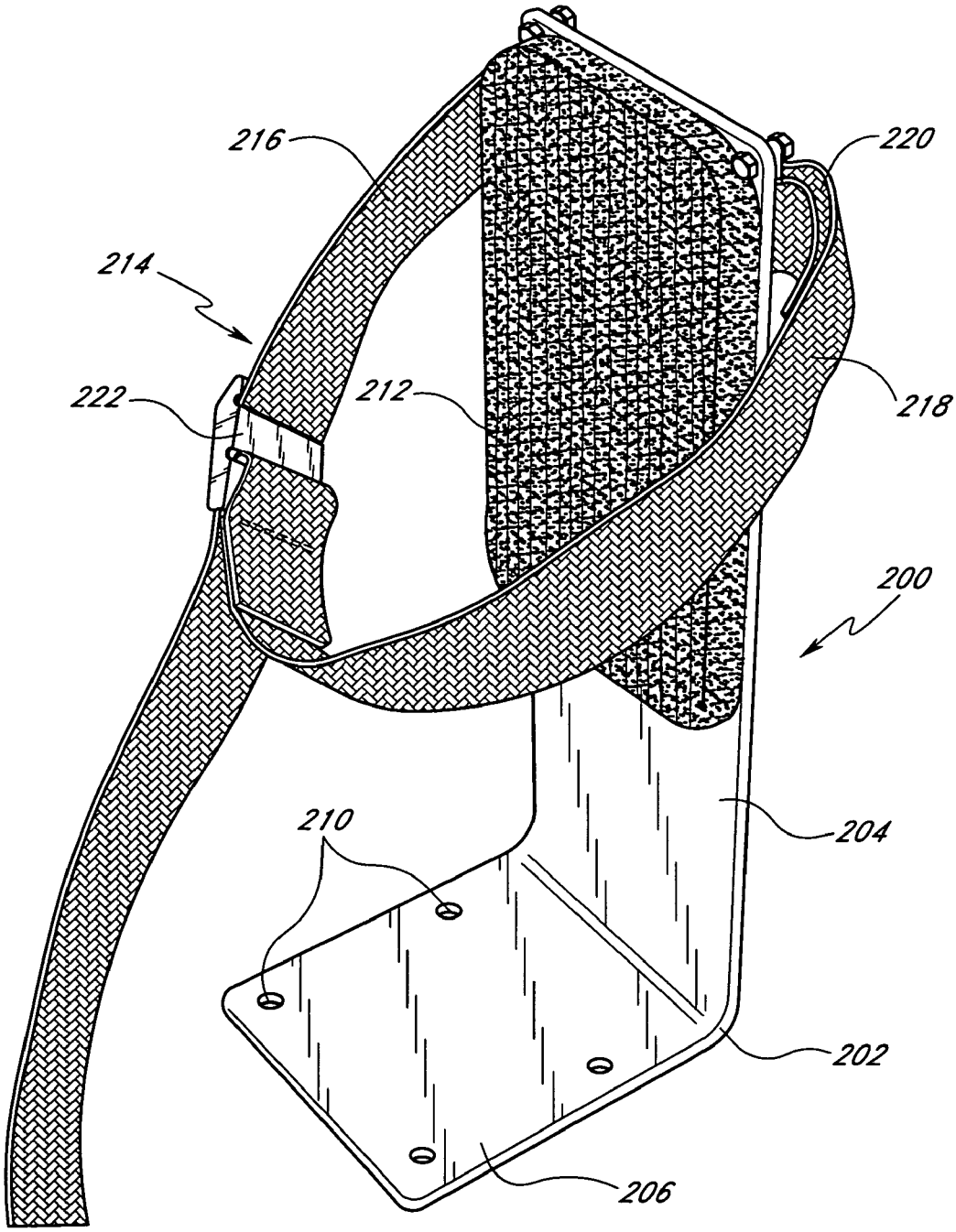
FIG. 20A is a front perspective view of the seat back attachment, illustrating the pad against which the rider rests his back, and a safety belt that wraps around the rider's chest.

A safety belt 214, shown in FIG. 20A, is preferably attached to the detachable back support 200. The belt 214 consists of a male strap 216 and a female strap 218. Each strap has a closed loop 220 at one end. The female strap 218 is fitted with a clamp 222 at its end opposite the closed loop 220.

Figure 20B:
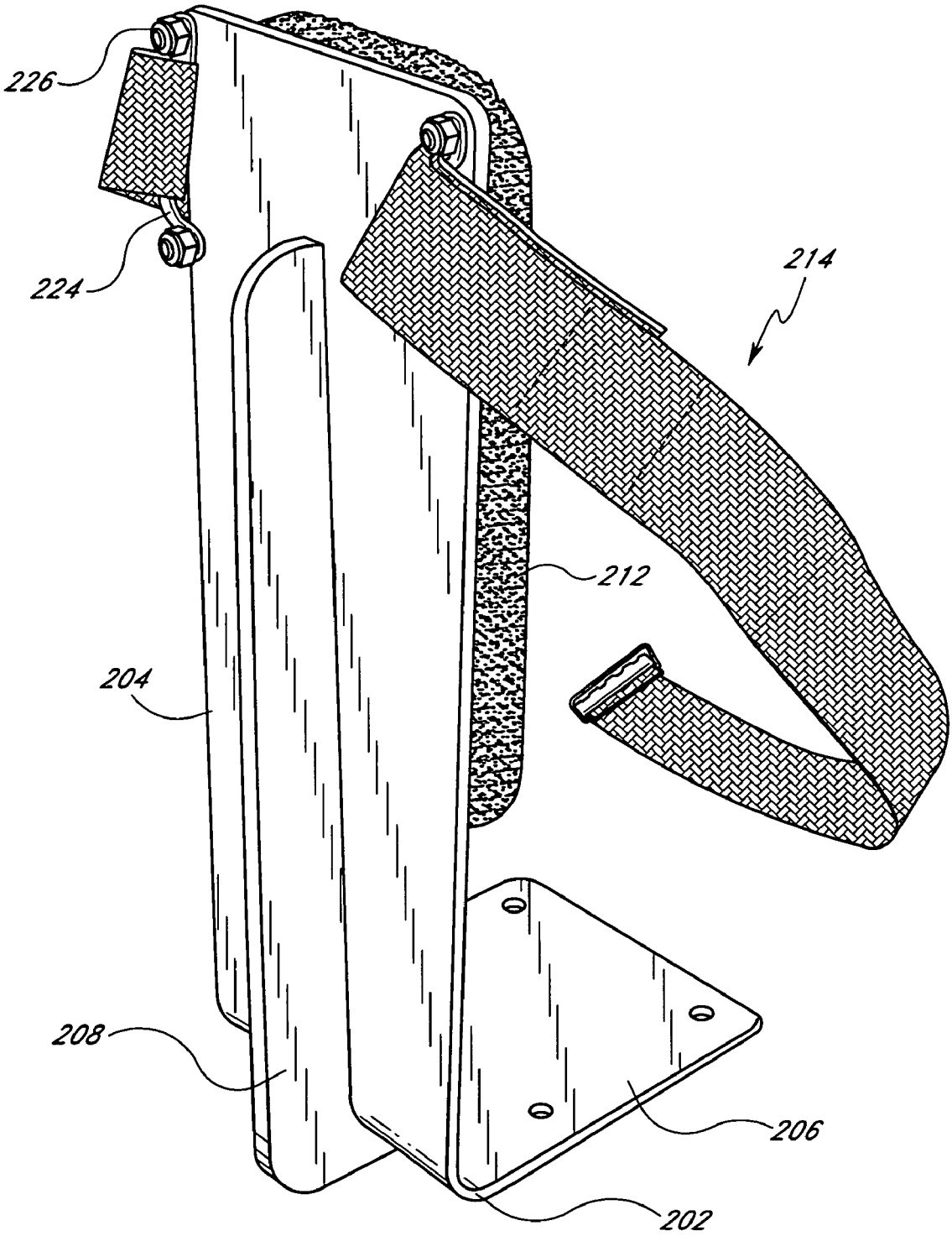
FIG. 20B is a rear perspective view of the seat back attachment, illustrating the spine that provides the seat back with rigidity.

The belt 214 is secured to the back support 200 by a pair of brackets 224, shown in FIGS. 20B and 21B. The brackets 224 contain holes at either end that corresponds to holes provided at the upper end of the vertical portion 204. The brackets 224 are detachably mounted to the vertical portion 204 by threaded bolt and nut fasteners 226. The brackets 224 are adapted to anchor the closed loop 220 ends of the belt 214 as shown in FIGS. 20A–B.

To fasten the safety belt 214, the rider passes the male strap 216 through the clamp 222, tightening the belt 214 snugly around his chest. With the belt 214 at a comfortable tension, the rider closes the clamp 222 on the male strap 216 to secure the belt 214 in place.

Safety Belt

Figure 23:
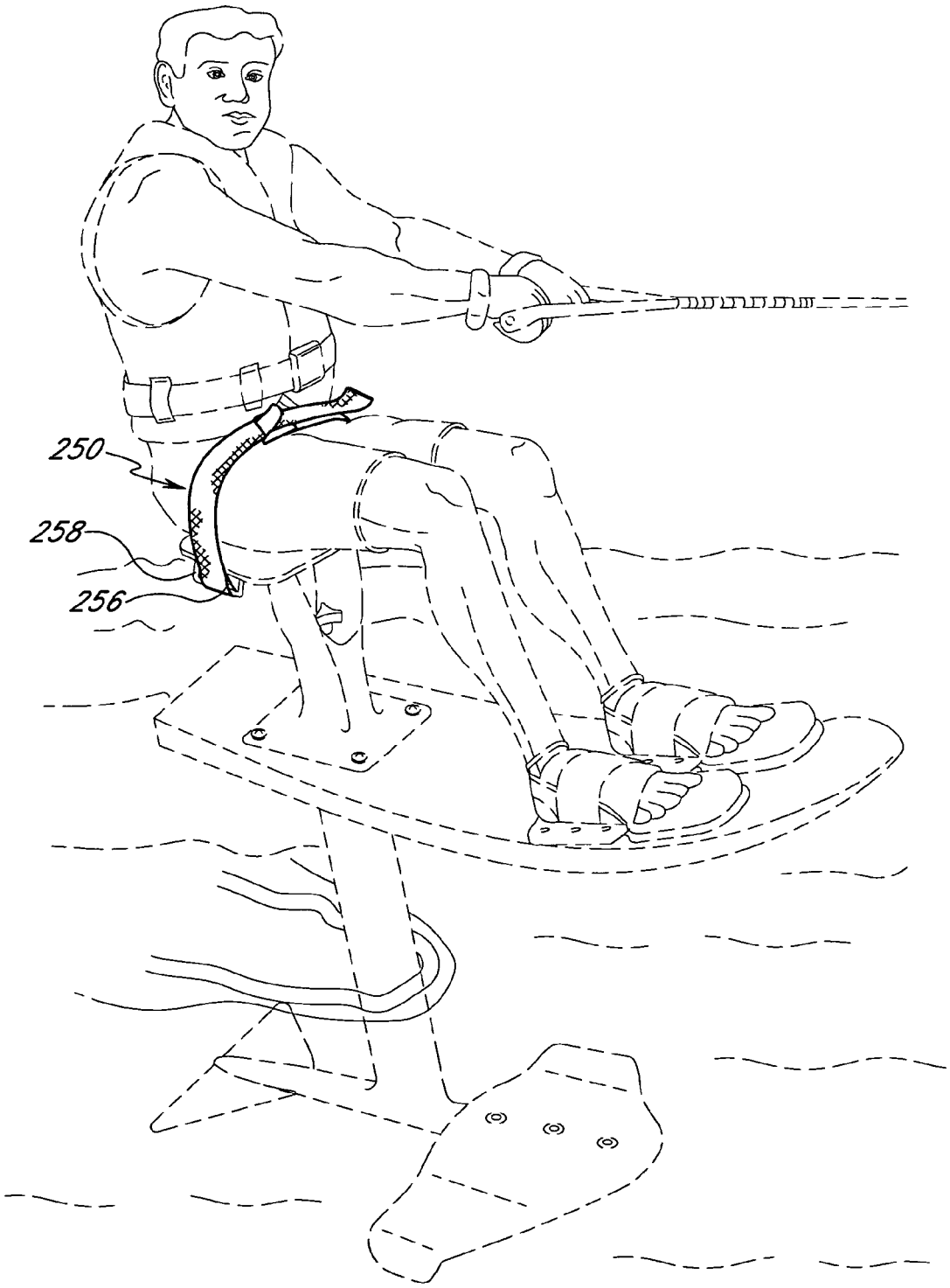
FIG. 23 is a perspective view of a rider atop the flying ski, with the safety belt secured about his lap.
Figure 24:
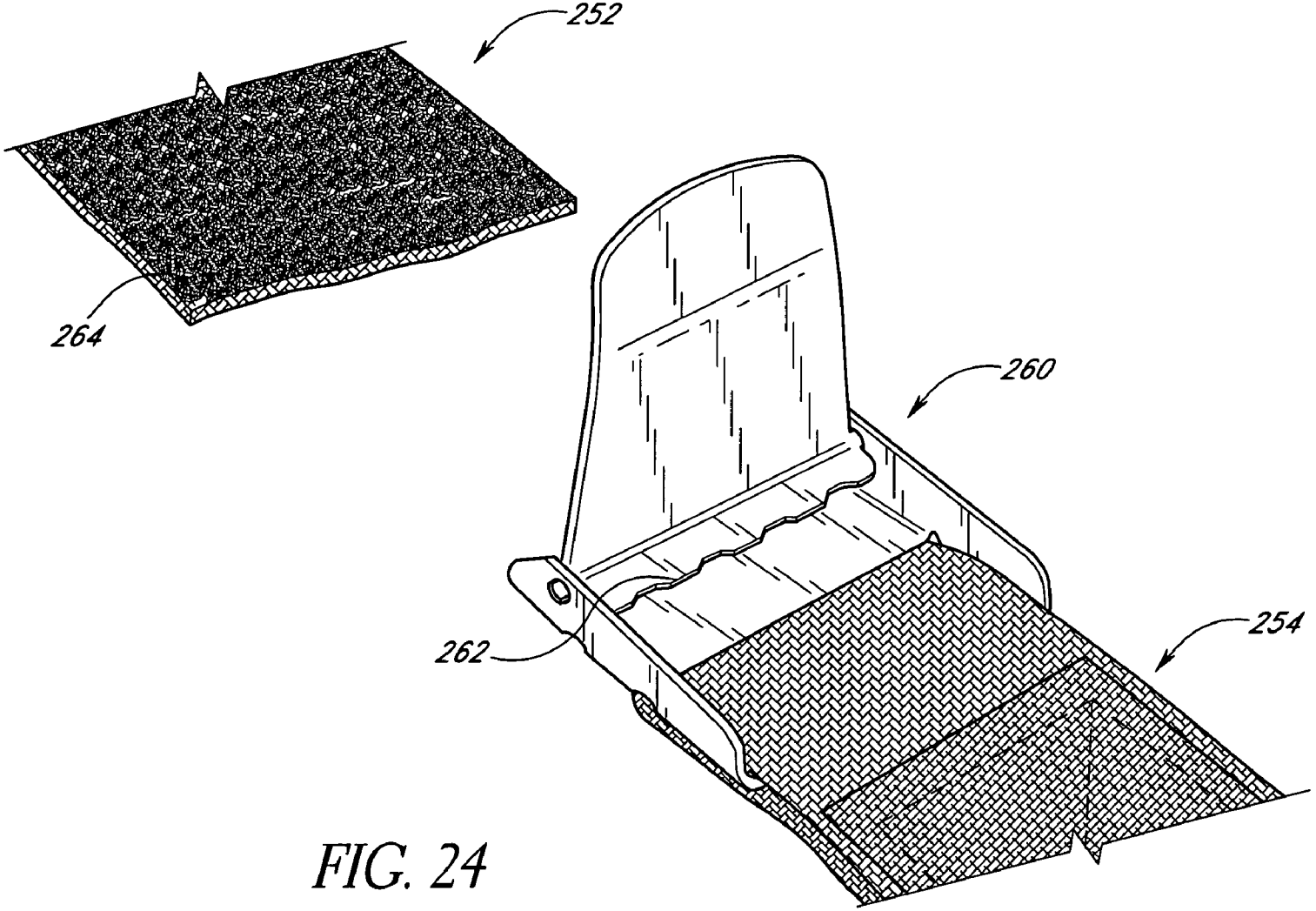
FIG. 24 is a perspective view of the buckle portion of the female strap of the safety belt and the mating end of the male strap.

As noted above, one aspect of the present flying ski is an improved safety belt 250, seen in combination with the flying ski and rider in FIG. 23. Referring to FIG. 24, the belt 250 is comprised of two straps, a male strap 252 and a female strap 254. Each strap has a loop 256 at one end that is adapted to be attached to the seat 50, as shown in FIG. 23. In one preferred embodiment, the loop 256 is formed by folding the end of the strap over and sewing the end to a portion of the strap adjacent to the end. The loop 256 is fastened to the seat 50 by detachable brackets 258. Each bracket 258 is connected at either end to the seat 50, and passes through the loop 256 of one strap of the belt 250, as shown in FIG. 23.

The female strap 254 has a clamp 260 attached to its end opposite the loop 256. The clamp 260, shown in detail in FIG. 24, has teeth 262 that are adapted to engage the male strap 252 when the clamp 260 is closed. To close the clamp 260, the lever 261 is rotated toward the male strap 252 until the teeth 262 engage, and lie substantially perpendicular to, the male strap surface 264.

Figure 25:
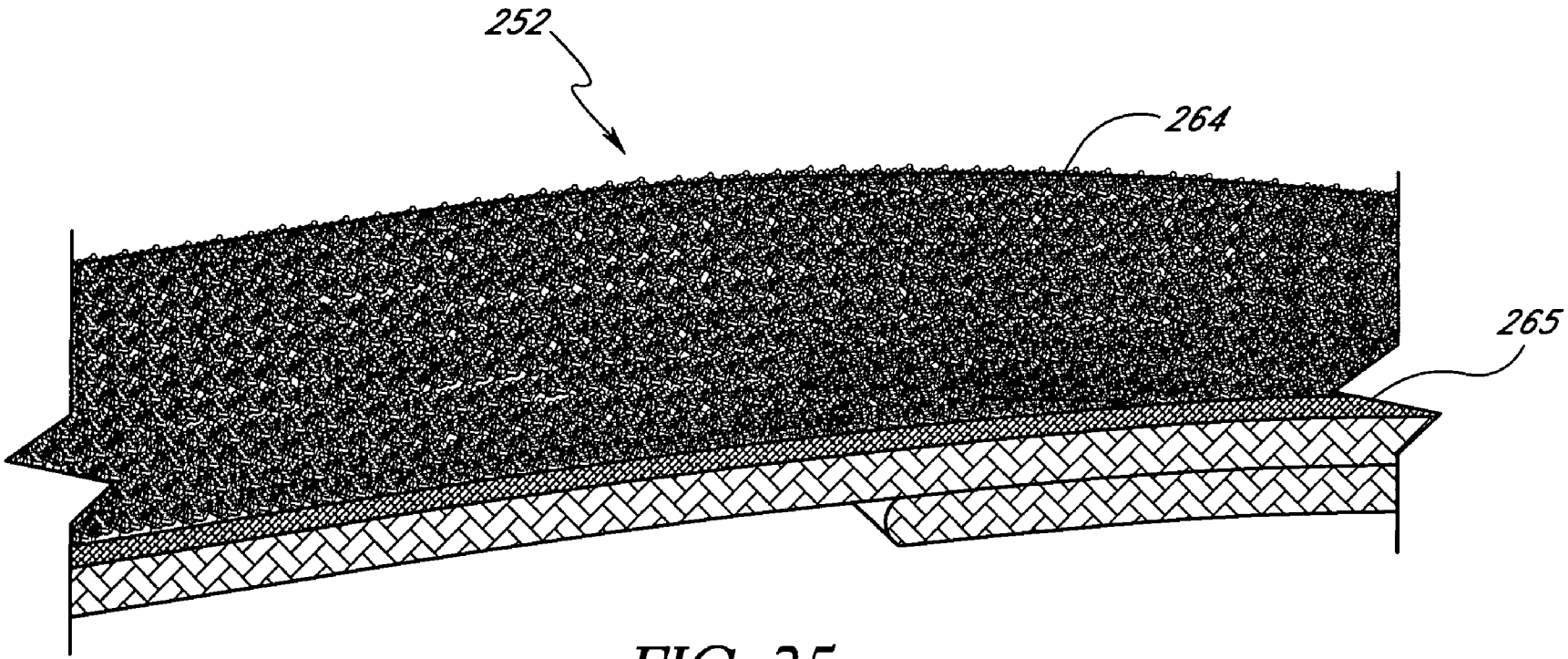
FIG. 25 is a detail view of the loop fiber surface of the male strap.

The male strap surface 264, shown in detail in FIG. 25, comprises a material consisting of a multitude of tightly packed loop fibers. Each loop fiber is attached at either end to a matrix 265. The length of the fiber in between forms a closed loop. When the material is first manufactured, substantially all fibers are closed loops. However, some loops break as the material wears. The matrix 265 is attached to a woven material core 271 having a high tensile strength. In a preferred embodiment, the matrix 265 comprises a single long strip that is secured to both sides of the core 271, wrapping around a free end 273 of the male strap as shown in FIG. 24.

Figure 26:
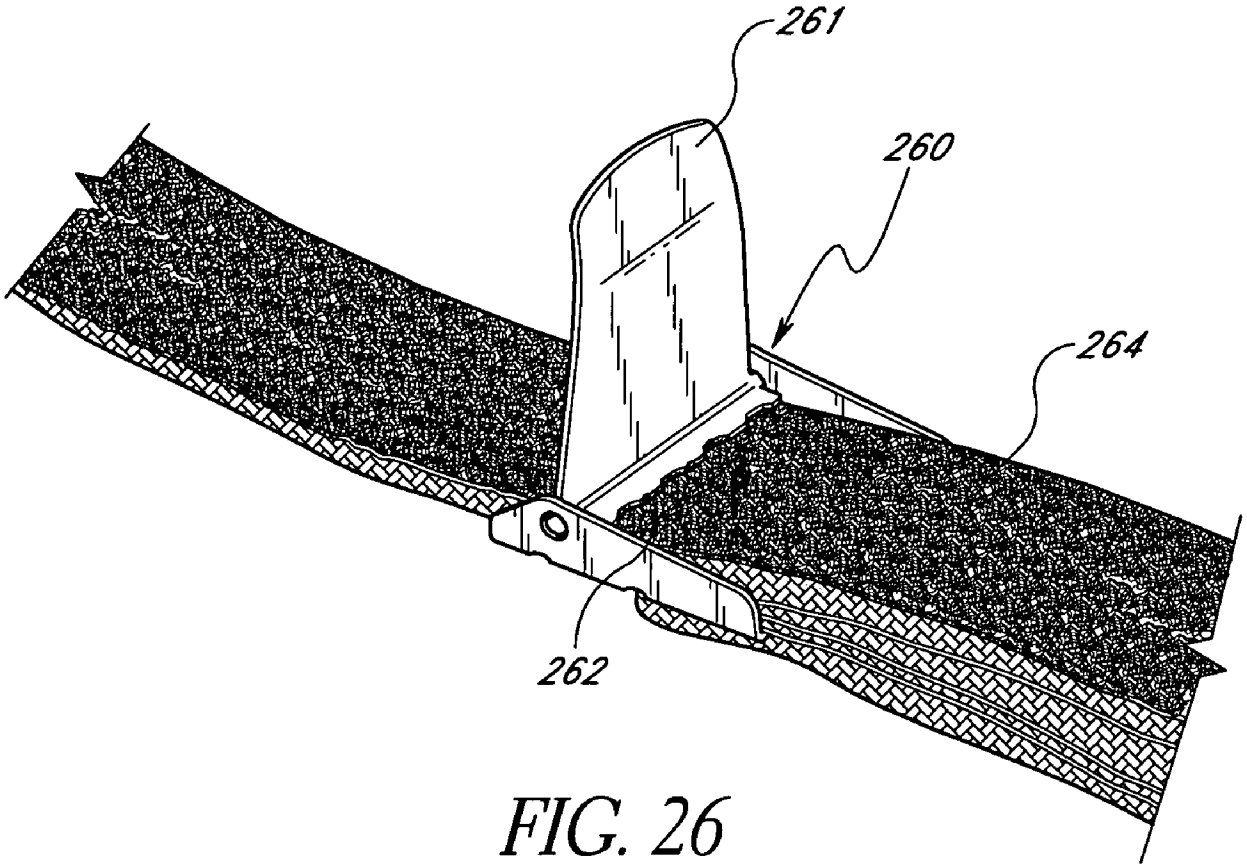
FIG. 26 is a perspective view of the intersection of the male and female straps of the safety belt, illustrating how the teeth of the buckle engage the loop fibers on the surface of the male strap.
Figure 27:
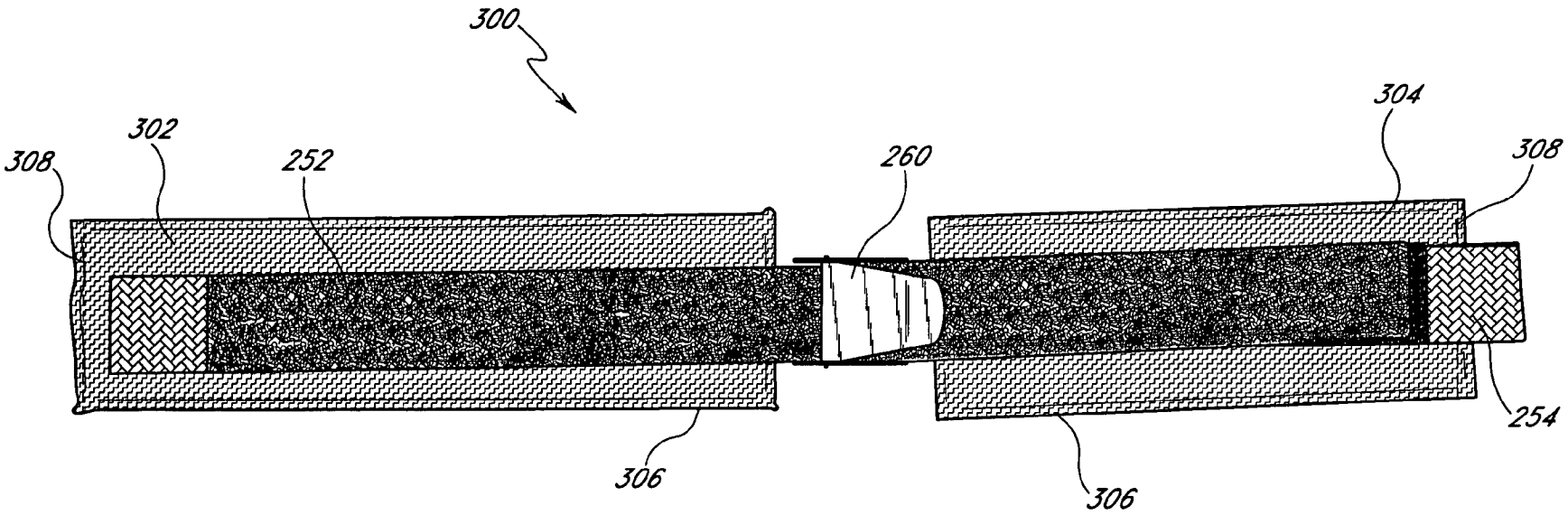
FIG. 27 is a top view of a preferred embodiment of the padded safety belt according to the present invention.

An upper surface 275 of the female strap 254 preferably includes a length of a hook portion 266 of a hook-and-loop fastener as shown in FIGS. 24 and 27. This portion 266 comprises a base material (not shown) having densely packed burrs 277 on one surface. Each burr 277 comprises a needle-like stalk that is fixed to the base material at one end, and includes a hook at the opposite end. Each burr 277 extends substantially perpendicularly away from the base material, so that when the hook portion 266 is pressed against the male strap surface 264, the burrs tend to become entangled with the loop fibers. Thus, when the male strap 252 and female strap 254 are pressed together as shown in FIG. 26, the two tend to stick together. Separating the two straps by sliding one along the surface of the other is very difficult. Thus, the strap configuration shown helps to prevent unwanted release of the safety belt 250. To remove the belt, the straps are easily separated by pulling their surfaces perpendicularly away from one another.

When the belt 250 is configured as in FIG. 26 and the clamp 260 is closed, its teeth 262 engage the loop fibers, some of which are attached to the matrix 265 on a first matrix portion 267 of the clamp 260, and some of which are attached to the matrix 265 on a second matrix portion 269 of the clamp 260. The first matrix portion 267 is defined as the portion of the matrix 265 toward which the clamp 260 moves when the belt 250 is tightened. The second matrix portion 269 is defined as the portion of the matrix 265 toward which the clamp 260 moves when the belt 250 is loosened. The border between the first portion 267 and second portion 269, is thus represented by the clamp teeth 262, and therefore changes as the belt 250 is adjusted.

It is believed that the loop fibers act as anchors, and are thus uniquely adapted to prevent the clamp teeth 262 from moving relative to the male strap 252 when the clamp 260 is closed. Some of those fibers that are attached to the matrix on the first portion 267 are believed to actually wrap around the teeth 262 and provide a pulling force tending to prevent the clamp 260 from advancing in a direction that would loosen the belt 250. Some of the fibers attached to the matrix on the second portion 269 provide a pushing force. The clamp teeth 262 abut a base portion of these fibers. For the clamp 260 to advance, it would either have to rise over the top of these fiber bases, or tear the fibers from the matrix. Since the clamp 260 is constrained from moving in a direction perpendicular to the surface of the belt 250, it cannot rise over the fiber bases. And tearing the fibers from the matrix would require a great deal of force. The reaction force of the fiber bases on the teeth 262 tends to prevent the teeth 262 from advancing along the belt 250.

The result of this unique engagement is a safety belt 250 that does not yield, even under extreme tensile force. Thus, the safety belt 250 increases the safety of the flying ski 10 by ensuring that rider and ski 10 are not separated by a hard landing or a crash. The safety belt 250 also increases the convenience of the flying ski 10 by eliminating the need for the rider to have to re-tighten the safety belt 250 during the middle of a run. Further, it prevents safety belt wear and the accompanying need to replace a worn-out safety belt.

Padded Safety Belt

As noted above, another aspect of the present flying ski 10 is a padded safety belt 300, pictured in FIGS. 27–33. The padded safety belt 300 is substantially identical to the safety belt 250 described above, including a male strap 252, a female strap 254 and a clamp 260. The padded safety belt 300 also includes first and second padded strips 302, 304. Those of skill in the art will appreciate that the first and second padded strips 302, 304 could be used with any safety belt. The padded strips 302, 304 provide a comfortable cushioning layer between the rider and the belt 250. The padded strips 302, 304 thus help to reduce the rate at which the rider fatigues, so that the rider can use the flying ski 10 for longer periods of time for increased enjoyment.

Figure 28:
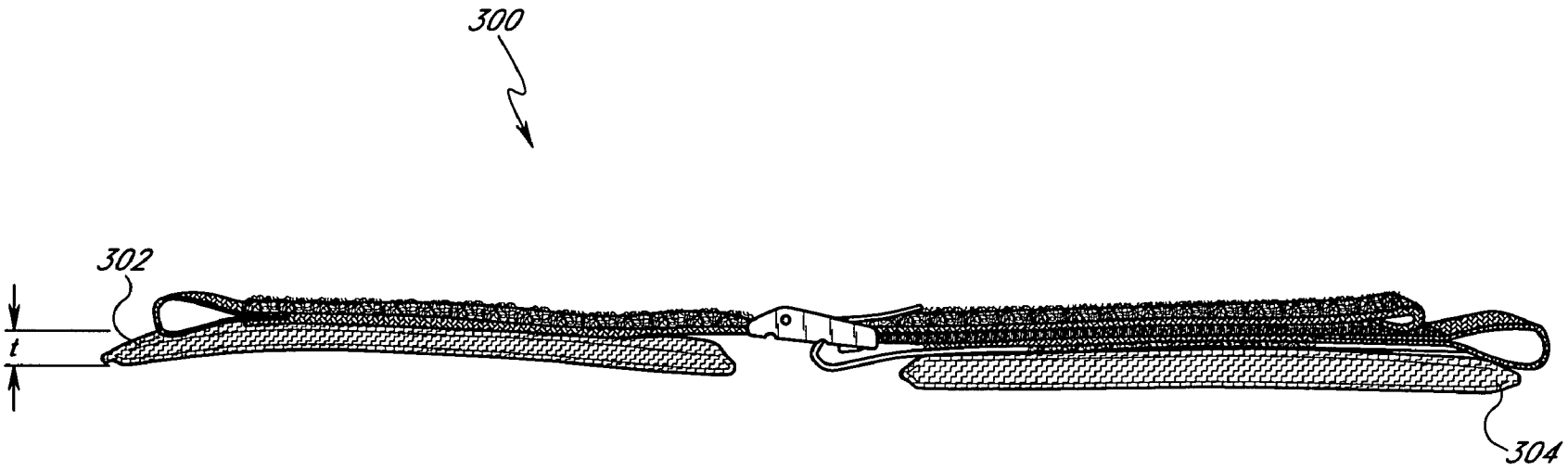
FIG. 28 is a top view of the padded safety belt of FIG. 27.

Each strip 302, 304 comprises a substantially rectangular length of resilient material having a thickness t (FIG. 28). In the illustrated embodiment, the first strip 302 is longer than the second strip 304. However, those of skill in the art will appreciate that both strips 302, 304 may have equal lengths, or the first strip 302 may be shorter than the second strip 304.

Rather than a single wide strip of material, the resilient material may comprise two or more parallel narrow strips. A preferred resilient material is dense foam. A durable cover 306 (FIGS. 27 and 31) preferably envelops the resilient material. The cover 306 preferably comprises a durable material such as nylon. Preferably, stitching 308 (FIGS. 27, 29 and 31) around the edges of the cover 306 permanently secures the cover 306 over the resilient material.

Preferably, a position of the padded strips 302, 304 on the safety belt 300 is adjustable. When the flying ski rider is an adult, the length of the male strap 252 that is inserted into the clamp 260 will be longer than when the flying ski rider is a child. Therefore, the optimal position of the padded strips 302, 304 on the straps 252, 254 will vary depending upon the size of the rider. Enabling the position of the padded strips 302, 304 upon the belt 300 to be adjustable allows each rider to optimize the position of the padded strips 302, 304 prior to riding in order to increase his or her comfort. Of course, those of skill in the art will appreciate that the padded strips 302, 304 may be permanently secured to the belt 300, as by stitching, for example.

Figure 30:
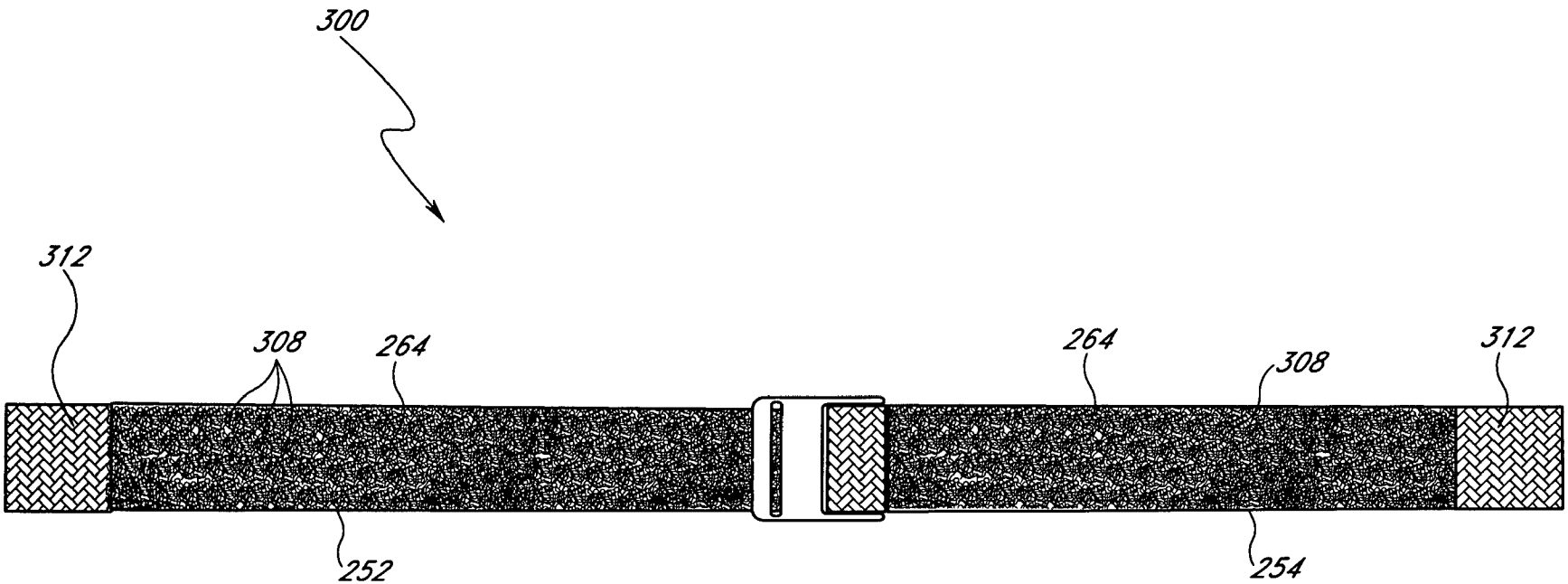
FIG. 30 is a bottom view of the padded safety belt of FIG. 27, illustrating the padded strips removed.
Figure 31:
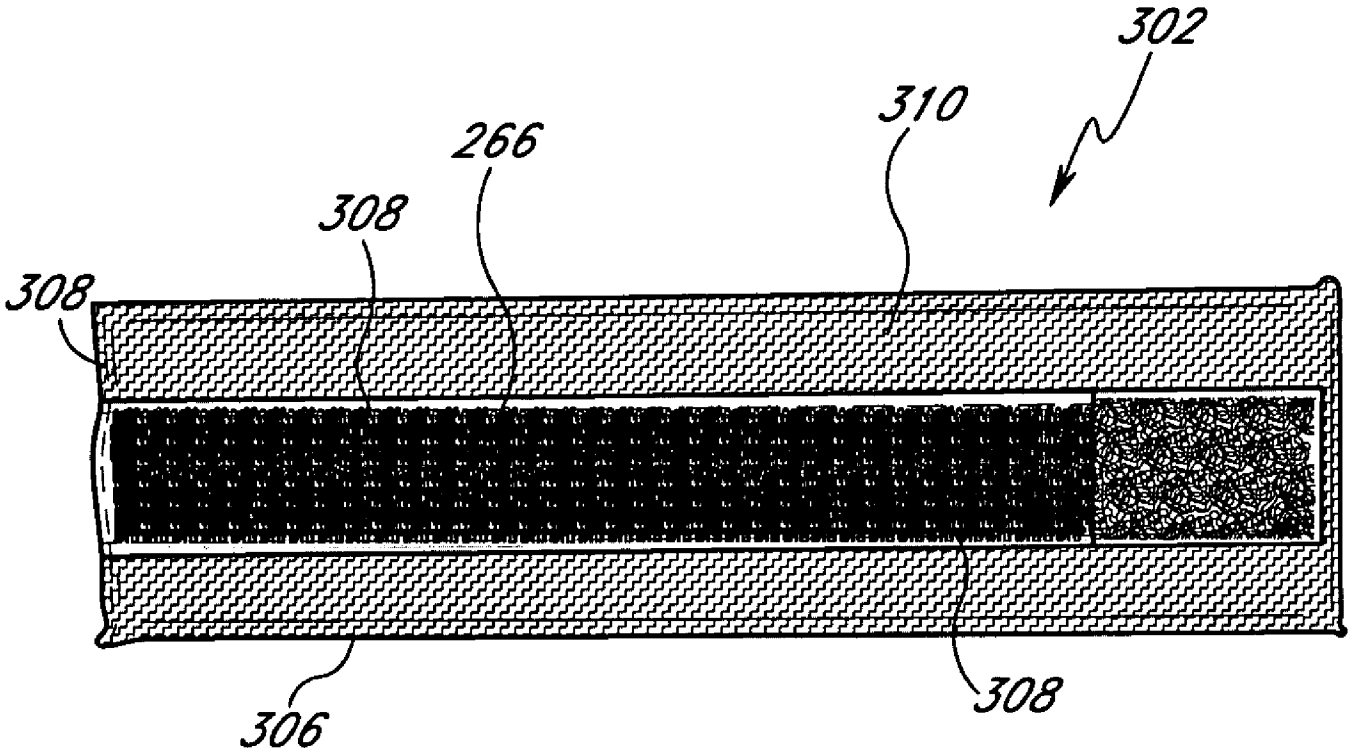
FIG. 31 is a top view of a padded strip of the padded safety belt of FIG. 27.

For adjustable attachment, preferably the strips 302, 304 and belt 300 include the hook-and-loop fastener 264, 266 described above. As shown in FIG. 31, an upper surface 310 of each of the first and second padded strips 302, 304 preferably includes a strip of the hook portion 266. The hook portion strip 266 is preferably attached along its edges by stitching 308. As shown in FIG. 30, a lower surface 312 of each of the male and female straps 252, 254 of the belt 300 preferably includes a strip of the loop portion 264. The loop portion strip 264 is also preferably attached along its edges by stitching 308, and may include transverse and diagonal stitching for added security. Those of skill in the art will appreciate that the padded strips 302, 304 may include the loop portion 264 and the belt 300 may include the hook portion 266.

Figure 29:
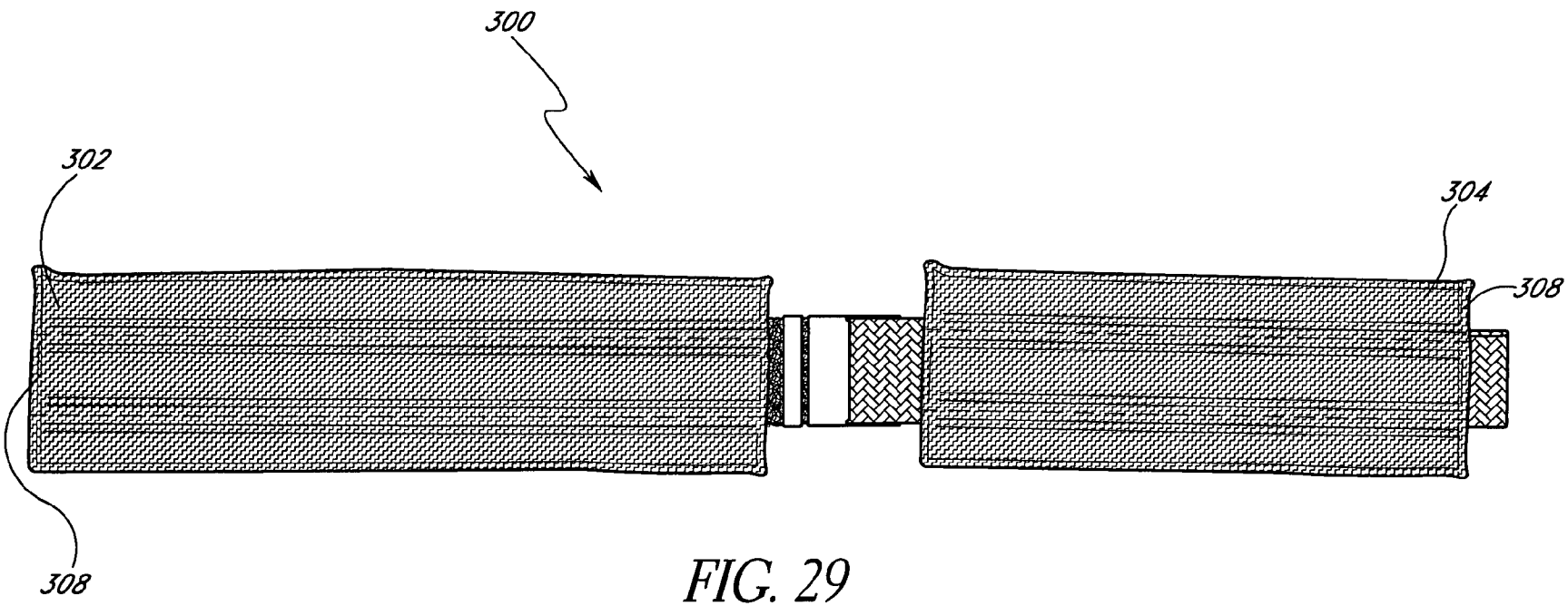
FIG. 29 is a bottom view of the padded safety belt of FIG. 27.

As shown in FIGS. 27–29, the hook-and-loop fastener on the padded strips 302, 304 cooperates with the hook-and-loop fastener on the belt 300 to adjustably secure the padded 302, 304 strips to the underside of the belt 300. To adjust a position of either strip 302, 304 with respect to the belt 300, the rider detaches the strip 302, 304 from the strap 252, 254 to which it is attached by manually pulling the strip 302, 304 and strap 252, 254 apart. The rider then moves the strip 302, 304 to the desired location along the strap 252, 254 and reattaches the strip 302, 304 to the strap 252, 254 by placing the hook and loop portions 264, 266 into contact with one another.

Figure 32:
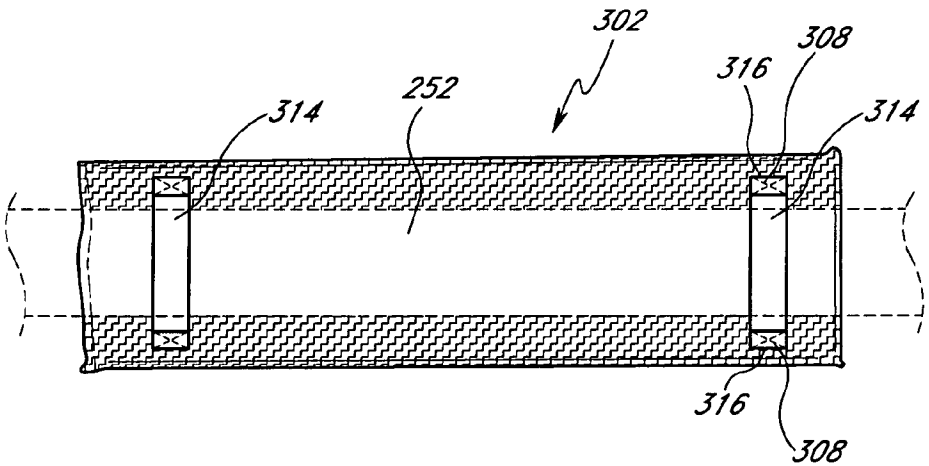
FIG. 32 is a top view of another preferred padded strip of the padded safety belt of FIG. 27.
Figure 33:
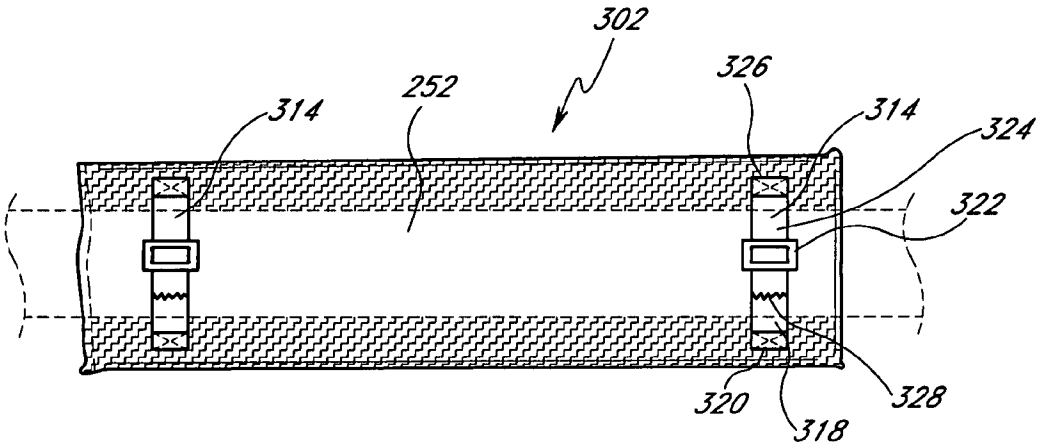
FIG. 33 is a top view of another preferred padded strip of the padded safety belt of FIG. 27.

Rather than providing hook and loop fastener, a variety of alternative methods could be used to adjustably secure the padded strips 302, 304 to the belt 300, as those of skill in the art will appreciate. For example, each strip 302, 304 may include one or more straps 314 that extend transversely across the strip 302, 304 as shown in FIGS. 32 and 33. Each strap 314 is preferably attached at either end 316 to the strip 302, 304 as by stitching 308. A strap 252, 254 is threadable through a gap between the strip 302, 304 and a central portion of the strap or straps 314. The strip 302, 304 is thus slidable along the length of the strap 252, 254 to the optimal position for rider comfort.

As shown in FIG. 33, each strap 314 may comprise a first segment 318 that is secured to the strip 302, 304 at a first end 320 and includes an attached buckle 322 at a second free end opposite the first end 320. A second segment 324 includes a first end 326 that is secured to the strip 302, 304 at a position spaced transversely across the strip 302, 304 from the attachment point of the first segment 318. A free end 328 of the second segment 324 is insertable through the buckle 322 such that the strap 314 can be tightened about the strap 252, 254, thus helping to secure the position of the strip 302, 304 along the strap 252, 254.

When the rider fastens the belt 300 around his or her waist, as described above, the padded strips 302, 304 provide a resilient layer between the belt 300 and the rider. The combination of the resilient padding material and the soft smooth cover 306 is much more comfortable to the rider than the stiff rough material of the straps 252, 254. The padded strips 302, 304 thus help to reduce chafing.

As the rider shifts position in the seat 30 in response to the movement of the flying ski 10, he or she bears against the safety belt 300. The resilient material of the padded strips 302, 304 absorbs some of the force exerted by the belt 300 upon the rider during these movements. Because the padded strips 302, 304 are preferably wider than the belt 300, the padded strips 302, 304 also help to distribute forces exerted by the belt 300 over a wider area of the rider's body. The padded strips 302, 304 thus lower the pressure exerted by the belt 300 upon the rider, increasing rider comfort.

Although this flying ski has been described in terms of a certain preferred embodiment and suggested possible modifications thereto, other embodiments and modifications apparent to those of ordinary skill in the art are also within the scope of this flying ski. It is also understood that various aspects of one or several embodiments or components can be used in connection with another or several embodiments or components. Accordingly, the scope of the flying ski is intended to be defined only by the claims that follow.

What is claimed is:

1. A recreational device that supports a seated human rider while the rider and the device are towed behind a powered watercraft, comprising:

an elongated board having a front end and a back end;

a seat portion extending upward from a top side of the board;

a strut extending downward from a bottom side of the board, the strut having a leading edge and a trailing edge, wherein a distance between the leading and trailing edges is greater along an upper portion of the strut than along a lower portion of the strut;

a fuselage mounted to a bottom end of the strut;

a front blade assembly provided along a front end portion of the fuselage; and a rear blade assembly provided along a rear end portion of the fuselage.

2. The recreational device of claim 1, wherein a distance between the leading and trailing edges increases at a constant rate along a length of the strut from the lower portion to the upper portion.

3. The recreational device of claim 1, wherein a distance between the leading and trailing edges reaches a maximum at a point along a length of the strut that generally corresponds to a position of the board.

4. A recreational device that supports a seated human rider while the rider and the device are towed behind a powered watercraft, comprising:

an elongated board having a front end and a back end;

a seat portion extending upward from a top side of the board;

a strut extending downward from a bottom side of the board, the strut having a leading edge and a trailing edge, wherein the leading and trailing edges are not parallel to one another;

a fuselage mounted to a bottom end of the strut;

a front blade assembly provided along a front end portion of the fuselage; and a rear blade assembly provided along a rear end portion of the fuselage.

5. The recreational device of claim 4, wherein the leading and trailing edges diverge along a length of the strut from the lower portion to the upper portion.

6. The recreational device of claim 5, wherein the leading and trailing edges reach a point of maximum divergence along a length of the strut that generally corresponds to a position of the board.

7. A recreational device that supports a seated human rider while the rider and the device are towed behind a powered watercraft, comprising:

an elongated board having a front end and a back end;

a seat portion extending upward from a top side of the board;

a strut extending downward from a bottom side of the board, the strut including an upper portion and a lower portion, a cross-section of the upper portion defining a greater area than a cross-section of the lower portion;

a fuselage mounted to a bottom end of the strut;

a front blade assembly provided along a front end portion of the fuselage; and a rear blade assembly provided along a rear end portion of the fuselage.

8. The recreational device of claim 7, wherein each cross-section defines a substantially oval shape.

9. The recreational device of claim 7, wherein the cross-section of the lower portion defines a minimum area adjacent the fuselage.

10. The recreational device of claim 7, wherein the cross-section of the upper portion defines a maximum area at a point along a length of the strut that generally corresponds to a position of the board.

* * * * *

UNITED STATES PATENT AND TRADEMARK OFFICE

CERTIFICATE OF CORRECTION

PATENT NO. : 7,097,523 B2
APPLICATION NO. : 11/129944
DATED : August 29, 2006
INVENTOR(S) : Robert C. Woolley It is certified that error appears in the above-identified patent and that said Letters Patent is hereby corrected as shown below:

On The Title page item 56

On page 1, column 2 at line 1 under OTHER PUBLICATIONS, please delete "Gallary," and insert -- Gallery, --, therefor;

On page 1, column 2 at line 1 under PRIMARY EXAMINER, please delete "Jesus" and insert -- Jesús --, therefor;

On page 2, column 1 at line 14 under U.S. PATENT DOCUMENTS, please delete "Folliett" and insert -- Follett --, therefor;

Column 18, line 6, please delete "1," and insert -- 11, --, therefor;

Column 27, line 15, please delete "corresponds" and insert -- correspond --, therefor.

Signed and Sealed this

Twentieth Day of February, 2007

JON W. DUDAS
*Director of the United States Patent and Trademark Office*